US006127998A

United States Patent [19]

Ichikawa et al.

[11] Patent Number: 6,127,998

[45] Date of Patent: Oct. 3, 2000

[54] MATRIX SUBSTRATE, LIQUID-CRYSTAL DEVICE INCORPORATING THE MATRIX SUBSTRATE, AND DISPLAY DEVICE INCORPORATING THE LIQUID-CRYSTAL DEVICE

[75] Inventors: Takeshi Ichikawa, Hachioji; Mamoru Miyawaki, Isehara; Katsumi Kurematsu, Hiratsuka; Osamu Koyama, Hachioji, all of Japan

[73] Assignee: Canon Kabushiki Kaisha, Tokyo, Japan

[21] Appl. No.: 08/953,725

[22] Filed: Oct. 17, 1997

[30] Foreign Application Priority Data

Oct. 18, 1996 [JP] Japan ..... 8-276530
Oct. 13, 1997 [JP] Japan ..... 9-279011

[51] Int. Cl.[7] ..... G09G 3/36

[52] U.S. Cl. ..... 345/100

[58] Field of Search ..... 345/50, 87, 90–92, 345/94, 98, 100, 204; 349/8; 340/719

[56] References Cited

U.S. PATENT DOCUMENTS

| | | | |
|---|---|---|---|
| 4,724,433 | 2/1988 | Inoue et al. | 345/208 |
| 4,746,915 | 5/1988 | Sekiya | 340/719 |
| 4,981,340 | 1/1991 | Kurematsu et al. | 350/333 |
| 5,170,158 | 12/1992 | Shinya | 345/98 |
| 5,218,232 | 6/1993 | Yuzurihara et al. | 257/754 |
| 5,250,931 | 10/1993 | Misawa et al. | 345/206 |
| 5,251,050 | 10/1993 | Kurematsu et al. | 359/57 |
| 5,264,953 | 11/1993 | Hirai et al. | 359/55 |
| 5,340,978 | 8/1994 | Rostoker et al. | 250/208.1 |
| 5,412,240 | 5/1995 | Inoue et al. | 257/347 |
| 5,434,441 | 7/1995 | Inoue et al. | 257/347 |
| 5,532,712 | 7/1996 | Tsuda et al. | 345/87 |
| 5,644,373 | 7/1997 | Furushima et al. | 349/158 |
| 5,706,021 | 1/1998 | Kurematsu | 345/89 |
| 5,717,473 | 2/1998 | Miyawaki | 349/43 |
| 5,726,719 | 3/1998 | Tanaka et al. | 349/8 |
| 5,754,158 | 5/1998 | Misawa et al. | 345/100 |
| 5,808,595 | 9/1998 | Kubota et al. | 345/92 |
| 5,850,203 | 12/1998 | Yamazaki et al. | 345/94 |

FOREIGN PATENT DOCUMENTS

| | | |
|---|---|---|
| 0 495 428 | 7/1992 | European Pat. Off. . |
| 0 689 086 | 12/1995 | European Pat. Off. . |
| 59-133590 | 7/1984 | Japan . |
| 2050668 | 1/1981 | United Kingdom . |

OTHER PUBLICATIONS

S.M. Fluxman, "Integrated Active Matrix Liquid Crystal Displays", The GEC Journal of Research 11 (1993) No. 1, Chelmsford, Essex, G.B.

Asada et al., "A 2.7 in. 1.3M Pixel Driver–Integrated Poly–Si TFT–LCD for Multimedia Projectors", IEEE International Solid State Circuits Conference, vol. 39, Feb. 1996, p. 190/191.

Rycke et al., "2–MHz Clocked LCD Drivers On Glass", IEEE Journal of Solid–State Circuits, 25 (1990) Apr., No. 2, New York, U.S., pp. 531–538.

*Primary Examiner*—Vijay Shankar
*Assistant Examiner*—Jeff Piziali
*Attorney, Agent, or Firm*—Fitzpatrick, Cella, Harper & Scinto

[57] ABSTRACT

A matrix substrate comprises a plurality of pixel electrodes arrayed in a matrix pattern, a plurality of switching elements connected to the pixel electrodes, a plurality of signal lines for supplying video signals to the plurality of switching elements, a plurality of scanning lines for supplying scanning signals to the plurality of switching elements, a horizontal driving circuit for supplying the video signals to the plurality of signal lines, and a vertical driving circuit for supplying the scanning signals to the plurality of scanning lines, wherein the horizontal driving circuit is comprised of a dynamic type circuit and the vertical driving circuit is comprised of a static type circuit.

31 Claims, 36 Drawing Sheets

FIG. 12A
FIG. 12B
FIG. 12C
FIG. 12D
FIG. 12E
FIG. 12F
FIG. 12G
FIG. 12H
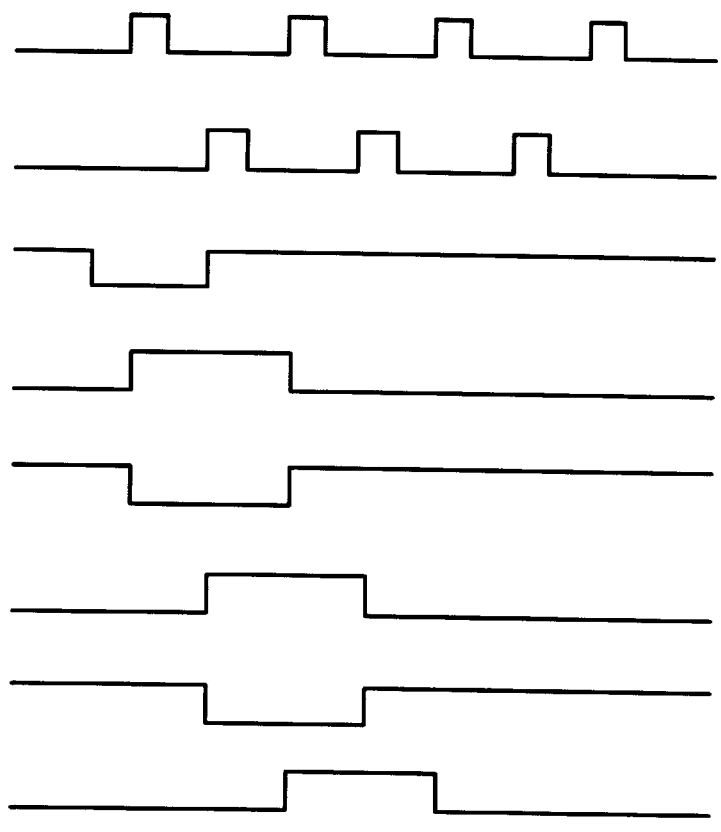
FIG. 13
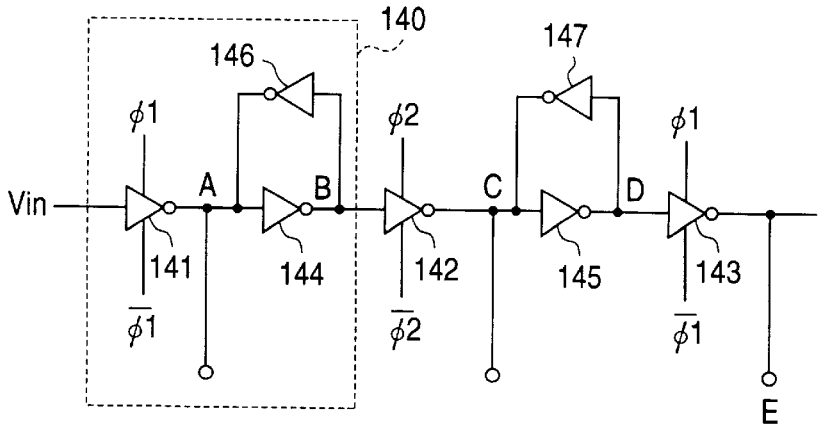

| | | | | | | | | | | | |
|---|---|---|---|---|---|---|---|---|---|---|---|
| R | G | B | R | G | B | R | G | B | R | G | B |
| R | G | B | R | G | B | R | G | B | R | G | B |
| R | G | B | R | G | B | R | G | B | R | G | B |
| R | G | B | R | G | B | R | G | B | R | G | B |
| R | G | B | R | G | B | R | G | B | R | G | B |

MATRIX SUBSTRATE, LIQUID-CRYSTAL DEVICE INCORPORATING THE MATRIX SUBSTRATE, AND DISPLAY DEVICE INCORPORATING THE LIQUID-CRYSTAL DEVICE

BACKGROUND OF THE INVENTION

1. Field of the Invention

The present invention relates to a matrix substrate, a liquid-crystal device for displaying images and letters by use of the matrix substrate and liquid crystal, and a display device incorporating the liquid-crystal device. More particularly, the invention concerns a liquid-crystal device and a display device characterized by a horizontal driving circuit and a vertical driving circuit for driving liquid-crystal elements.

2. Related Background Art

As the world moves into the multimedia age nowadays, devices for communications by image information are increasing their importance. Among others, liquid-crystal display devices are drawing attention because of their small thicknesses and low consumption power and have grown to one of basic industries, as comparable to semiconductors. The liquid-crystal display devices are now used mainly in 10-inch size notebook personal computers. It is to be expected that the liquid-crystal display devices of larger screen sizes will be used not only for the personal computers, but also for workstations and home-use televisions in the future. With increase in the screen size, however, manufacturing equipment will become more expensive and electrically severe characteristics will be demanded for driving the large screen. Therefore, with increase in the screen size, the manufacturing cost will rapidly increase in proportion to the square to the cube of the size.

Under such circumstances, attention is focused recently on a projection method for fabricating a compact liquid-crystal display panel and optically enlarging a liquid-crystal image to display it. The reason is that the decrease of size can improve the characteristics and also decrease the cost, similar to the scaling law that the performance and cost are improved with compactification of semiconductor. From these points, when the liquid-crystal display panel is of a so-called active matrix type wherein a TFT (Thin Film Transistor) is provided for each pixel, compact TFTs having sufficient driving force are necessary and a trend is to move from amorphous Si TFTs to polycrystalline Si TFTs. Video signals of the resolution level according to the NTSC standards adopted in the ordinary televisions do not require so quick processing.

Therefore, the liquid-crystal display devices can be fabricated in the integral structure incorporating the display area and peripheral driving circuits by making not only the TFTs, but also even the peripheral driving circuits such as shift registers or decoders of polycrystalline Si. However, since polycrystalline Si is inferior to monocrystalline Si, in order to realize high-definition televisions of a higher resolution level than in the NTSC standards or displays of the XGA (extended Graphics Array) or SXGA (Super extended Graphics Array) class in the resolution standards of computer, a plurality of separate shift registers must be provided. In this case, there appears noise called ghost in display areas corresponding to borders of separation and desires to solve the problem exist in this field.

On the other hand, attention is also focused on the display devices of the monocrystalline Si substrate achieving extremely high driving force, rather than the display devices of the integral structure of polycrystalline Si. In this case, the driving force of transistor by the peripheral driving circuits is sufficient and thus the separate driving as described above is not necessary. This solves the problem of the noise.

With use of either of these polycrystalline Si and monocrystalline Si, a reflection type liquid-crystal device can be provided in such a way that reflection type liquid-crystal elements are formed by connecting the drains of TFTs with reflecting electrodes and interposing the liquid crystal between the reflecting electrodes and a transparent common electrode and that horizontal and vertical shift registers for scanning of the liquid-crystal elements are formed on the same semiconductor substrate.

Under such circumstances, a driving circuit for liquid-crystal device that can decrease the consumption power of active matrix liquid-crystal device was proposed as disclosed in Japanese Laid-open Patent Application No. 59-133590 (JPA 59-133590). This JPA 59-133590 discloses the driving circuit wherein a signal line driving circuit for selection of signal line is composed of plural shift registers and wherein a selecting circuit for selecting and applying two clock signals is provided for each shift register and describes use of dynamic shift registers as the shift registers.

It is described that this invention can decrease the consumption power by supplying low-frequency clocks to the most shift registers and can expectedly achieve increase of yield by use of the dynamic shift registers.

However, when the signal line driving circuit is constructed of the plurality of separate shift registers, the fact is that this arrangement is not completely free of occurrence and instability of the noise called the ghost discussed above. The JPA 59-133590 omits investigation on configurations of the both signal line driving circuit and scanning line driving circuit for liquid-crystal devices ready for high resolutions and many pixels, based on total consideration of the area of a chip in which the pixels and driving circuits are made, the consumption power, and reliability.

SUMMARY OF THE INVENTION

An object of the present invention is to provide a liquid-crystal device having scanning circuits of low consumption power, of small chip area, with high reliability, and with high freedom, by solving the above problems in the case of use of the shift registers as the scanning circuits of the peripheral circuits (driving circuits) in the liquid-crystal device.

Another object of the present invention is to provide a matrix substrate comprising a plurality of pixel electrodes arrayed in a matrix pattern, a plurality of switching elements connected to the pixel electrodes, a plurality of signal lines for supplying video signals to the plurality of switching elements, a plurality of scanning lines for supplying scanning signals to said plurality of switching elements, a horizontal driving circuit for supplying the video signals to said plurality of signal lines, and a vertical driving circuit for supplying the scanning signals to said plurality of scanning lines, wherein said horizontal driving circuit is comprised of a dynamic type circuit and said vertical driving circuit is comprised of a static type circuit.

Still another object of the present invention is to provide a liquid-crystal device comprising:

a matrix substrate having a plurality of pixel electrodes arrayed in a matrix pattern, a plurality of switching elements connected to the pixel electrodes, a plurality of signal lines for supplying video signals to the plurality of switching elements, a plurality of scanning lines for supplying scanning signals to said plurality of switching elements, a horizontal driving circuit for supplying the video signals to said plurality of signal lines, and a vertical driving circuit for supplying the scanning signals to said plurality of scanning lines; and a liquid-crystal material disposed between said matrix substrate and an opposed substrate opposed thereto;

wherein said horizontal driving circuit is comprised of a dynamic type circuit and said vertical driving circuit is comprised of a static type circuit.

Since the present invention selectively employs the dynamic and static type circuits as the driving circuits for horizontal driving and for vertical driving of the reflection type liquid-crystal elements, it can present such various effects that the driving circuits are optimized, that the chip size of the liquid-crystal display device is decreased, that the consumption power is low, that the reliability is high, and that the freedom of design is high.

BRIEF DESCRIPTION OF THE DRAWINGS

FIGS. 12A, 12B, 12C, 12D, 12E, 12F, 12G and 12H are timing charts of the dynamic shift register applicable to the liquid-crystal panel according to the present invention;

FIG. 13 is a circuit diagram of a static shift register applicable to the liquid-crystal panel according to the present invention;

FIGS. 25A, 25B, 25C, 25D and 25E are absent);

DETAILED DESCRIPTION OF THE PREFERRED EMBODIMENTS

The matrix substrate and the liquid-crystal device according to the present invention have the respective configurations as described above.

For easy understanding of the present invention, a reference example and embodiments thereof will be described below. It is, however, noted that the present invention is by no means intended to be limited to only the embodiments described herein.

Reference Example

Figure 1:
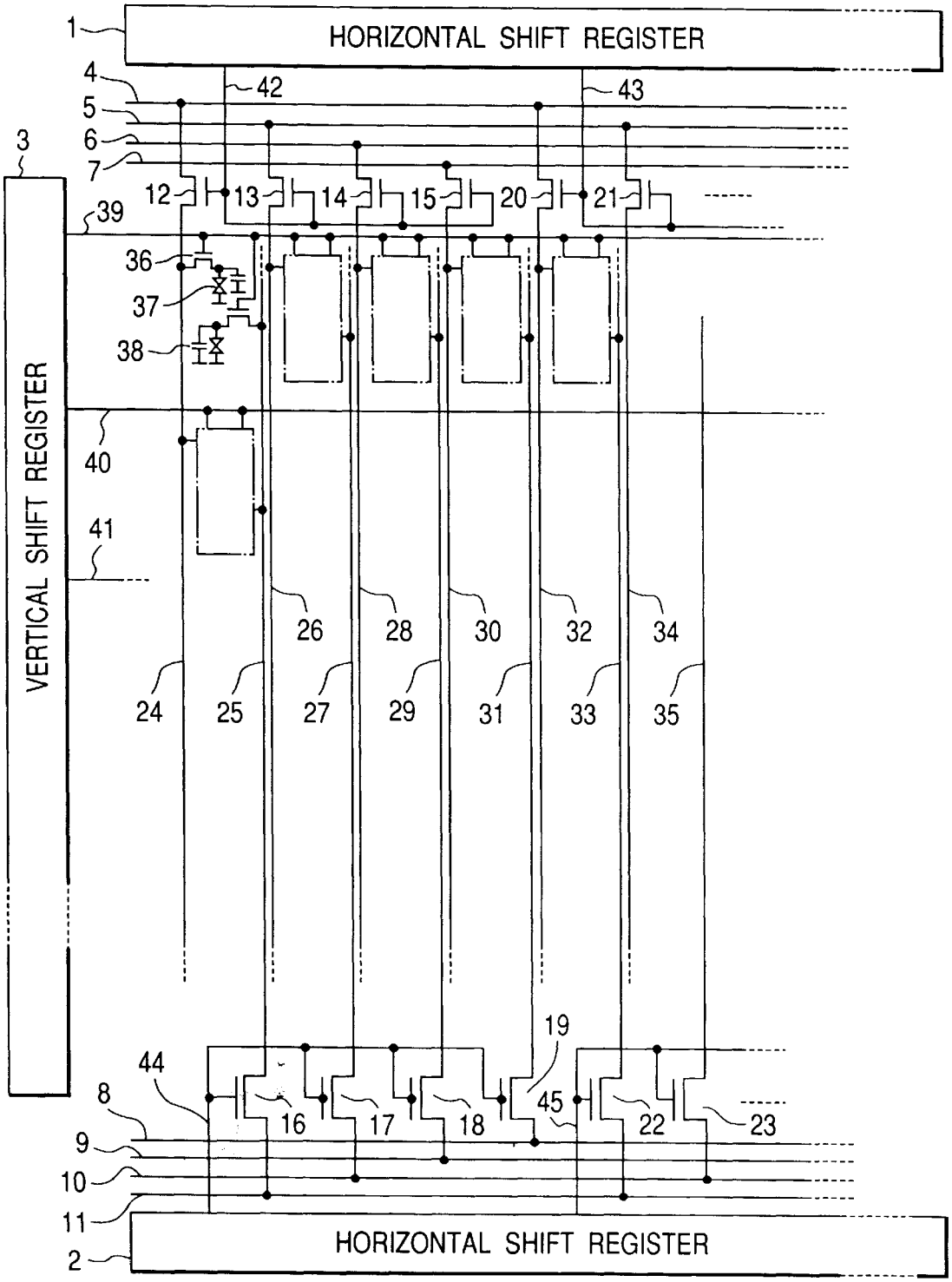
FIG. 1 is a circuit diagram to show the driving circuits of a liquid-crystal panel as a reference example of the present invention.
Figures 2A, 2B, 2C, 2D, 2E, 2F, 2G, 2H:
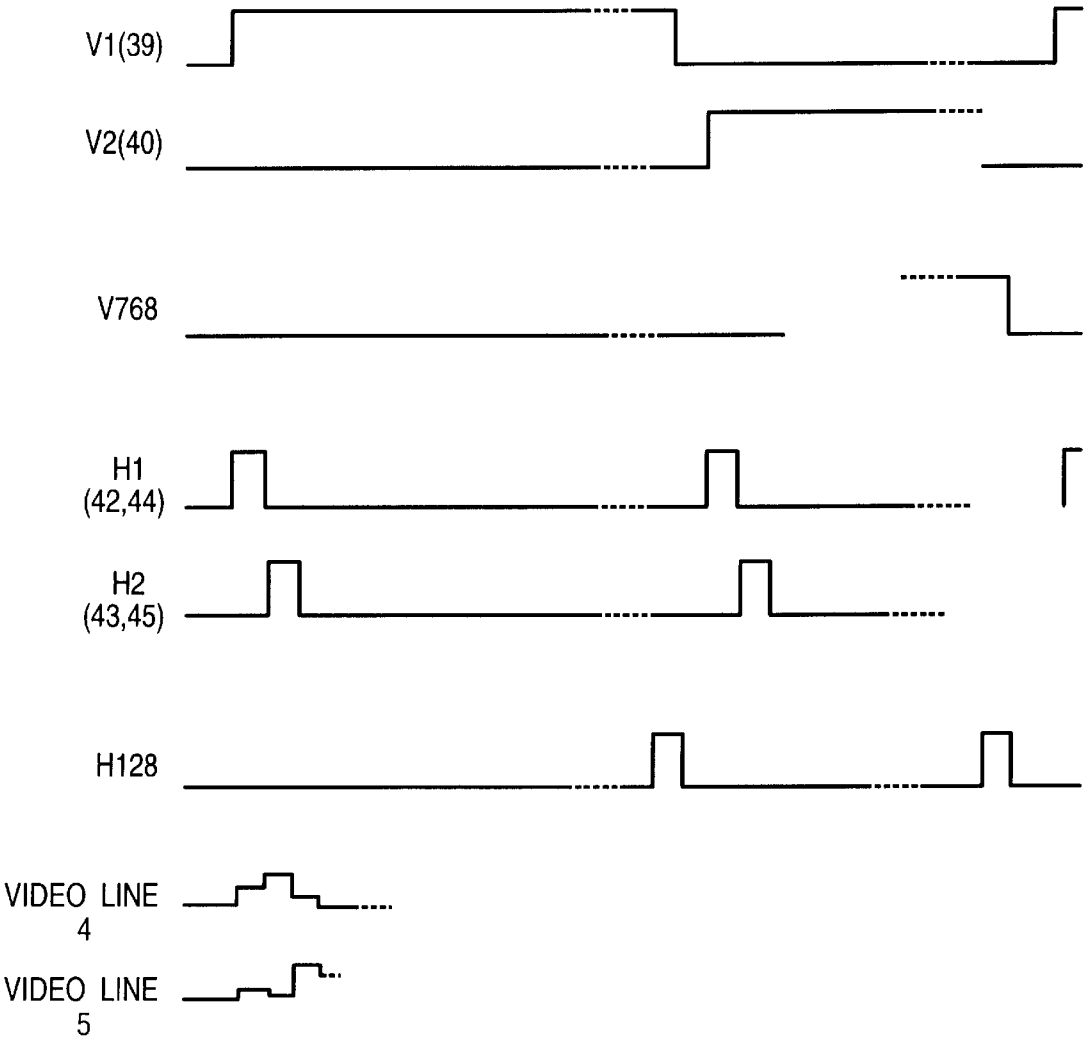
FIGS. 2A, 2B, 2C, 2D, 2E, 2F, 2G and 2H are timing charts of the driving circuits of the liquid-crystal panel as a reference example of the present invention.

The reference example of the present invention will be described using FIG. 1. FIG. 1 is a circuit diagram of the liquid-crystal panel in this example. The driving method of this liquid-crystal panel will be described. In the drawing, reference numerals 1, 2 designate horizontal shift registers (horizontal driving circuit), 3 a vertical shift register (vertical driving circuit), 4 to 11 video lines for video signals, 12 to 23 sampling MOS transistors for sampling the video signals in accordance with scanning pulses from the horizontal shift registers, 24 to 35 signal lines to which the video signals are supplied, 36 a switching MOS transistor for TFT in the pixel section, 37 a liquid crystal interposed between the pixel electrode and the common electrode, and 38 an additional capacitor attendant on the pixel electrode. Numerals 39, 40, 41 denote driving lines for horizontal scanning output of the vertical shift register 3, and 42 to 45 output lines for vertical scanning from the horizontal shift registers 1, 2.

In this circuit, the input video signals are sampled through the sampling MOS transistors 12 to 23 by vertical scanning control signals 42 to 45 of the horizontal shift registers. Supposing the horizonal scanning control signal 39 of the vertical shift register is in the output state, the pixel section switching MOS transistor 36 will become on, whereby a potential of the signal line sampled will be written in the pixel. The detailed timing will be described referring to FIGS. 2A to 2H. The timing will be described with an XGA panel in which the number of pixels of liquid-crystal panel is 1024×768.

First, the driving line 39 of the horizontal scanning output of the vertical shift register 3 turns to the high level (H); that is, the pixel transistor 36 becomes on. During that period outputs of the horizontal shift registers represented by numerals 42 to 45 successively turn to the high level (H) to turn the sampling MOS transistors 12 to 23 on, whereby potentials of the video lines 4 to 11 are written through the signal lines into the pixels. The potentials are kept in the additional capacitors 38. In this circuit each of the output lines 42 to 45 from the horizontal shift registers 1, 2 is connected to four sampling MOS transistors 12 to 15, 16 to 19, . . . , and the output lines 42 and 44 from the respective horizontal shift registers 1, 2 simultaneously turn to the high level. Therefore, the sampling MOS transistors 12 to 19 are simultaneously brought into the sampling state, so that eight pixels are simultaneously subjected to writing through the respective video signal lines 4 to 11. The horizontal shift registers 1, 2 have 1024/8=128 stages. After completion of the 128th stage, the driving line 39 of the vertical shift register 3 is turned off. Then the driving line 40 from the vertical shift register 3 is turned to the high level and the output lines 42 to 45 of the horizontal shift registers 1, 2 are again successively turned to the high level (H). This operation is repeated. In the present embodiment, for suppressing flicker of image, the driving was conducted at a speed twice greater than the normal writing speed and writing was carried out twice for the all pixels during the period of 1/75 sec at the vertical synchronizing frequency 150 Hz. At this time, an on period of the vertical shift register 3 is approximately 6.5 μsec, while an on period of the horizontal shift registers 1, 2 is approximately 50 nsec.

Figure 3:
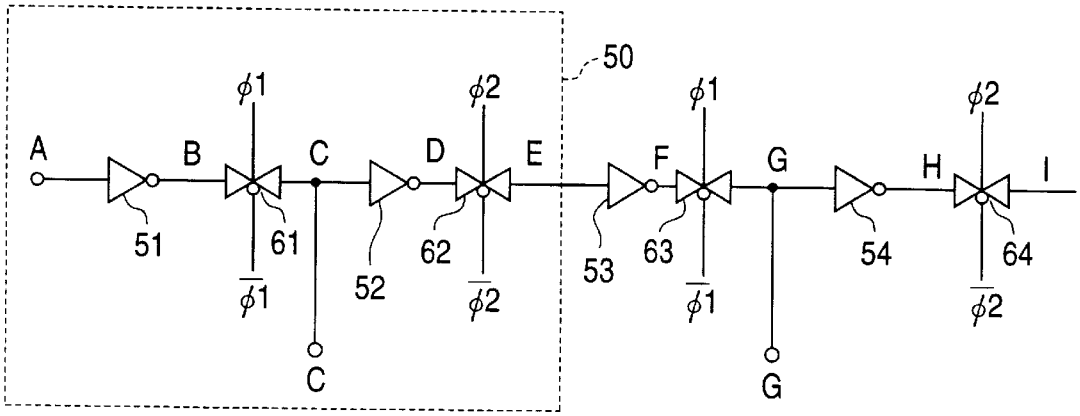
FIG. 3 is a circuit diagram of a dynamic shift register applicable to the liquid-crystal panel.

The horizontal shift register circuit 1, 2 will be described below. FIG. 3 shows an example of the horizontal shift register circuit of this example. This example is a dynamic shift register composed of CMOS inverters 51 to 54 and transfer gates 61 to 64 of CMOS. An enclosed portion 50 represents a basic unit of the shift register, which represents one stage. FIGS. 4A to 4I are timing charts of the horizontal shift register circuit, which show waveforms at respective points B to G with input of A in synchronization with control clocks $\phi 1$, $\phi 2$ of the transfer gates 61 to 64. As illustrated, outputs are propagated successively. In this example the parts indicated by C, G are output sections, which are connected to the gates of the sampling MOS transistors 12 to 23 shown in FIG. 1 (the waveforms of H1, H2 shown in FIGS. 2D and 2E correspond to the output waveforms of C, G). In the dynamic shift register, the node of C becomes a floating node after fall of the control clock $\phi 1$ and is kept at a constant potential mainly by a gate capacitance of the next stage. Accordingly, this configuration has the problem that if the leak level is high or if the floating period is long, incorrect data will be transferred with failing to propagate to the next terminal.

Figure 5:
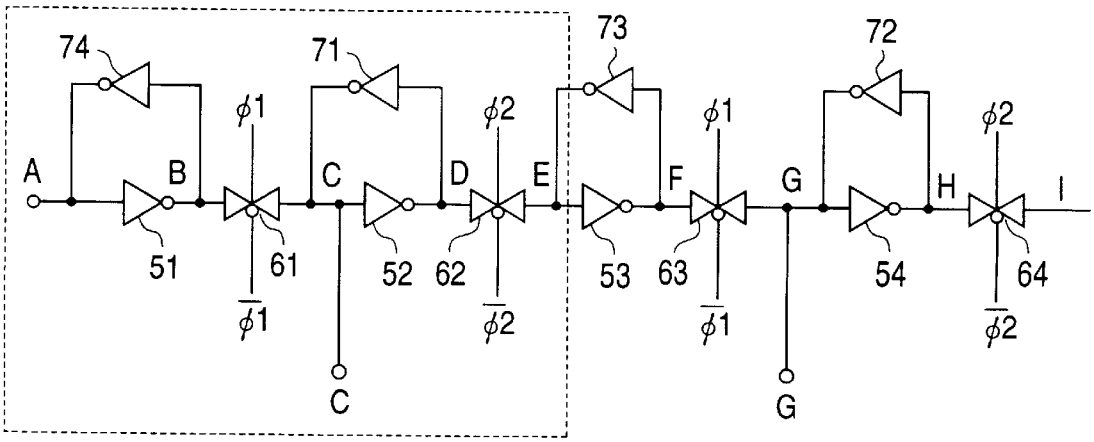
FIG. 5 is a circuit diagram of a static shift register applicable to the liquid-crystal panel.
Figures 4A, 4B, 4C, 4D, 4E, 4F, 4G, 4H, 4I:
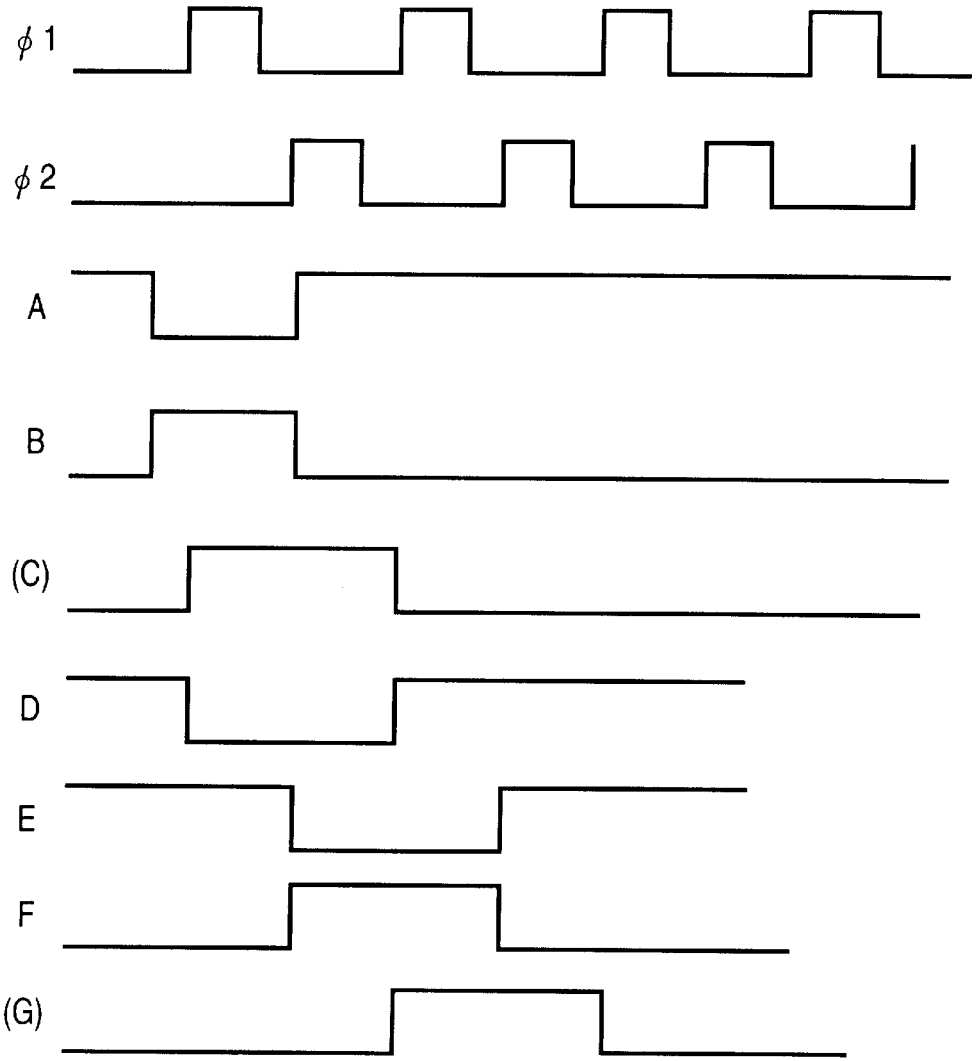
FIGS. 4A, 4B, 4C, 4D, 4E, 4F, 4G, 4H and 4I are timing charts of the dynamic shift register applicable to the liquid-crystal panel.
Figures 6A, 6B, 6C, 6D, 6E:
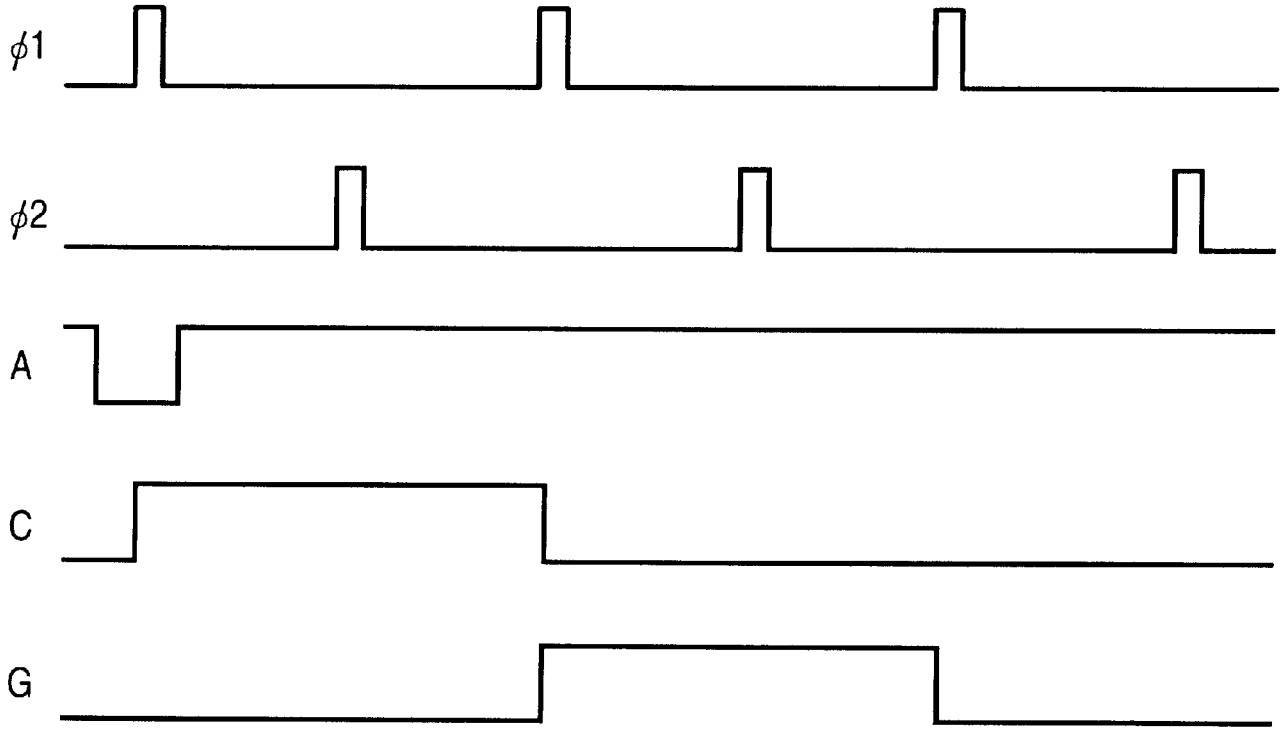
FIGS. 6A, 6B, 6C, 6D and 6E are timing charts of a dynamic shift register applicable to the liquid-crystal panel.

If inverters of numerals 71, 72 and 73, 74 are added as shown in FIG. 5, a stable circuit configuration of a static type can be realized without the floating nodes; but this configuration requires transistors 1.5 times those of the dynamic type. This means that the chip area increases and the consumption power also increases. The increase of chip area is not preferred, because it results in decrease in yield and increase in cost. In the present example the horizontal and vertical shift registers both are formed in the dynamic type shown in FIG. 3.

The horizontal shift registers will be discussed first. Since the operation is quick with the floating period of the horizontal shift registers being 50 nsec or less as shown in FIGS. 4A to 4I, the shift registers are made of the CMOS circuits being capable of operating at high speed and less in leak current. The gate capacitance of the next stage is approximately 10 fF.

In this circuit configuration, supposing the voltage drop is 1 V, t=50 nsec, and C=10 fF, permissible leak current i is sufficiently large as follows:

$$i=(10\times10^{-15}1)/(50\times10^{-9})=200\text{ nA}.$$

Thus the reliability is maintained sufficient. Namely, the horizontal shift registers can be constructed of the dynamic shift registers excellent in terms of the chip area and the consumption power.

Figure 7B:
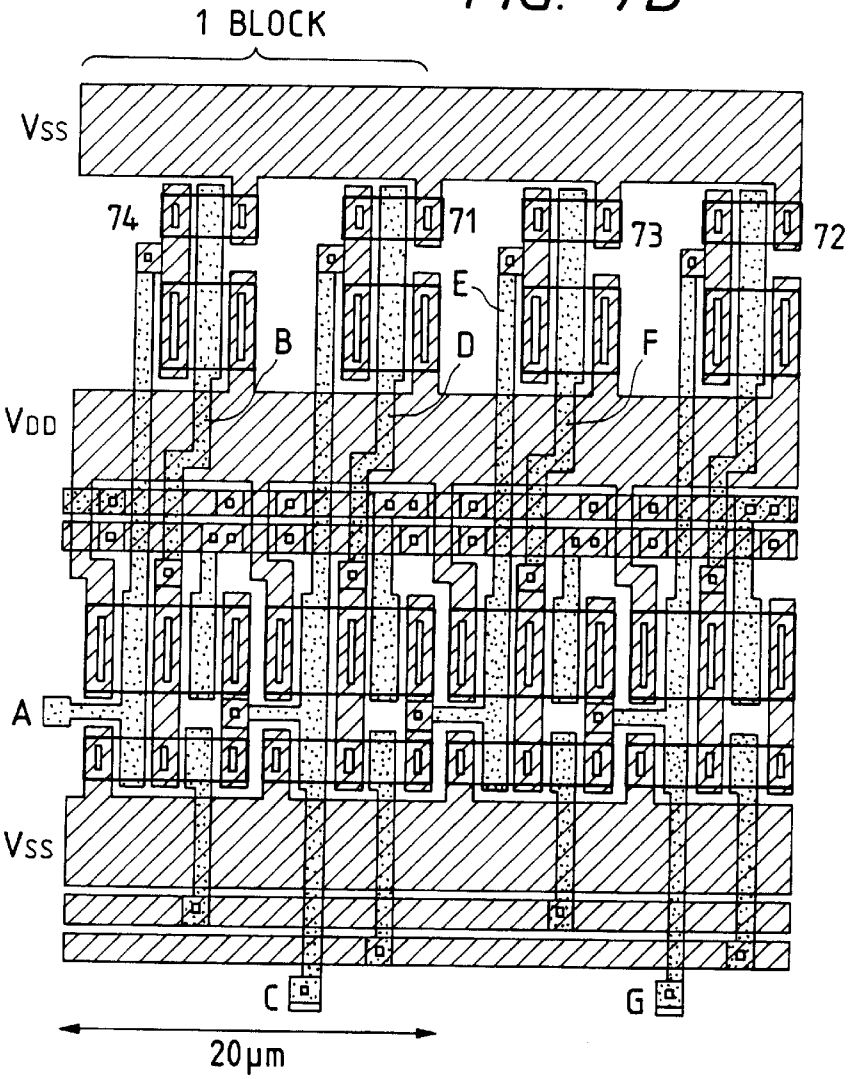
FIGS. 7A and 7B are plan views of the shift register applicable to the liquid-crystal panel.
Figure 7A:
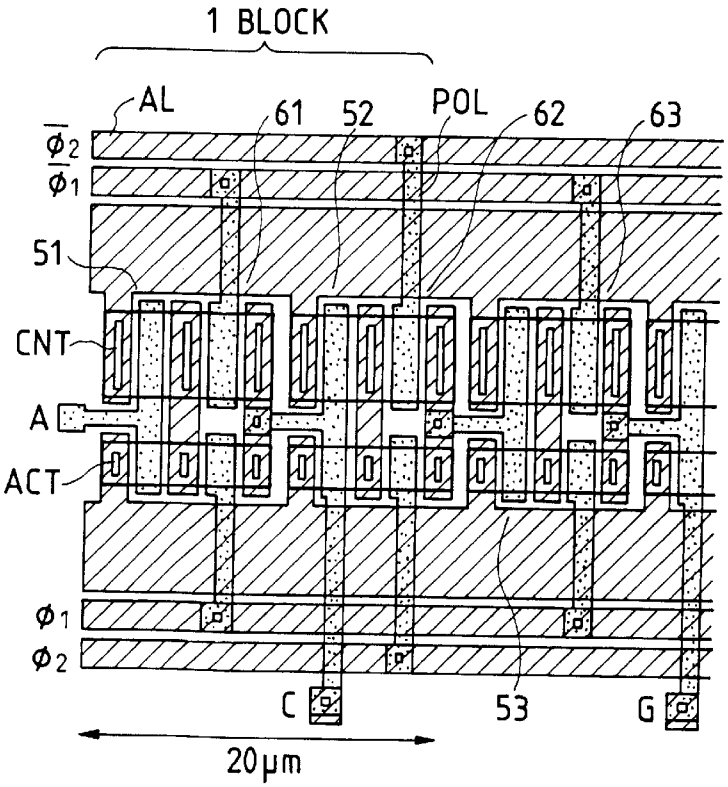

Next described is the vertical shift register. In the vertical shift register, one block of shift register circuit is necessary per pixel pitch. FIG. 7A and FIG. 7B show layout diagrams where the pixel size is 20 μm. FIG. 7A is a layout diagram of the dynamic type horizontal shift register shown in FIG. 3 and FIG. 7B a layout diagram where the shift register is the static shift register shown in FIG. 5. AL represents aluminum, POL doped polysilicon, and CNT contacts. The elements are made at ACT. The reference symbols are given according to FIG. 5. The number of transistors per stage of shift register increases from eight to twelve, and thus the area of shift register increases greatly. As the pixel size becomes smaller and smaller in this way, especially, as the pixel size becomes below the level of 20 μm, the pitch per stage of shift register becomes smaller, and the chip area thus comes to greatly depend upon the number of transistors. Especially, in the case of the layout to increase the number of power supplies with increase in the number of transistors as in FIG. 5, this difference is large, which would greatly affect the number of chips taken from a wafer and the yield, in turn resulting in raising the cost. In such a region, the dynamic type with the smaller number of transistors is conveniently employed. FIGS. 6A to 6E are timing charts of the vertical shift register. The circuit of this vertical shift register 3 is of the dynamic type similar to the circuit shown in FIG. 3. The outputs C, G are successively propagated in synchronization with the clocks φ1, φ2. The floating period is set to approximately 6.5 μsec, which is two figures greater than that of the horizontal shift registers 1, 2. However, supposing the voltage drop is 1 V, t=6.5 μsec, and C=10 fF, the permissible leak current i is as follows:

$$i=(10\times10^{-15}1)/(6.5\times10^{-6})=1.5\text{ nA}.$$

Thus, deceptable leak current is 40 times severer than that of the horizontal shift resisters. By constructing the horizontal shift registers for performing high-speed operation and the vertical shift register with both of the dynamic shift registers, the liquid-crystal panel can be theoretically obtained in a small chip area, at low cost, and of small consumption power. However, considering in detail this matter, it have dawned on the present inventors that it is not very suitable to employ the dynamic type vertical shift register as the vertical shift one. That is, as a driving method of the active matrix type panel, signals are often simultaneously written in a plurality of pixels so as to have a long time for writing signal into one pixel, as shown in the above. Accordingly, a case of bringing frequently about a state that two or more of the vertical scanning lines (gate lines) are simultaneously driven frequently occurs, in which the vertical shift register in practical. Then, as the number of pixels into which the signals being simultaneously written are increased and the number of the scanning lines simultaneously driven are also increased, a propagation time per stage of the vertical shift register becomes long. Accordingly, a more strict leak value is required for reliability in comparison with the above-mentioned allowable leak value, hence it is not very suitable to employ the dynamic type vertical shift register.

[First Embodiment]

Figure 8:
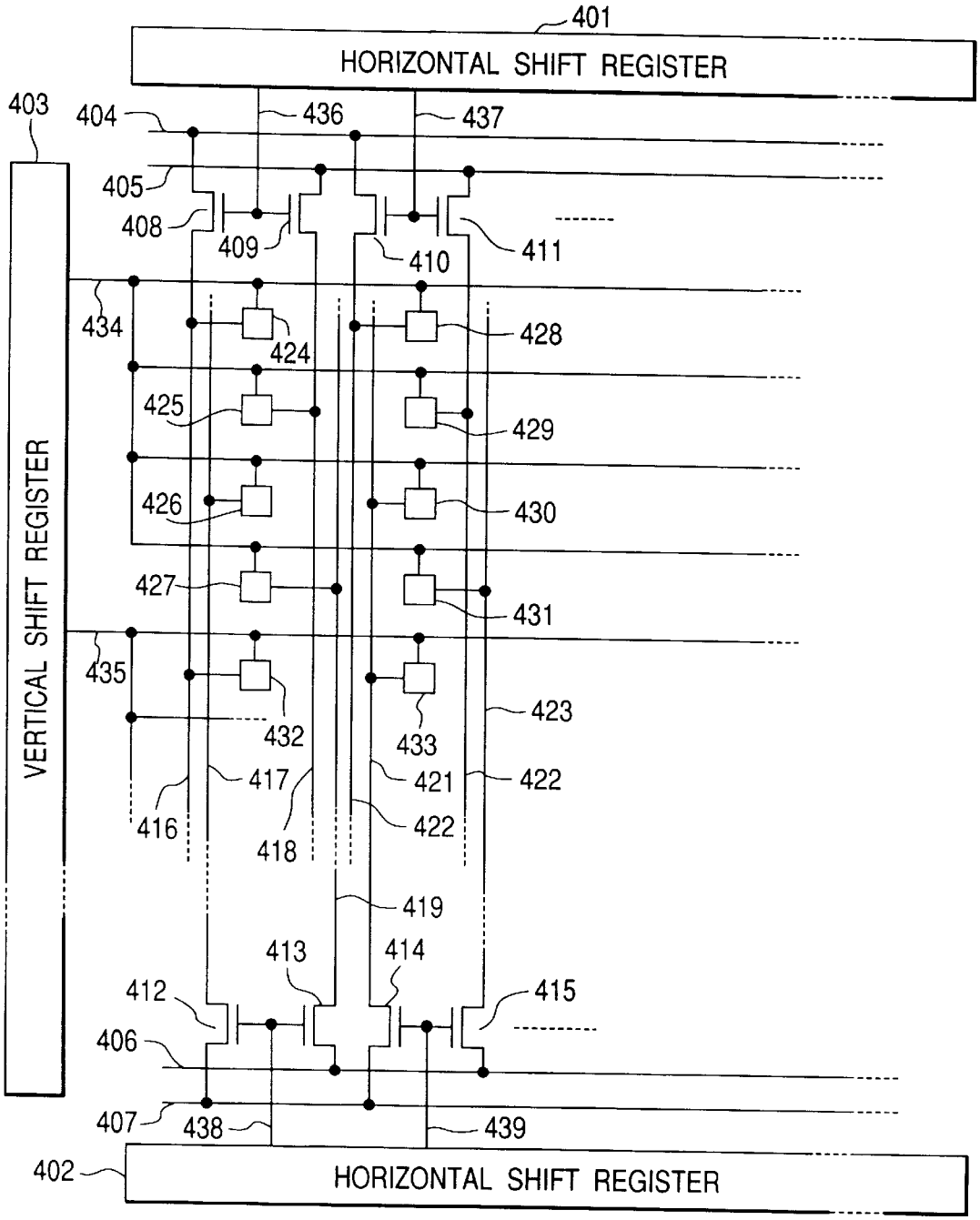
FIG. 8 is a circuit diagram to show an example of the driving circuits of liquid-crystal panel according to the present invention.

The first embodiment of the present invention will be described. In FIG. 8, reference numerals 401, 402 designate the horizontal shift registers (horizontal driving circuit), 403 the vertical shift register (vertical driving circuit), 404 to 407 the video lines for video signals, 408 to 415 . . . the sampling transistors for sampling the video signals in accordance with the scanning pulses from the horizontal shift registers, 416 to 423 the signal lines to which the video signals are supplied through the sampling transistors 408 to 415 . . . , and 424 to 433 the switching transistors of pixel section each including the liquid crystal interposed between the common electrode and the pixel electrode and the additional capacitor for temporarily holding pixel charge. Numerals 434, 435 denote the driving lines for output from the vertical shift register 403, and 436 to 439 the output lines from the horizontal shift registers.

The basic operation of this example is the same as in the reference example. This example is a VGA panel having the pixels, for example, of 640×480. The operation timing is basically the same as in the reference example, but writing is carried out at the vertical synchronizing frequency 60 Hz in this example. At this time the on period of the vertical shift register 403 is approximately 102 μsec, which is about 16 times longer than that in the reference example. On the other hand, the on period of the horizontal shift registers 401, 402 is different from that in the reference example. Each video signal is divided into four and two each out of the sampling transistors 408 to 415 are paired. Thus the on period of the horizontal shift registers is approximately 160 nsec. In this example the operation is quick with the floating period of the horizontal shift registers 401, 402 being 160 nsec or less. Supposing the voltage drop is 1 V, t=160 nsec, and C=10 fF, the permissible leak current i is large enough as follows:

$$i=(10\times10^{-15}1)/(160\times10^{-9})=62.5\text{ nA}.$$

The reliability is thus not degraded. Namely, the horizontal shift registers are preferably constructed of the dynamic shift registers in terms of the chip area and consumption power as also described in the reference example.

On the other hand, the vertical shift register is constructed of the static shift register shown in FIG. 5 above. The floating period of the vertical shift register 403 is as long as approximately 102 μsec. Supposing the voltage drop is 1 V, t=102 μsec, and C=10 fF, the permissible leak current i is as follows:

$$i=(10\times10^{-15}1)/(102\times10^{-6})=98\text{ pA}.$$

Since the leak current i is small, use of the dynamic shift register is not preferable from the aspect of reliability. In addition, the consumption power is almost negligible because the frequency is low in the vertical shift register 403. Also, from the aspect of layout, one block can be arranged in the region of four pixels, and thus the problem of chip area is not so significant. Therefore, the vertical shift register 403 is preferably constructed of the static shift register, especially, from the aspect of reliability.

By the arrangement wherein the horizontal shift registers 401, 402 for carrying out the high-speed operation are constructed of the dynamic shift registers as shown in FIG. 3 while the vertical shift register 403 of the slow operation and with the large period of arrangement of one block of shift register is constructed of the static shift register, this embodiment realized the liquid-crystal panel applicable to the liquid-crystal projector device, low in the consumption power, high in the reliability, small in the chip area, and low in the cost.

[Second Embodiment]

Figure 9:
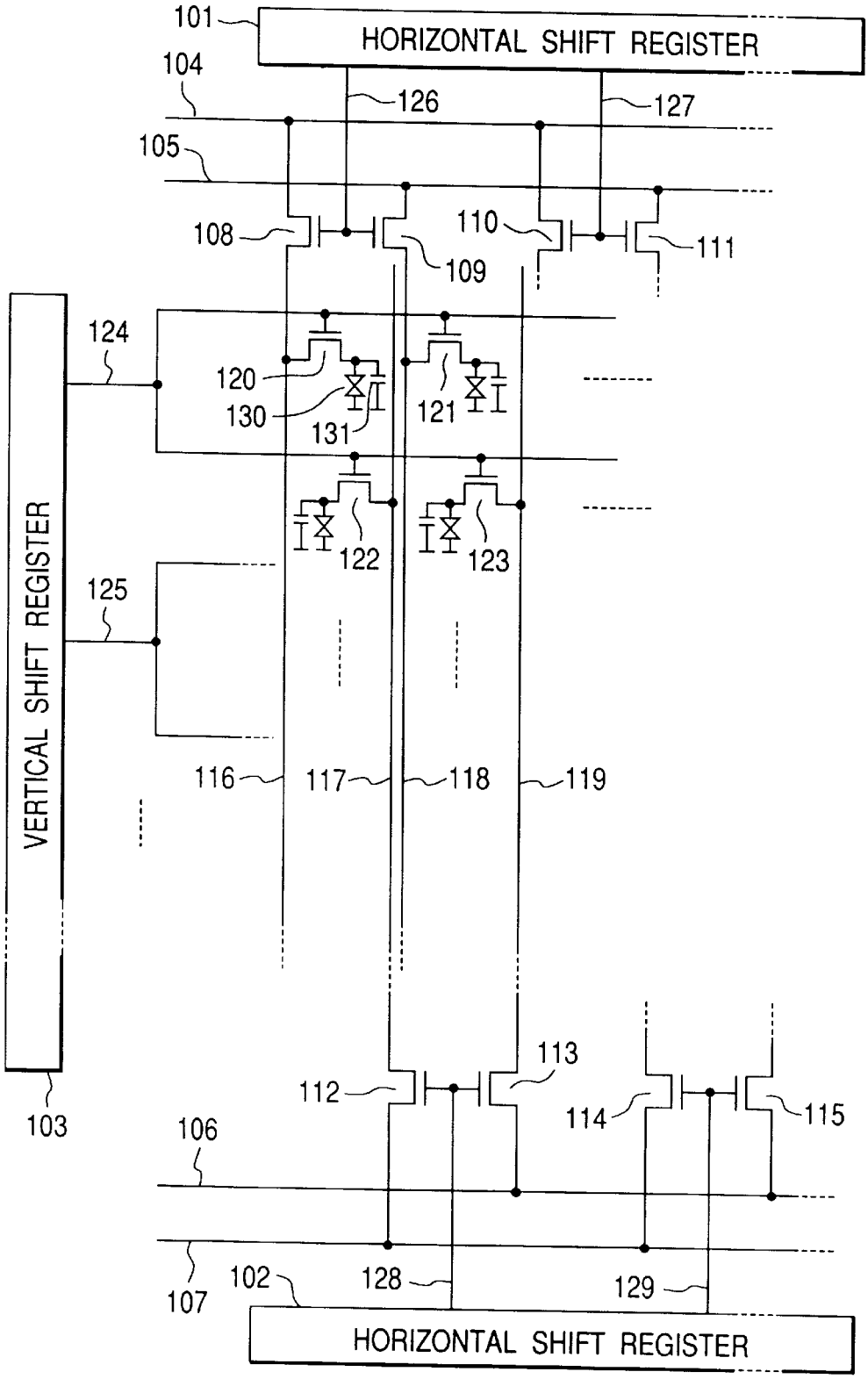
FIG. 9 is a circuit diagram to show an example of the driving circuits of liquid-crystal panel according to the present invention.
Figures 10A, 10B, 10C, 10D, 10E, 10F, 10G:
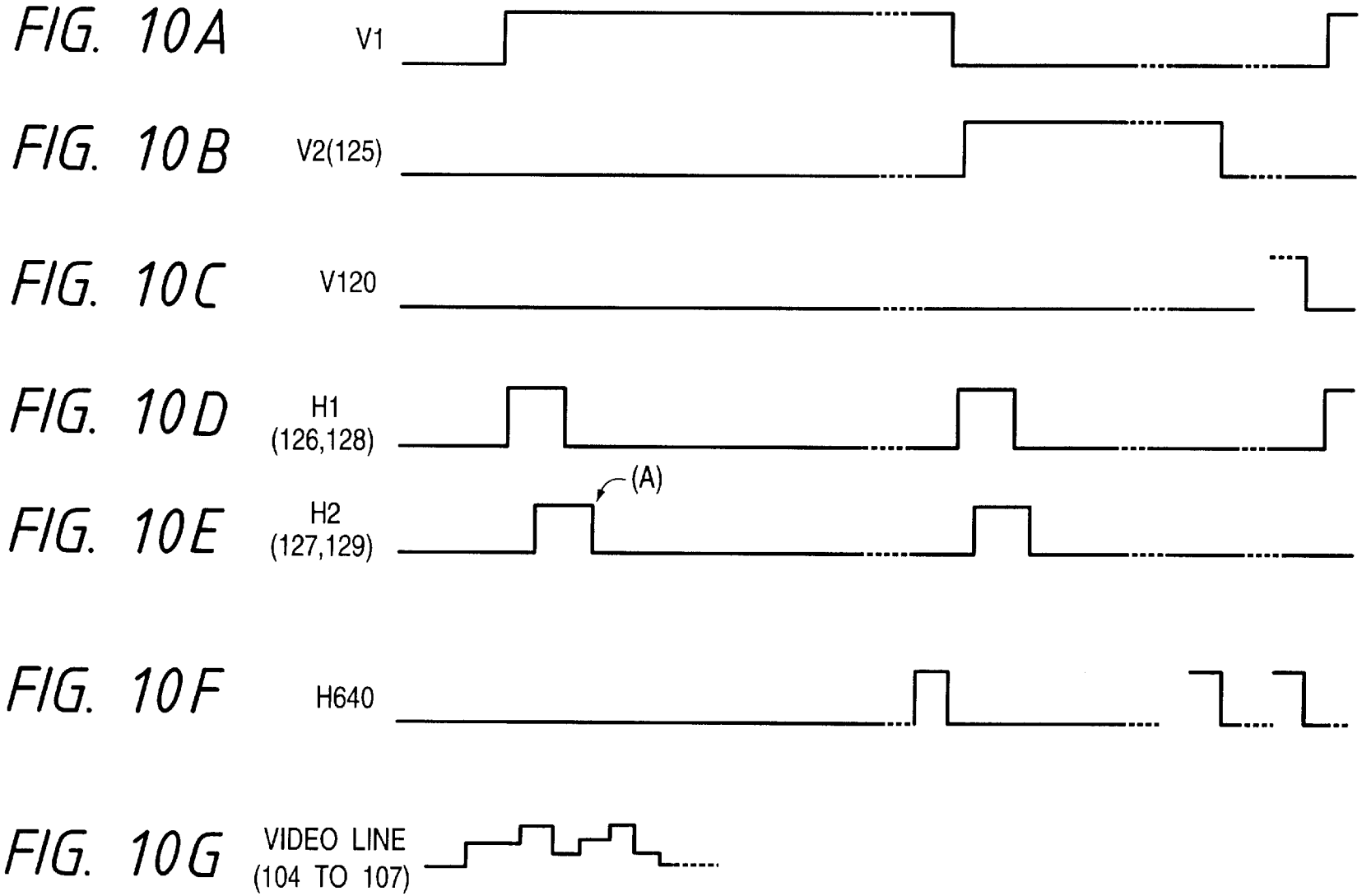
FIGS. 10A, 10B, 10C, 10D, 10E, 10F and 10G are timing charts to show an example of the driving circuits of liquid-crystal panel according to the present invention.

FIG. 9 is a circuit diagram of the liquid-crystal panel of the present example. In FIG. 9, 101, 102 designate the horizontal shift registers, 103 the vertical shift register, 104 to 107 the video lines for video signals, 108 to 115 . . . the sampling transistors for sampling the video signals in accordance with the scanning pulses from the horizontal shift registers, 116 to 119 . . . the signal lines to which the video signals are supplied through the sampling transistors 108 to 115 . . . , and 120 to 123 . . . the switching transistors of pixel section each including the liquid crystal 130 interposed between the common electrode and the pixel electrode and the additional capacitor 131 for temporarily holding the pixel charge. Numerals 124, 125 denote the driving lines for output from the vertical shift register 103, each of which is divided into two horizontal scanning lines to be connected to the switching transistors 120 to 123 . . . of pixel section. Further, numerals 126 to 129 represent the output lines from the horizontal shift registers.

The liquid-crystal panel of this example is an SXGA panel (of pixels of 1280×1024). The driving method of this panel is basically the same as in the reference example and the first embodiment, but this example is arranged to simultaneously write signals in four pixels by four video lines. At the vertical synchronizing frequency 75 Hz, the on period of the vertical shift register 103 is approximately 38 μsec, while the on period of the horizontal shift registers 101, 102 is approximately 30 nsec. The operation timing is shown in FIGS. 10A to 10G. In FIGS. 10A to 10G, V1, V2, V120 indicate output pulses of 124, 125, . . . from the vertical shift register, H1, H2, H640 do output pulses from the horizonal shift registers, and a signal waveform on the video lines is exemplified.

First, the driving line of 124 is turned to the high level (H) and during that period the output lines 126, 127 (128, 129) of the horizontal shift registers 101, 102 are successively turned to the high level (H) to write potentials on the video lines 104 to 107 through the signal lines into the switching transistors 120 to 123 of pixel section. The potentials are held in the additional capacitors 131. In this circuit the output lines 126 and 127 from the horizontal shift registers 101, 102 take the high level as overlapping partly. This means that each sampling transistor 110, 111, 114, 115 also temporarily samples a potential to be sampled by each sampling transistor 108, 109, 112, 113. However, this raises no problem, because potentials of the video lines 104 to 107 determined at the timing of A are finally written through the signal lines 116 to 119 into the pixels, as shown in FIGS. 10A to 10G. On the other hand, since the high-definition panel has many pixels, the writing time per pixel becomes shorter. Since the driving method of the present example includes preliminary writing of previous pixel potential, writing potential differences become smaller in the liquid-crystal driving essentially including the inversion drive, and the writing thus becomes easier, which can be said as a preferred driving method.

Figure 11A:
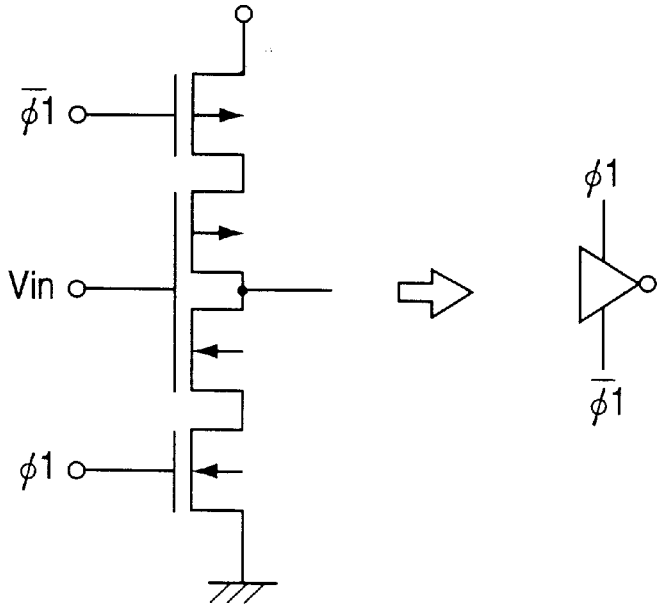
FIGS. 11A and 11B are circuit diagrams of a dynamic shift register applicable to the liquid-crystal panel of the present invention.
Figure 11B:
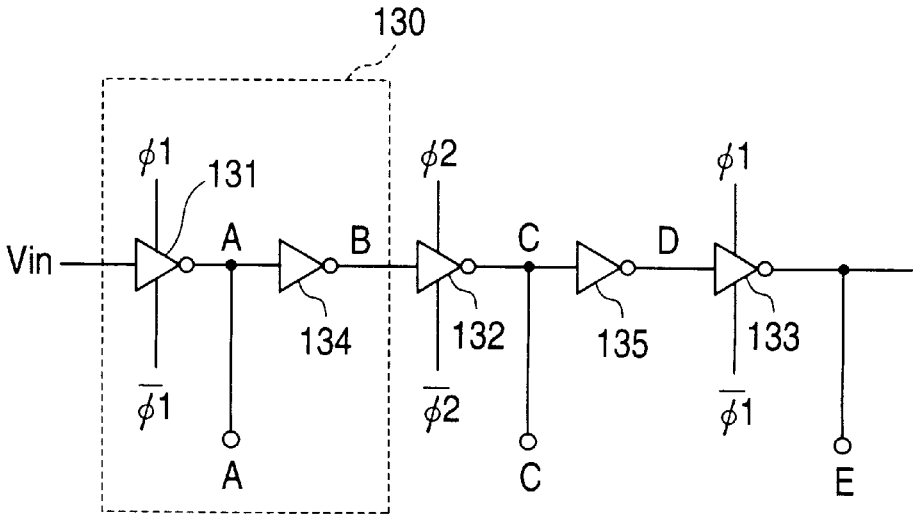

Next described is the horizontal shift register circuit. An example of the horizontal shift register circuit is shown in FIG. 11A and FIG. 11B. This shift register is a dynamic shift register, which is composed of clocked CMOS inverters 131 to 133 and CMOS inverters 134, 135. The section 130 enclosed in the dashed line indicates the basic unit of shift register, which is one stage composed of six transistors. FIGS. 12A to 12H are timing charts of this shift register, wherein outputs are successively propagated in synchronization with the clocks ϕ1, ϕ2. Here, the portions indicated by A, C, E represent the output portions, which are connected to the gates of the sampling transistors shown in FIG. 9. Since the shift register is of the dynamic type, the nodes of A, C, E become floating nodes after fall of clock ϕ1 or ϕ2 and the potential is maintained mainly by the gate capacitance of the next stage. As shown in FIG. 13, to the dynamic shift register of 141 to 145, CMOS inverters 146, 147 may be added in parallel and in the opposite direction to the CMOS inverters 144, 145, whereby a stable circuit configuration of the static type can be realized without the floating nodes. However, the number of transistors increases from six to eight. Namely, this increase of transistors increases the chip area and the consumption power. In this example the horizontal shift registers operate at high speed with the floating period thereof being 30 nsec or less, and the reliability is thus not degraded even by use of the dynamic shift register. Therefore, the horizontal shift registers are preferably constructed of the dynamic shift registers demonstrating excellent characteristics in terms of the chip area and consumption power.

On the other hand, the vertical shift register is constructed of the static shift register shown in FIG. 13. The floating period of the vertical shift register is approximately 38 μsec, which is three figures or more longer than that of the horizontal shift registers. Supposing the voltage drop is 1 V, t=38 μsec, and C=10 fF, the permissible leak current i is as follows:

$$i=(10\times10^{-15}\times1)/(38\times10^{-6})=263\text{ pA}.$$

From the aspect of reliability use of the dynamic type is not so preferred. In addition, since the consumption power in the vertical shift register is almost negligible because of the low frequency, it is preferable that the vertical shift register be constructed of the static shift register. In terms of the layout no problem will arise, either, because one block can be arranged in the region of two pixels.

By the arrangement wherein the horizontal shift registers for performing the high-speed operation are constructed of the dynamic shift registers and the vertical shift register operating at low speed is constructed of the static shift register as described above, the present embodiment can realize the liquid-crystal panel applicable to the liquid-crystal projector device, low in the consumption power, high in the reliability, small in the chip area, and low in the cost.

[Embodiment 3]

Figure 14:
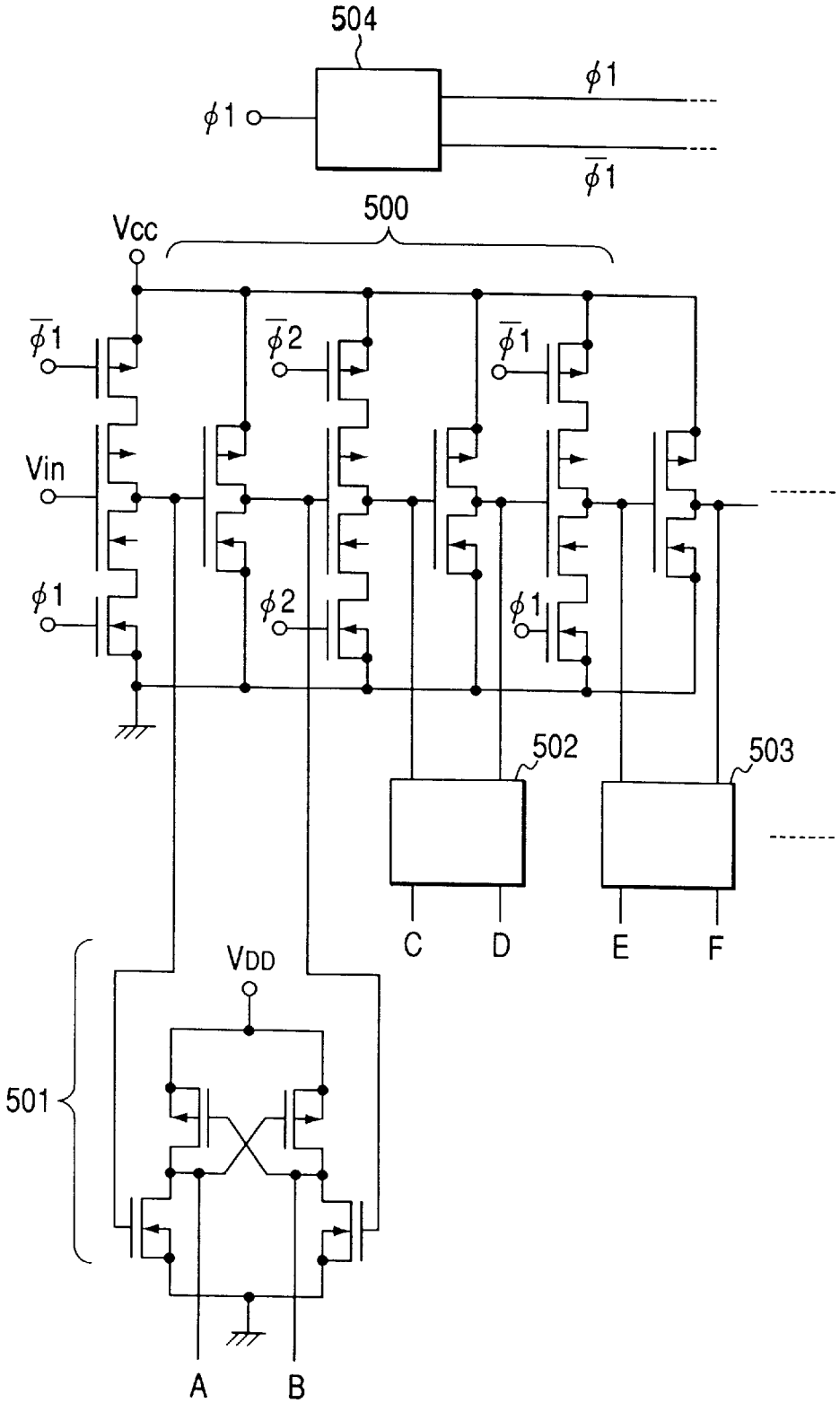
FIG. 14 is a circuit diagram of a shift register applicable to the liquid-crystal panel according to the present invention.

The basic configuration is the same as in Embodiment 2 shown in FIG. 9, but the configuration of the horizontal shift register circuit is different. FIG. 14 is a diagram of the shift register circuit. Numeral 500 denotes the dynamic shift register shown in FIGS. 11A and 11B, and booster circuits 501, 502, 503, . . . a reconnected to outputs of the respective inverters. The output from the shift register indicated by numeral 126 in FIG. 9 is outputted from B. Each sampling transistor 108 to 115 is illustrated as one MOS transistor in FIG. 9, but, without having to be limited particularly to this example, it is needless to mention that the sampling transistors may be transfer gates of CMOS transistor or the like. When the transfer gates of CMOS transistor are used, the output A from the booster circuit 501, 502, 503, . . . is also used and is connected to the gate of pMOS transistor. Numeral 504 represents a clock buffer of clock ϕ1 (ϕ2), which drives long wires with large capacitances because of routing in the liquid-crystal panel. Assuming that routing is of 2 cm, the capacitance is as large as approximately 10 pF, though depending upon the size of liquid-crystal panel. The power-supply voltage of numerals 500, 504 is for example 5 V, which drives the clock buffers and shift registers operating at high speed, in low consumption power. Summing up the four upper and lower clock buffers, the average consumption power of the present example is about 34 mW at the power-supply voltage 5 V but is about 840 mW at the power-supply voltage 20 V, which is sixteen times greater. The power-supply voltage of the booster circuits and the other circuits is 20 V to write the voltage through the video lines into the liquid-crystal panel. Since the horizontal shift registers are of the dynamic type as in the second embodiment, the number of transistors per stage of shift resister, also including the booster circuit, is 10 and one block may be arranged in the region of two pixels. The chip size is thus small.

On the other hand, the vertical shift register is the static shift register shown in FIG. 5 as in the second embodiment.

Since in the vertical shift register the consumption power is almost negligible because of the low frequency, the vertical shift register is preferably constructed of the static shift register. By the arrangement wherein the horizontal shift registers for performing the high-speed operation are constructed of the dynamic shift registers and the circuit configuration to decrease the power-supply voltage and finally boost the voltage is employed and wherein the vertical shift register operating at low speed is constructed of the static shift register as described above, the present embodiment realized the liquid-crystal panel applicable to the liquid-crystal projector device, low in the consumption power, high in the reliability, small in the chip area, and low in the cost.

[Embodiment 4]

This embodiment shows an example wherein the liquid-crystal device is constructed by forming polysilicon thin film transistors (poly-Si TFTs) on an insulating glass substrate. In this case, the dynamic shift registers are used for the horizontal driving circuit, and the leak level thus needs to be decreased. On the other hand, there is an advantage that the wiring capacitance of clock can be decreased because the base is the insulating substrate. However, the mobility needs to be of a larger value as compared with normally used poly-Si. In the present example the circuit according to Embodiment 3 is realized using high-performance poly-Si TFTs described below, thereby forming a cheap liquid-crystal display device.

Figure 26:
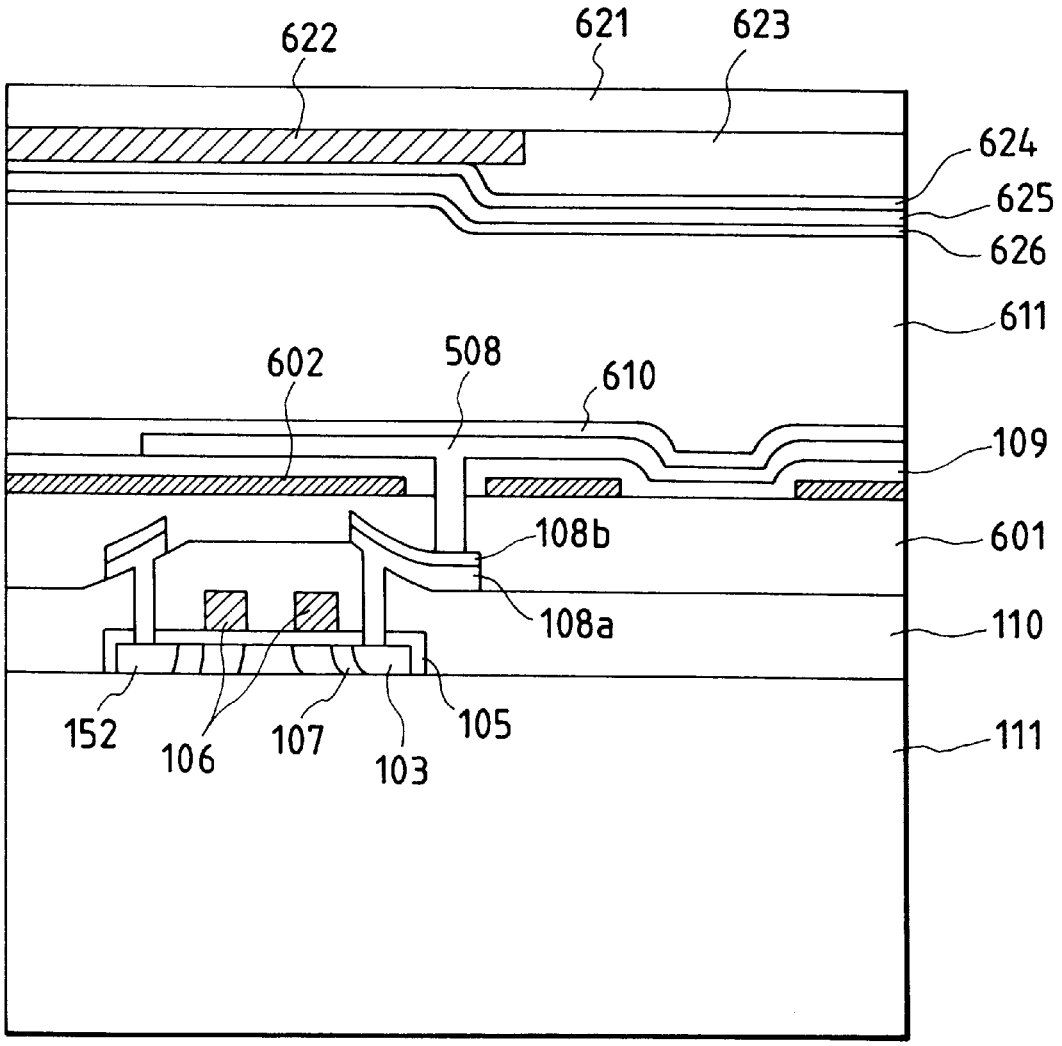
FIG. 26 is a schematic view for explaining a fabrication step of the liquid-crystal panel.

The process using low-temperature poly-Si TFTs will be described below referring to FIG. 26.

First, glass substrate 111 is subjected to buffered oxidation and then a film of a-Si is deposited in the thickness of about 50 nm by the normal LPCVD process. After that, the film is exposed to a KrF excimer laser to form a polycrystalline silicon layer 103. Then an oxide film 105 is deposited in the thickness of 10 to 100 nm, thereby forming a gate oxide film. After formation of gate electrode 106, the source and drain (152, 103, 107) are formed by the ion doping method. Activation of impurities is carried out, for example, by annealing under a nitrogen atmosphere and thereafter an insulating film 110 is made in the thickness of about 500 nm. After patterning of contact holes, wiring layers 108*a*, 108*b* are made. For example, the wiring layer 108*a* is made by depositing a TiN film by sputtering and thereafter the wiring layer 108*b* is made by depositing an Al-Si film by sputtering. Then the two films are patterned simultaneously.

Then a Ti layer 602, which is a light shielding film, is deposited by sputtering and then patterned. After that, an insulating film 109 for formation of capacitor is made, for example, by decomposing a mixture of silane gas and ammonia gas or a mixture of silane gas and $N_2O$ at temperatures of 200 to 400° C. in the plasma and effecting deposition. Then it is thermally treated at temperatures of 350 to 500° C. in hydrogen gas or in a mixture of hydrogen gas and inert gas such as nitrogen gas for 10 to 240 minutes, thereby hydrogenating the polycrystalline silicon. After making through holes, ITO layer 508 is made as a transparent electrode. After that, liquid crystal 611 is injected between the transparent electrode and the opposed electrode. The opposed substrate is a one wherein black matrix 622, color filter 623, ITO transparent common electrode 624, protecting film 625, and alignment film 626 are made on glass substrate 621.

The poly-Si TFTs made herein have the mobility of 60 $cm^2$/Vsec and the leak current of $10^{-10}$ A or so. Therefore, the present example can provide the cheap liquid-crystal display device low in the consumption power and small in the chip area by use of such poly-Si TFTs.

[Fifth Embodiment]

Figure 15:
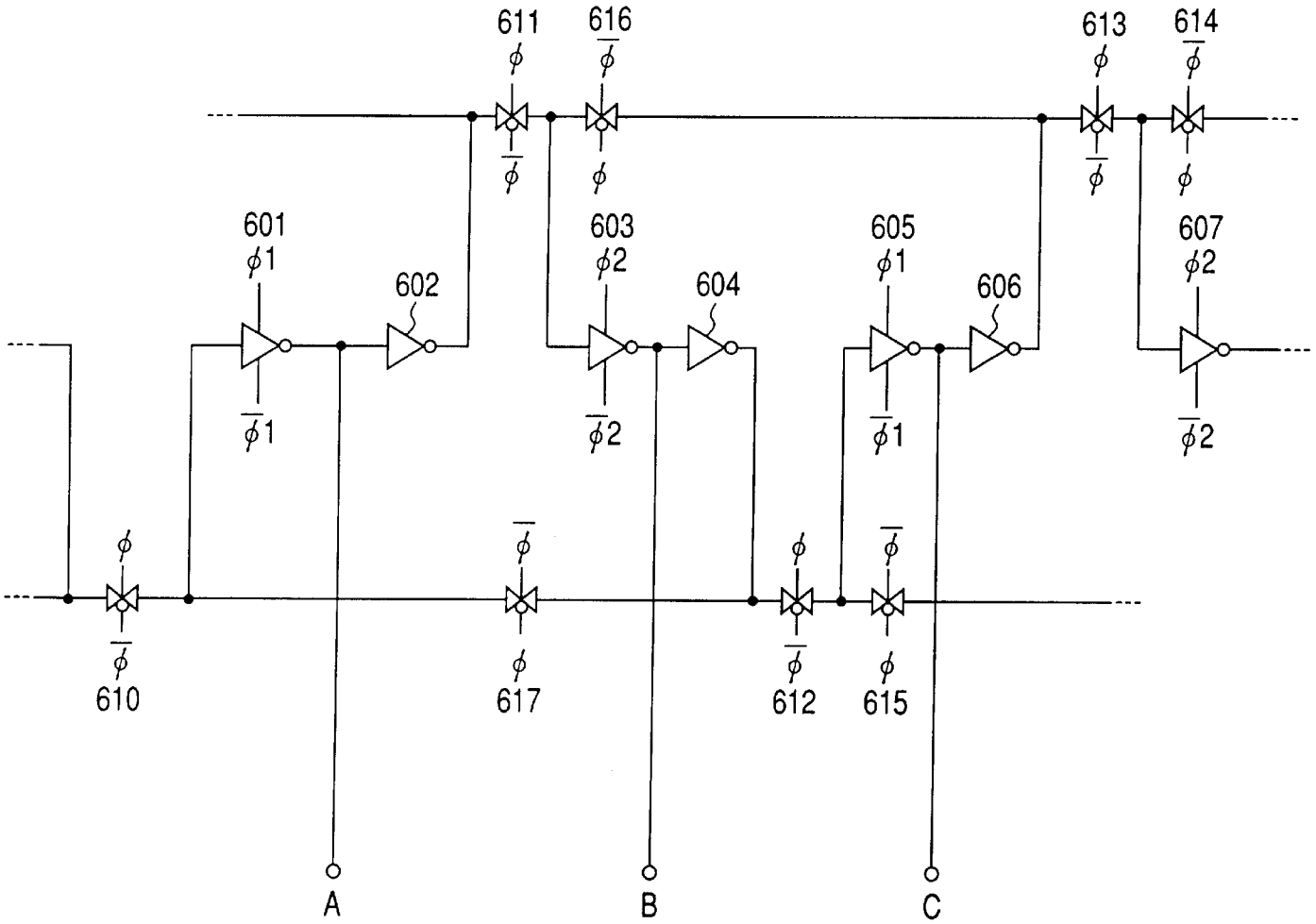
FIG. 15 is a circuit diagram of a shift register applicable to the liquid-crystal panel according to the present invention.

The basic structure is substantially the same as in the second embodiment shown in FIG. 9, but the circuit configuration of horizontal shift register is different. FIG. 15 is a shift register circuit diagram. This is an example in which transfer gates 610 to 617 as inverting switches are connected to the dynamic shift register shown in FIGS. 11A and 11B. By connecting such circuits, the shift register circuit capable of transferring signals to two directions (hereinafter called "two-way type shift register") is achieved. The transfer gates 610 to 613 out of those 610 to 617 become conductive when the clock pulse $\phi$ is of the high level. The transfer gates 614 to 617 become conductive when the clock pulse $\phi$ is of the low level. When the clock pulse $\phi$ is of the high level, the states of the shift register outputs are propagated in the order of A, B, and C in the case of the timing shown in FIGS. 12A to 12H. On the other hand, when the clock pulse $\phi$ is of the low level, the states of the shift register outputs are propagated in the order of C, B, and A in the case of the timing shown in FIGS. 12A to 12H. Thus, the two-way circuit is achieved depending upon the potentials of clock pulse $\phi$. When such a shift register is applied to the horizontal shift registers and when an image is displayed on the liquid-crystal panel, for example, in FIG. 9, the picture can be displayed from the left or inversely from the right. Demands vary for the displaying directions, depending upon the optical system, the type of system (whether the front type or the rear type), and so on. By using the circuit including the switches of the present example, the same liquid-crystal panel can be applicable to various systems and it is the liquid-crystal panel with very high flexibility.

It is needless to mention that this two-way property can be applied not only to the horizontal shift registers, but also to the vertical shift register. A great effect can be achieved by adopting at least one shift register of the two-way type. It is also a matter of course that it is more effective to apply the two-way type shift registers to the both horizontal and vertical shift registers. The present example was arranged to use the dynamic horizontal shift registers and the static vertical shift register as in the second embodiment, but the arrangement of this example is also effective in the case of use of the dynamic shift registers for the both as in the reference example. Since the two-way type arrangement increases the number of transistors, it becomes more important to use the dynamic shift registers in order to improve the yield and to decrease the chip area so as to increase the number of chips taken from a wafer.

By the arrangement wherein the horizontal shift registers for performing the high-speed operation are constructed of the dynamic shift registers and in the two-way circuit configuration while the vertical shift register operating at low speed is constructed of the static shift register as described above, the present embodiment realized the liquid-crystal panel applicable to the liquid-crystal projector device, low in the consumption power, high in the reliability, capable of the two-way display, high in the flexibility, small in the chip area, and low in the cost.

[Sixth Embodiment]

A liquid-crystal display device to which the horizontal and vertical shift registers as described above are applied will be described.

The liquid-crystal panel of the present example will be described as an example using the semiconductor substrate, but the substrate is not always limited to the semiconductor substrate. The substrate may be a transparent substrate of glass or the like. Further, the all switching elements of the liquid-crystal panel are of the MOSFET or TFT type, but they may be of the two-terminal type such as the diode type. Further, the liquid-crystal panel described below can be effectively used as a display device not only in home-use televisions, but also in projectors, head mounted displays, three-dimensional video game devices, laptop computers, electronic notebooks, video conference systems, car navigation systems, panels of airplane, and so on.

Figure 16:
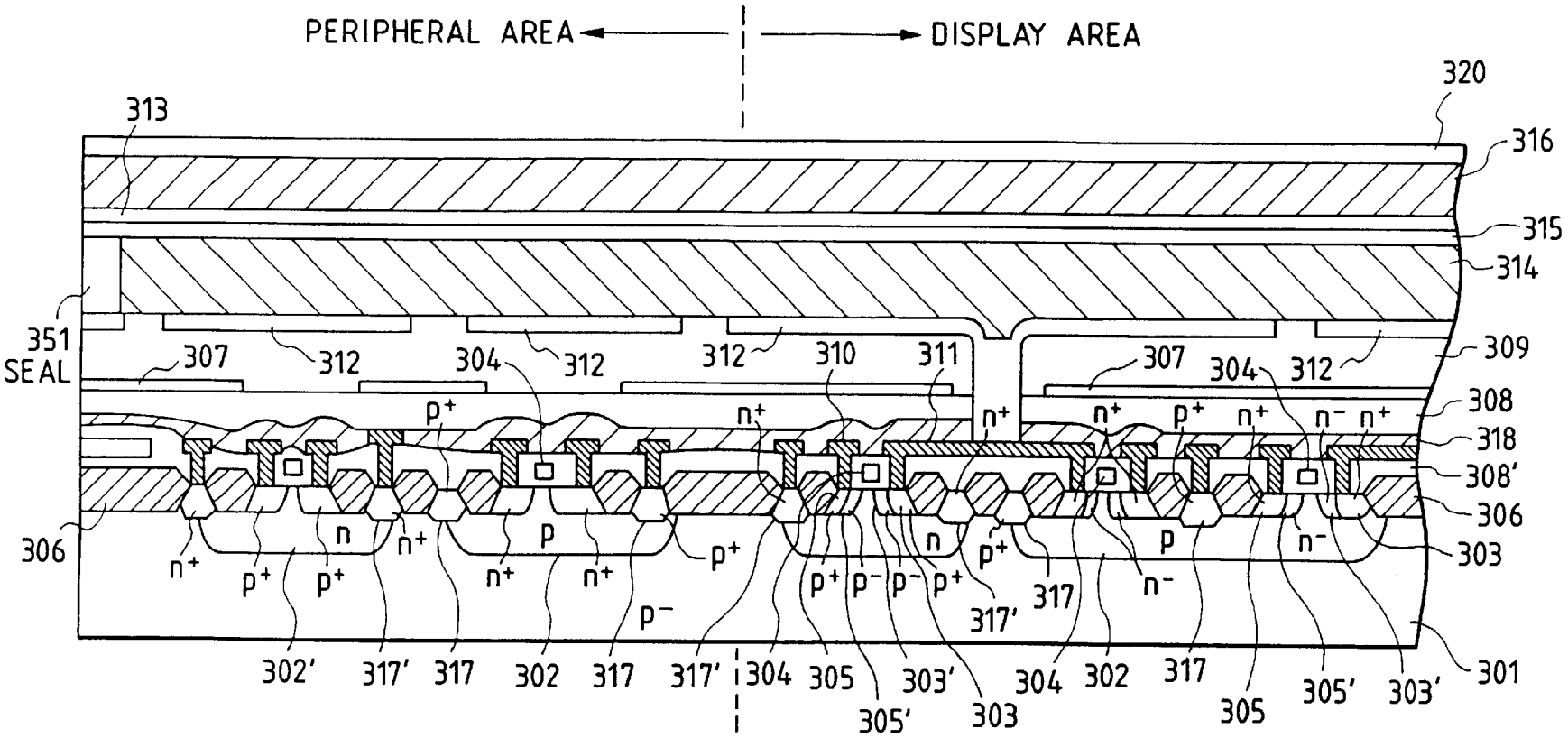
FIG. 16 is a cross-sectional view to show an example of the liquid-crystal elements according to the present invention.

A cross section of the liquid-crystal panel portion of the present example is shown in FIG. 16. In the drawing, reference numeral 301 designates the semiconductor substrate, 302, 302' p-type and n-type wells, respectively, 303, 303', 303" source regions of transistor, 304 gate regions, and 305, 305', 305" drain regions.

As shown in FIG. 16, since the high voltage of 20 to 35 V is applied to the transistors in the display area, the source and drain layers are not formed in a self-aligned manner with respect to the gates 304, but they are formed with an offset. Between the source and drain regions there are the low-concentration $n^-$ layer in the p-well and the low-concentration $p^-$ layer in the n-well as indicated by the source region 303' and drain region 305'. For reference, an offset amount is preferably between 0.5 and 2.0 $\mu$m. On the other hand, a circuit section, which is a part of the peripheral circuits, is shown on the left side of FIG. 16 and the circuit section as a part of the peripheral section is so constructed that the source and drain layers are formed in the self-aligned manner with respect to the gates.

The offset of source and drain was described herein, but, in addition to either presence or absence of the offset, other effective ways are to change the offset amounts depending upon their respective withstand voltages and to optimize the gate length. The reason is as follows. Since parts of the peripheral circuits are logic based circuits, the drive of the parts is normally 1.5 to 5 V based drive. Thus, the above self-aligned structure is provided for decreasing the transistor size and for increasing the driving force of transistor. This substrate 301 is made of a p-type semiconductor and the substrate has the lowest potential (normally, the earth potential). The voltage applied to the pixels, i.e. 20 to 35 V, is applied to the n-type wells in the display area. On the other hand, the logic driving voltage, 1.5 to 5 V, is applied to the logic section of the peripheral circuitry. This structure permits optimum devices to be constructed according to their respective voltages, thereby realizing not only reduction of chip size, but also display by the greater number of pixels based on the increase of driving speed.

In FIG. 16, numeral 306 represents a field oxide film, 310 a source electrode connected to a data wire, 311 a drain electrode connected to a pixel electrode, 312 pixel electrodes also serving as a reflecting mirror, and 307 a light shielding layer covering the display area and peripheral area, for which Ti, TiN, W, or Mo, or the like is suitable. As shown in FIG. 16, the above light shielding layer 307 covers the display area except for the connecting parts between the pixel electrodes 312 and the drain electrodes 311; whereas, in the peripheral pixel area, the above light shielding layer 307 is removed from the regions with heavy wiring capacitances, for example, such as some of the video lines, and the clock lines. In the case where illumination light is mixed in high-speed signals in the portions from which the above light shielding layer 307 is removed, so as to cause a malfunction of circuit, some transferable design is considered so as to cover the layer of pixel electrode 312. Numeral 308 designates an insulating layer below the light shielding layer 307, a flattening process is done on P-SiO layer 318 by SOG, and the P-SiO layer 318 is further covered by P-SiO layer 308, thus assuring stability of the insulating layer 308. It is needless to mention that, as well as the flattening method by SOG, the flattening may be made by another flattening method for forming a P-TEOS (Phospho-Tetraethoxy-Silane) film to further cover the P-SiO layer 318 and thereafter subjecting the insulating layer 308 to a CMP (Chemical Mechanical Polishing) process as detailed below.

Numeral 309 denotes an insulating layer disposed between the reflecting electrodes 312 and the light shielding layer 307 and the charge holding capacitors of reflecting electrodes 312 are made through this insulating layer 309. For forming large-capacitance capacitors, effective materials are P-SiN and $Ta_2O_5$ with high dielectric constants, laminate films with $SiO_2$, and so on, as well as $SiO_2$. The light shielding layer 307 is a flat layer of a metal selected from Ti, TiN, Mo, W, and so on and the film thickness thereof is preferably between approximately 500 Å and 5000 Å.

Further, numeral 314 indicates the liquid-crystal material, 315 the common transparent electrode, 316 the opposed substrate, 317, 317' high-concentration impurity regions, 319 the display area, and 320 an antireflection film.

As shown in FIG. 16, the high-concentration impurity layer 317, 317' of the same polarity as the well 302, 302' formed below the transistor is formed in the peripheral part and the inside of the well 302, 302'. Even if a high-amplitude signal is applied to the source, the well potential will be stable, because it is fixed to a desired potential by the low-resistance layer. Thus, display of high-quality image is achieved. Further, the above high-concentration impurity layers 317, 317' are provided through the field oxide film between the n-type well 302' and the p-type well 302, which obviates a need for the channel stop layer immediately below the field oxide film, normally used in the case of the MOS transistors.

Since these high-concentration impurity layers 317, 317' can be made at the same time as the process for forming the source and drain layers, the number of masks and manhours are decreased in the fabrication process, thus achieving the reduction of cost.

Next, reference numeral 313 indicates a reflection-preventing film provided between the common transparent electrode 315 and the opposed substrate 316, which is made so as to reduce the reflectivity at the interface in consideration of the refractive index of the liquid crystal at the interface. In that case, a preferred material is an insulating film having a smaller refractive index than those of the opposed substrate 316 and the transparent electrode 315.

The well region 302' has the opposite conduction type to the semiconductor substrate 301. Therefore, the well region 302 is of the p-type in FIG. 16. The p-type well region 302 and n-type well region 302' preferably contain higher concentrations of impurities than the semiconductor substrate 301. When the impurity concentration of the semiconductor substrate 301 is $10^{14}$ to $10^{15}$ ($cm^{-3}$), the impurity concentration of the well region 302 is preferably between $10^{15}$ and $10^{17}$ ($cm^{-3}$).

The source electrode 310 is connected to a data wire through which a signal for display is sent and the drain electrode 311 is connected to the pixel electrode 312. These electrodes 310, 311 are made of a material selected from Al, AlSi, AlSiCu, AlGeCu, and AlCu for ordinary wiring. Stable contact can be achieved by using a barrier metal layer of Ti and TiN as a contact face between the bottom of these electrodes 310, 311 and the semiconductor. Contact resistance is also decreased. The pixel electrodes 312 are preferably made of a high reflection material with a flat surface, which can be selected from materials such as Cr, Au, and Ag, in addition to the ordinary wiring metals including Al, AlSi, AlSiCu, AlGeCu, and AlCu. For enhancing flatness, the surfaces of the base insulating layer 309 and pixel electrodes 312 are processed by the Chemical Mechanical Polishing (CMP) method.

The holding capacitors 325 are capacitors for holding signals between the pixel electrodes 312 and the common transparent electrode 315. The potential of the substrate is applied to the well regions 302. In the present embodiment, transmission gate structures of the respective rows are arranged alternately row by row in such a way that the first row from the top includes upper n-channel MOSFET 323 and lower p-channel MOSFET 324, that the second row includes upper p-channel MOSFET 324 and lower n-channel MOSFET 323, and so on. As described above, contact is made by the stripe wells with the power-source lines not only in the periphery of the display area, but also inside the display area by provision of fine power-supply lines.

At this time the key is stabilization of resistance of well. Hence, in the case of the p-type substrate, a configuration employed is such that the area or the number of contact of n-wells inside the display area is made greater than that of contact of p-wells. Since the p-wells are maintained at the constant potential by the p-type substrate, the substrate plays a role as a low-resistance body. Accordingly, influence of fluctuation is apt to become greater due to input/output of signals to the sources and drains of the island-patterned n-wells, but it is prevented by intensifying the contact from the upper wiring layer. This realized stable and high-quality display.

Figure 17:
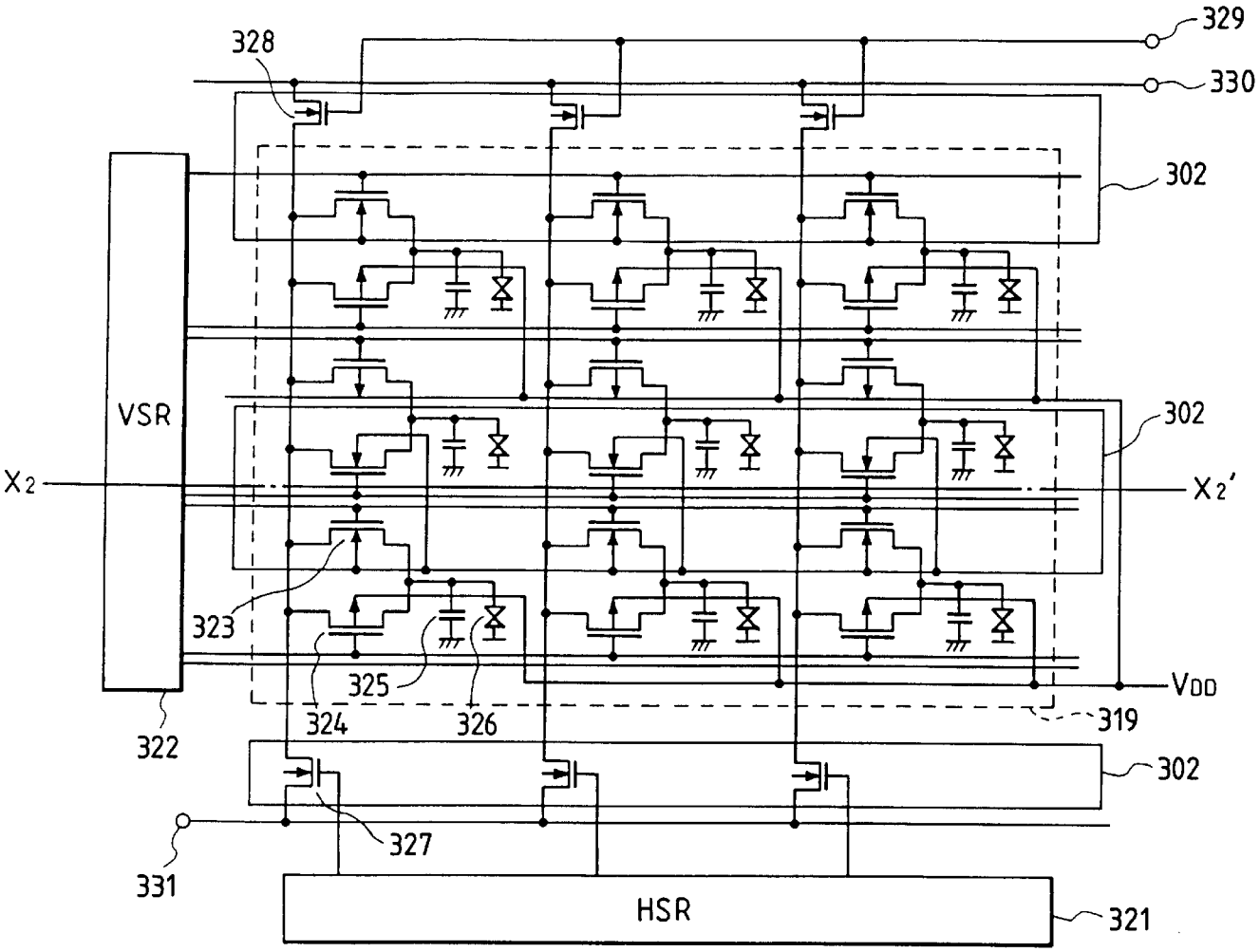
FIG. 17 is a schematic circuit diagram of a liquid-crystal device according to the present invention.

In FIG. 17, image signals (video signals, pulse-modulated digital signals, etc.) are supplied through image signal input terminal 331 and are delivered to each data wire by opening or closing the signal transfer switch 327 according to a pulse from the horizontal shift register 321. The vertical shift register 322 applies the high pulse to the gates of n-channel MOSFETs 323 in a selected row and the low pulse to the gates of p-channel MOSFETs in the selected row.

As described above, the switches in the pixel section are constructed of the monocrystalline CMOS transmission gates, presenting an advantage that signals to be written into the pixel electrodes can be fully written as signals of source, independent of the threshold value of MOSFET.

Since the switches are made up of the monocrystalline transistors, unstable behavior or the like does not occur at grain boundaries of poly-Si TFT and the high-speed drive with high reliability can thus be realized without dispersion.

Now, described below is the CMP (Chemical Mechanical Polishing) most suitable for polishing of the pixel electrodes of the reflection type.

The chemical mechanical polishing is preferably used, because the surface of pixel electrode can be finished as a very flat surface (mirror surface) thereby. The present invention may adopt the technology disclosed in Japanese Patent Application No. 8-178711 filed prior to this application by the applicant.

The prior application concerns polishing of the surface of pixel electrode by the chemical mechanical polishing, by which the surface of pixel electrode can be made smooth like a mirror surface and by which the surfaces of the all pixel electrodes can be formed on a common plane. Further, after the pixel electrode layer is made on an insulating layer or after an insulating layer is deposited on the pixel electrode layer with holes formed therein, the above polishing step is carried out, thereby better filling the regions between the pixel electrodes by the insulating layer and perfectly eliminating unevenness. This can prevent irregular reflection and alignment failure due to the unevenness, thereby enabling to achieve display of high-quality image.

This technology will be explained using FIGS. 24A to 24E and FIGS. 25F to 25H. FIGS. 24A to 24E and FIGS. 25F to 25H show the pixel section of the active matrix substrate applied to the reflection type liquid-crystal device, but the peripheral driving circuits including the shift registers for driving the switching transistors of the pixel section can also be made on the same substrate at the same time as the pixel section forming step. The fabrication process will be described in order.

Figure 24A:
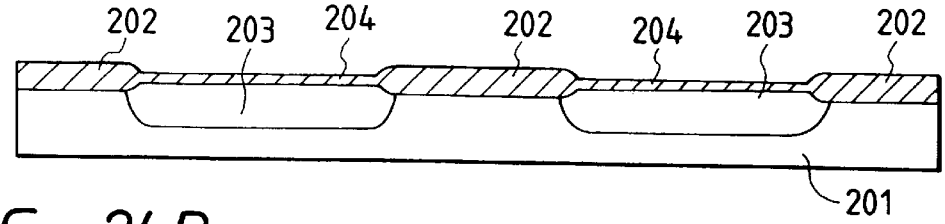
FIGS. 24A, 24B, 24C, 24D and 24E are schematic views for explaining fabrication steps of liquid-crystal panel.

N-type silicon semiconductor substrate 201 in the impurity concentration of $10^{15}$ $cm^{-3}$ or less is locally thermally oxidized to form LOCOS 202. With the LOCOS 202 as a mask, boron is injected in the dose of about $10^{12}$ $cm^{-2}$ by ion implantation, obtaining PWL 203 as p-type impurity regions in the impurity concentration of about $10^{16}$ $cm^{-3}$. This substrate 201 is again thermally oxidized to form gate oxide film 204 in the thickness of oxide film of 1000 Å or less (FIG. 24A).

Figure 24B:
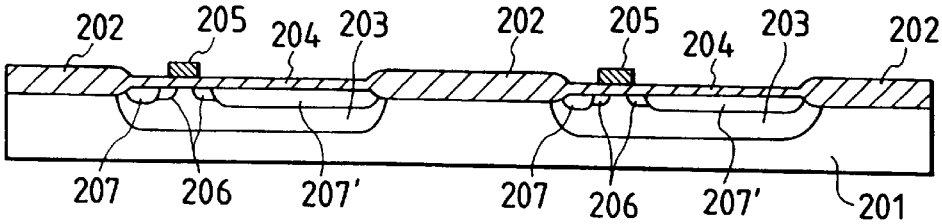

After gate electrodes 205 are made of n-type polysilicon doped with phosphorus in about $10^{20}$ $cm^{-3}$, phosphorus is injected by ion implantation in the dose of about $10^{12}$ $cm^{-2}$ into the entire surface of substrate 201 to form NLD 206 as n-type impurity regions in the impurity concentration of about $10^{16}$ $cm^{-3}$. Then, using a patterned photoresist as a mask, phosphorus is injected by ion implantation in the dose of about $10^{15}$ $cm^{-2}$, thereby forming the source and drain regions 207, 207' in the impurity concentration of about $10^{19}$ $cm^{3}$ (FIG. 24B).

Figure 24C:
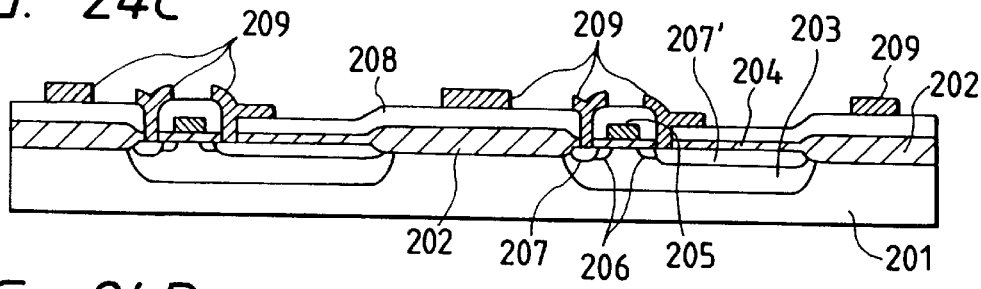

PSG 208 as an interlayer film is then formed over the entire surface of substrate 201. This PSG 208 can be replaced by NSG (Nondoped Silicate Glass)/BPSG (Boro-Phospho-Silicate Glass) or TEOS Tetraethoxy-Silane). Contact holes are made by patterning in the PSG 208 immediately above the source and drain regions 207, 207'. After evaporation of Al by sputtering, the Al layer is patterned to form Al electrodes 209 (FIG. 24C). For improving the ohmic contact characteristics between the Al electrodes 209 and the source and drain regions 207, 207', the barrier metal layer of Ti/TiN or the like is preferably formed between the Al electrodes 209 and the source and drain regions 207, 207'.

Figure 24D:
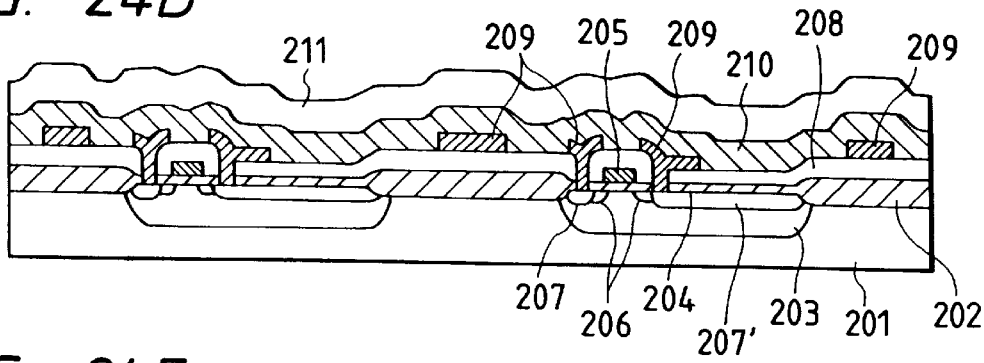

Plasma SiN 210 is deposited in about 3000 Å over the entire surface of substrate 201 and then PSG 211 is deposited in the thickness of about 10000 Å (FIG. 24D).

Figure 24E:
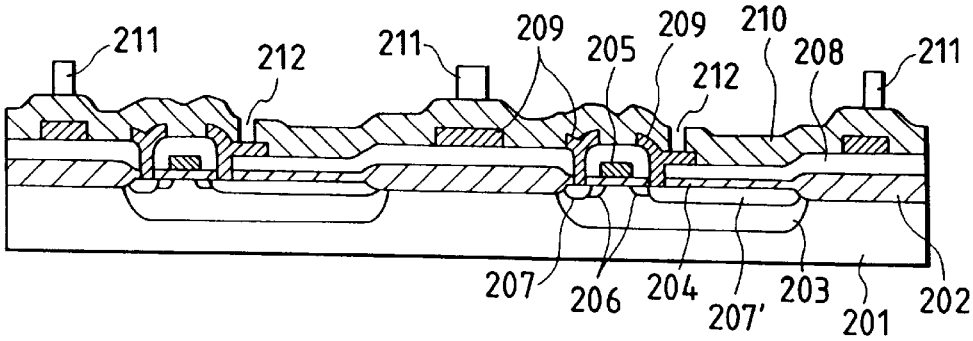

Using the plasma SiN 210 as a dry etching stopper layer, the PSG 211 is patterned so as to leave only the separation regions between the pixels, and thereafter through holes 212 are patterned by dry etching immediately above the Al electrodes 209 in contact with the drain regions 207' (FIG. 24E).

Figure 25F:
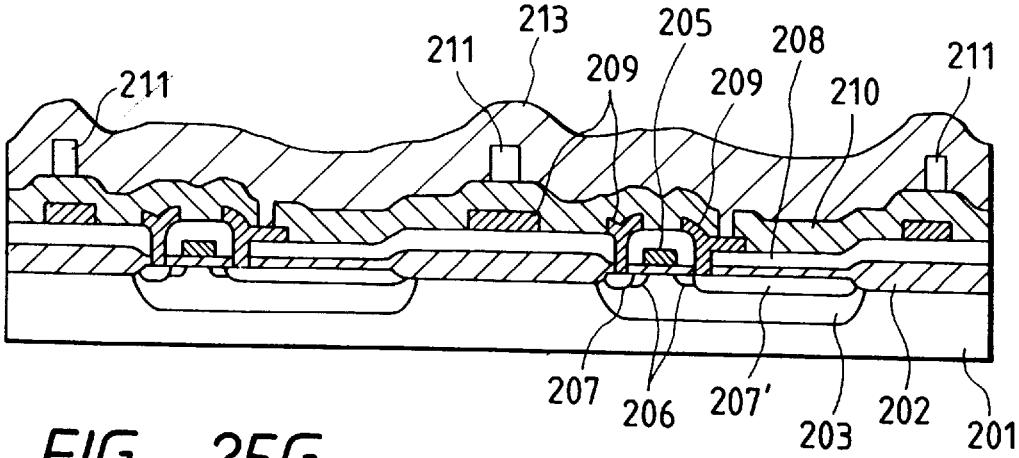
FIGS. 25F, 25G and 25H are schematic views for explaining fabrication steps of liquid-crystal panel (note

Pixel electrode layer 213 is deposited in the thickness of 10000 Å or more on the substrate 201 by sputtering or EB (Electron Beam) evaporation (FIG. 25F). This pixel electrode layer 213 is made of a material selected from metal layers of Al, Ti, Ta, W, and so on or layers of compounds of these metals.

Figure 25G:
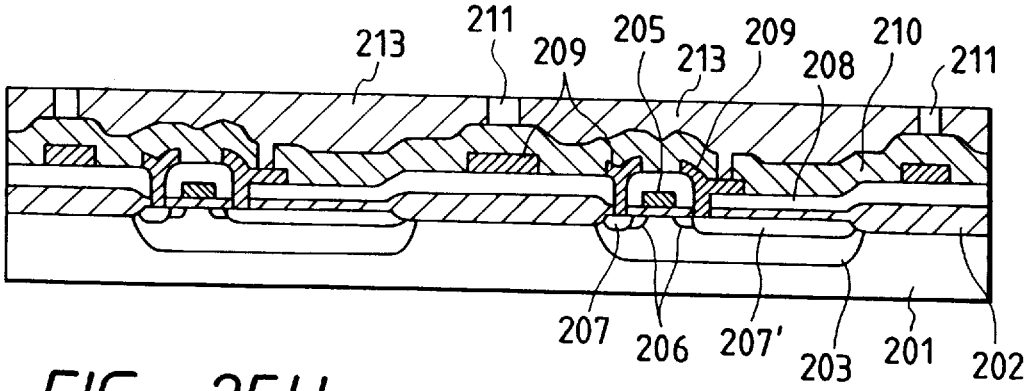

The surface of pixel electrode layer 213 is polished by the CMP (FIG. 25G). If the thickness of PSG 211 is 10000 Å and the thickness of the pixel electrode layer is x Å, a polishing amount is between x Å inclusive and x+10000 Å.

Figure 25H:
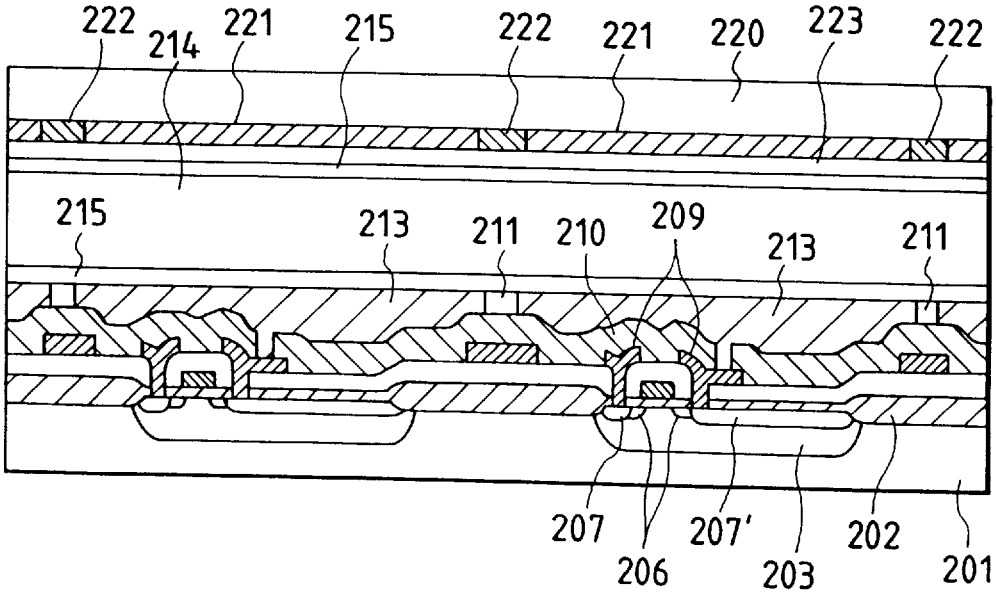

Alignment film 215 is further formed over the surface of the active matrix substrate made by the above steps, the surface of alignment film 215 is processed by an alignment process such as a rubbing process, it is then bonded through a spacer (not illustrated) to the opposed substrate, and the liquid crystal 214 is injected to the space between them, thereby forming the liquid-crystal elements (FIG. 25H). In the present example, the opposed substrate is composed of color filter 221, black matrix 222, common electrode 223 of ITO or the like, and alignment film 215' on a transparent substrate 220.

In the active matrix substrate of the present example, as apparent from FIG. 25H, the surface of pixel electrode 213 is smooth and the insulating layer is buried in gaps between adjacent pixel electrodes. Therefore, the surface of the alignment film 215 formed thereon is also smooth without unevenness. Hence, application of this technology can prevent decrease of light utilization efficiency due to scattering of incident light, degradation of contrast due to rubbing failure, and occurrence of bright line caused by lateral electric field due to a step between pixel electrodes, all of which were caused by unevenness on the pixel electrodes, and can thus raise the quality of display image.

Next, a plan view of the liquid-crystal panel of this example is shown in FIG. 17 (a cross-sectional view of which is shown in FIG. 16). In the drawing, reference numeral 321 designates the horizontal shift register, 322 the vertical shift register, 323 an n-channel MOSFET, 324 a p-channel MOSFET, 325 a holding capacitor, 326 a liquid-crystal layer, 327 a signal transfer switch, 328 a reset switch, 329 a reset pulse input terminal, 330 a reset power terminal, and 331 an input terminal of image signal The semiconductor substrate 301 is of the p-type in FIG. 16, but it may be of the n-type.

Figure 18:
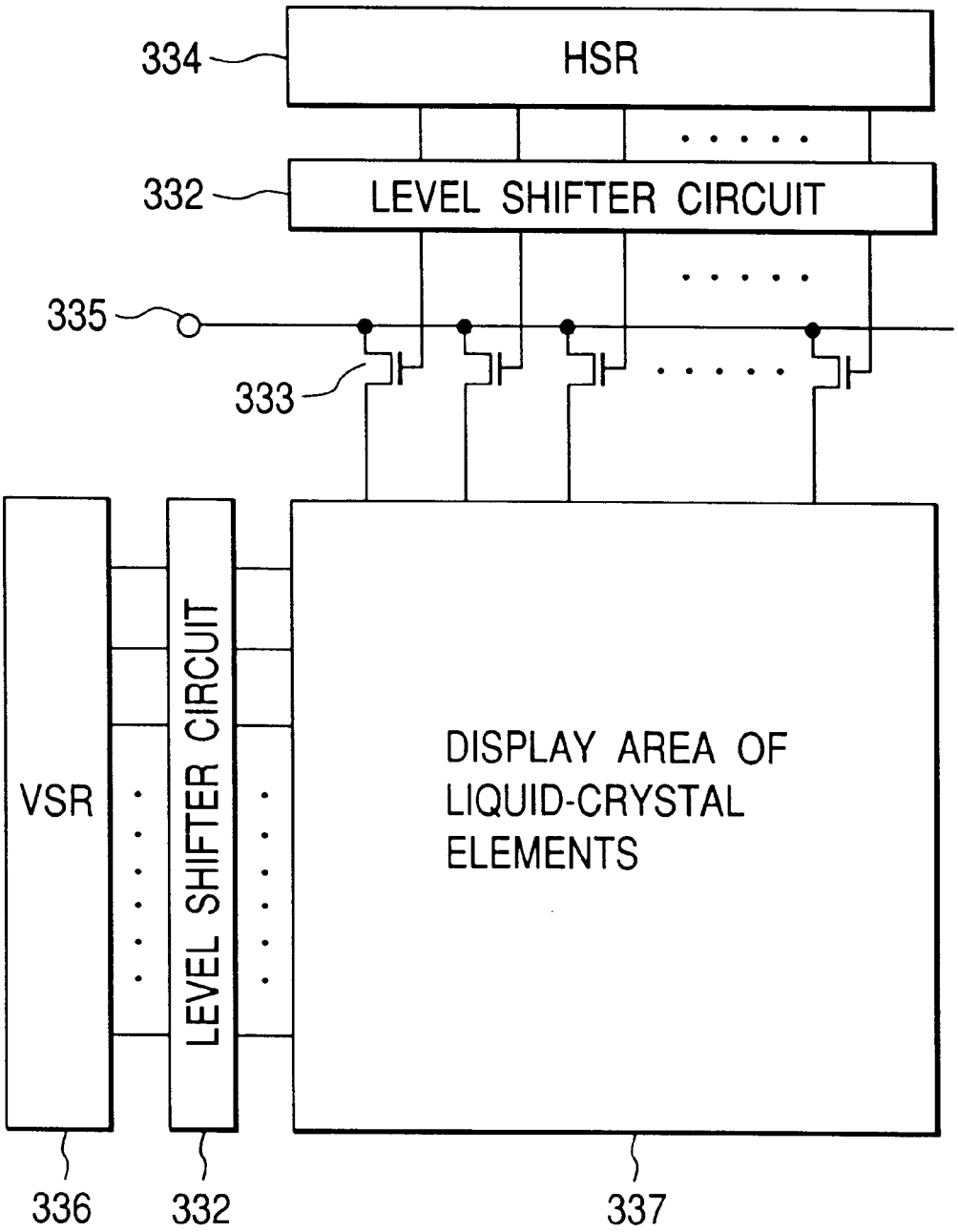
FIG. 18 is a block diagram of a liquid-crystal device according to the present invention.

The configuration of the peripheral circuits of panel will be described below referring to FIG. 18. In FIG. 18, numeral 337 denotes the display area of liquid-crystal elements, 332 a level shifter circuit, 333 a video signal sampling switch, 334 the horizontal shift register, 335 a video signal input terminal, and 336 the vertical shift register.

In the above configuration, the amplitude of about 25 V to 30 V is supplied through the video signal input terminal 335, and the logic circuits including the both horizontal and vertical shift registers etc. can thus be driven at the very low value of about 1.5 to 5 V, thereby achieving the high-speed operation and low consumption power. The horizontal and vertical shift registers in this example can perform two-way scanning by selection switches and are ready for change of arrangement or the like of the optical system without changing the panel. Therefore, the same panel can be used in different series of products, thus presenting a merit of decrease of cost. In FIG. 18, the video signal sampling switches are of the one transistor configuration of single polarity, but, without having to be limited to this, they may be of the CMOS transmission gate configuration so as to permit all signals on the input video line to be written into the signal lines, of course.

When the CMOS transmission gate configuration is applied, the problem of fluctuation occurring in the video signals will arise due to the difference in the area between the NMOS gate and PMOS gate or in overlap capacitance between the gate and the source/drain. For solving it, the source and drain of MOSFET in the gate amount equal to approximately a half of the gate amount of MOSFETs of sampling switches of the respective polarities are connected to each signal line and a pulse of opposite phase is applied thereto, which prevents the fluctuation and by which very good video signal are written on the signal lines. This enabled to display an image with still higher quality.

Figure 19:
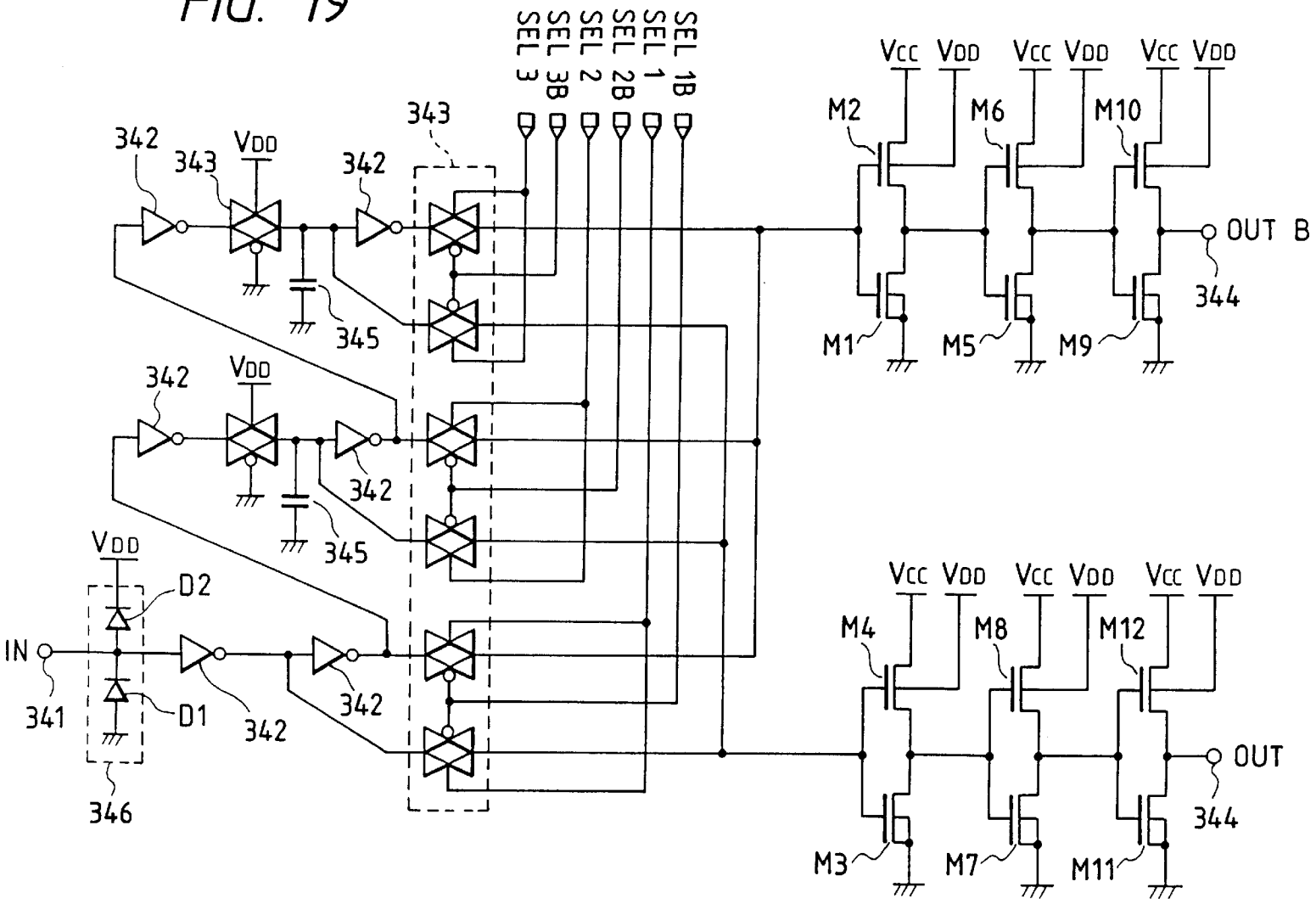
FIG. 19 is a circuit diagram including a delay circuit in an input section of the liquid-crystal device according to the present invention.

Next described with FIG. 19 is a way for accurate synchronization between the video signal and sampling pulse. For this, it is necessary to change a delay amount of sampling pulse. Numeral 342 denotes inverters for pulse delay, 343 switches for determining which delay inverter is to be selected, 344 outputs controlled in the delay amount, and 345 capacitors (wherein OUTB indicates an opposite-phase output and OUT does a common-mode output). Numeral 346 represents a protecting circuit.

How many delay inverters 342 a signal pass can be determined by selection of combination of SEL 1 (SEL 1B) to SEL 3 (SEL 3B).

Since this synchronizing circuit is built in the panel, even if delay amounts of pulses from the outside of panel lose symmetry because of a jig or the like in the case of the three-sheet panel of R, G, and B, the delay amounts can be adjusted by the above selection switches, whereby good display images can be obtained without positional deviation due to the high region of pulse phase of R, G, and B. It is also a matter of course that it is effective to employ such an arrangement that a temperature-measuring diode is built in the panel and that the delay amounts are temperature-corrected referring to a table, based on an output from the diode.

Next described is the relationship with the liquid-crystal material. FIG. 16 showed the flat structure of opposed substrate, but the common electrode substrate 316 in fact has unevenness for preventing interface reflection of the common transparent electrode 315 and the common transparent electrode 315 is formed on the uneven surface. The antireflection film 320 is provided on the opposite side of the common electrode substrate 316. An effective method for forming the uneven shape is a method of sand polishing with abrasive grains of small particle sizes, which is effective in achieving high contrast.

The liquid-crystal material used is a polymer network liquid crystal PNLC. However, a polymer dispersed liquid crystal PDLC or the like may be used as the polymer network liquid crystal. The polymer network liquid crystal PNLC is made by the polymer phase separation method. A solution prepared from a liquid crystal and a polymerizable monomer or oligomer, the solution is injected into a cell by ordinary method, then UV polymerization takes place to effect phase separation between the liquid crystal and the polymer, thereby forming the polymer of network pattern in the liquid crystal. The PNLC contains many liquid crystal molecules (70 to 90 wt %).

In the PNLC, while optical scattering is strong in use of a nematic liquid crystal having large anisotropy of refractive index ($\Delta n$), drive can be done at low voltage in use of a nematic liquid crystal having large anisotropy of dielectric constant ($\Delta E$). When the size of the polymer network, i.e., center-to-center distance of the network is 1 to 1.5 ($\mu$m), the optical scattering becomes strong enough to achieve high contrast.

Figure 20:
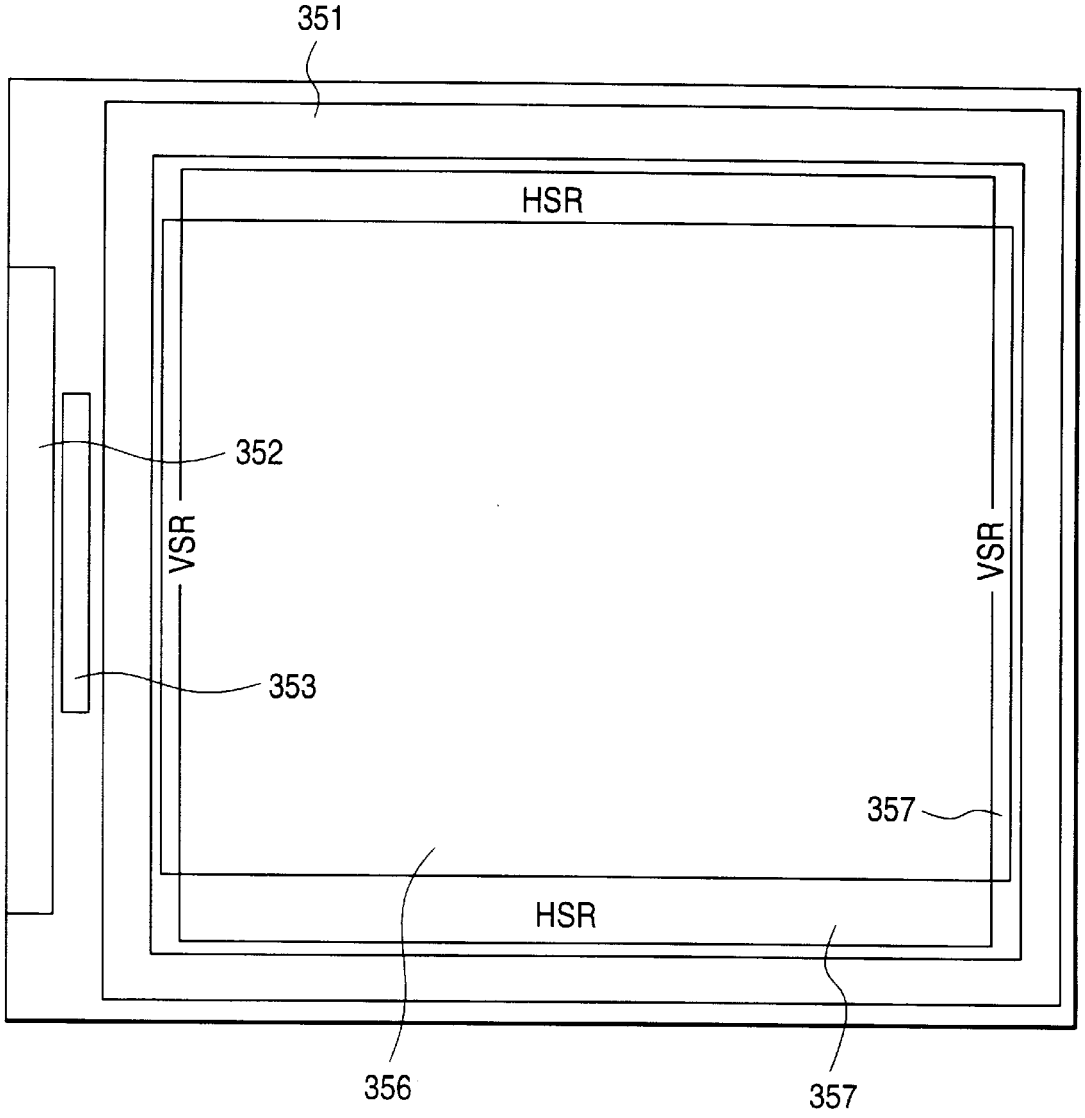
FIG. 20 is a conceptual drawing of a liquid-crystal panel of the liquid-crystal device according to, the present invention.

The relationship between the seal structure and the panel structure will be described below referring to FIG. 20. In FIG. 20, numeral 351 denotes a seal portion, 352 an electrode pad section, and 353 a clock buffer circuit. An amplifier section not illustrated is used as an output amplifier upon electrical inspection of panel. There is an unrepresented Ag paste section for taking in the potential of opposed substrate. Numeral 356 represents a display section composed of the liquid-crystal elements and 357 a peripheral circuit section including the horizontal and vertical shift registers (SR) and so on. The seal section 351 indicates a contact region of contact bonding material or adhesive for bonding the glass substrate having the common electrode 315 to a member obtained by forming the pixel electrodes 312 on the semiconductor substrate 301 around the four sides of the display section 356. After they are bonded to each other by the seal section 351, the liquid crystal is injected into the display section 356 and the shift register section 357.

In the present embodiment, as shown in FIG. 20, the circuits are formed both inside and outside the seal in order to decrease the total chip size. In the present example, the outlets of pads are concentrated on one side of the panel, but they may be located on the both longer sides or on many sides more than one, which is effective for handling of high-speed clock.

When the semiconductor substrate such as the Si substrate is used for constructing the liquid-crystal display device, the side walls of substrate are exposed to strong light, for example, in a projector, and the substrate potential varies, which could cause a malfunction of panel. Therefore, the side walls of panel and the peripheral circuit section around the display area in the top surface of panel are preferably covered by a substrate holder capable of shielding light. Further, the back side of the Si substrate is preferably constructed in such a holder structure that a metal with high thermal conductivity such as Cu is connected through an adhesive with high thermal conductivity with the back surface.

The pixel electrodes of the liquid-crystal display device of the present invention can be made as reflection type electrodes. In this case, the surfaces of the electrodes are polished by the aforementioned Chemical Mechanical Polishing (CMP), whereby the electrode surfaces are conveniently formed in the mirror surface state without unevenness. The method using this CMP is different from the ordinary method for first patterning a metal layer and polishing it, and is a method for preliminarily forming grooves for formation of electrodes at positions where the electrode patterns should be formed, in the insulating region by etching, then depositing a metal layer thereon, and thereafter polishing the metal layer to remove the metal layer on the regions where the electrode patterns are not to be formed and to flatten the metal layer on the electrode pattern regions to the level of the insulating region. When this method is employed, the width of wiring is extremely wider than those of the regions other than the wiring and, according to the common sense of conventional etching apparatus, execution of etching would raise a problem that a polymer is deposited during etching to obstruct patterning.

Thus we investigated the etching conditions in the conventional oxide film based etching ($CF_4/CHF_3$ based etching).

Figure 21A:
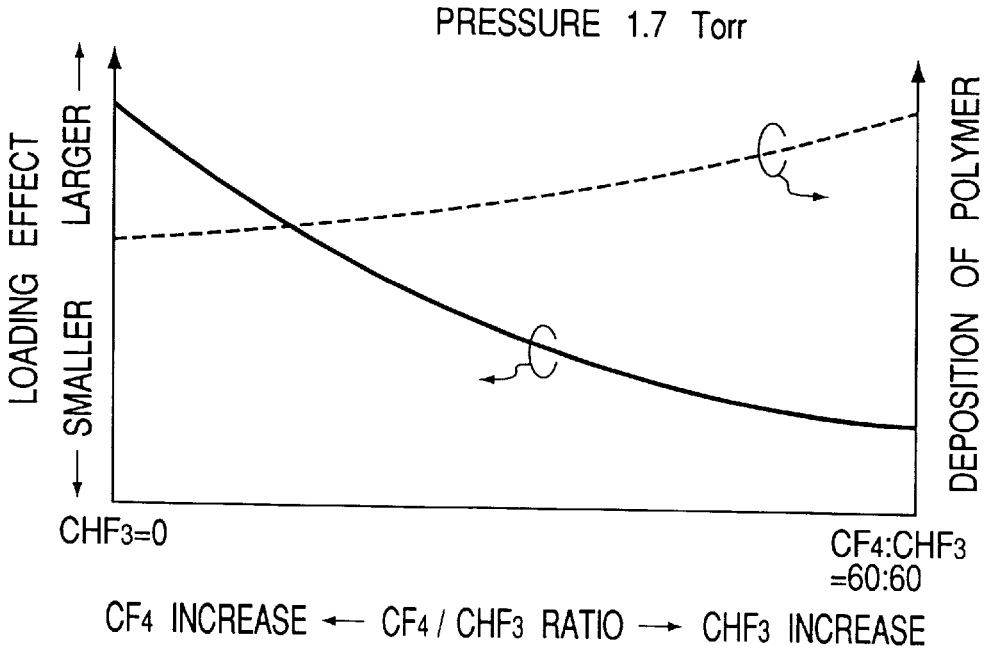
FIGS. 21A and 21B are graphs for determining whether the etching process in fabrication of the liquid-crystal device according to the present invention is good or bad.
Figure 21B:
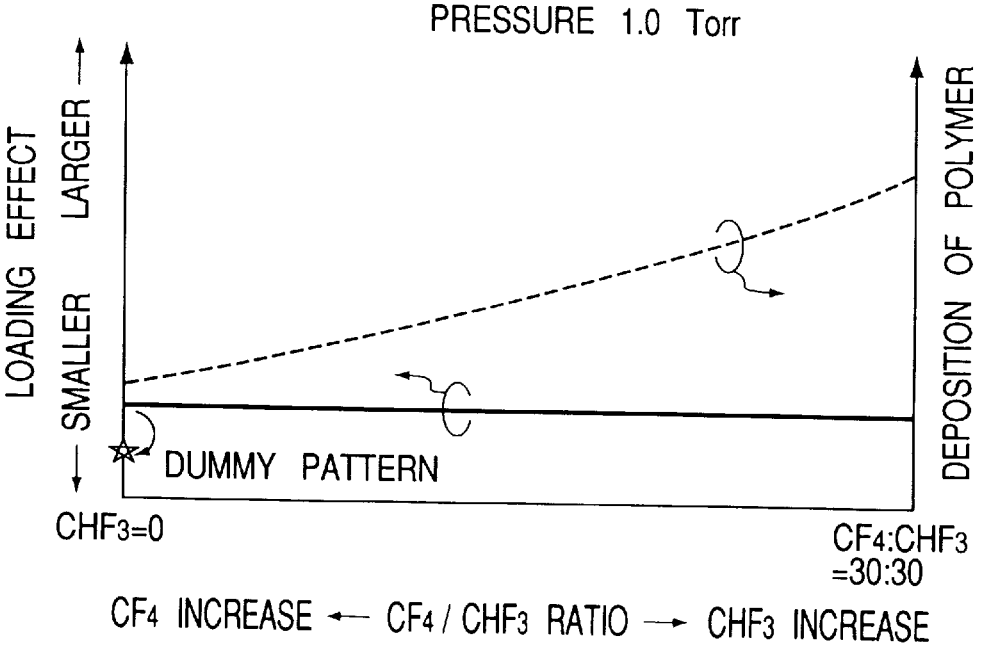

FIGS. 21A and 21B are drawings to show whether the etching process is good or bad.

FIG. 21A shows the result of conventional etching when the total pressure was 1.7 Torr.

FIG. 21B shows the result of etching (in the investigation this time) when the total pressure was 1.0 Torr.

Under the condition of FIG. 21A, deposition of polymer actually decreases with decrease of the deposition-nature gas $CHF_3$, but dimensional differences (the loading effect) become extremely great between patterns close to the resist and patterns far therefrom, which are not available for practical use.

From FIG. 21B, it is seen that as the pressure is gradually decreased in order to suppress the loading effect, the loading effect is considerably suppressed at pressures of 1 Torr and less and that etching with only $CF_4$ and zero $CHF_3$ is effective.

Further, little resist exists in the pixel electrode region while the resist covers the peripheral section. It was found that it was difficult to make a structure and that a dummy electrode equivalent to the pixel electrodes was effectively formed as a structure up to the peripheral section of display area.

This structure has such effects that the level difference, which existed before, is eliminated between the display section and the peripheral section or the seal section to enhance the gap accuracy and in-plane uniformity and that nonuniformity upon injection of liquid crystal is also decreased, thereby enabling to obtain the panels of high quality at high yields.

Figure 22:
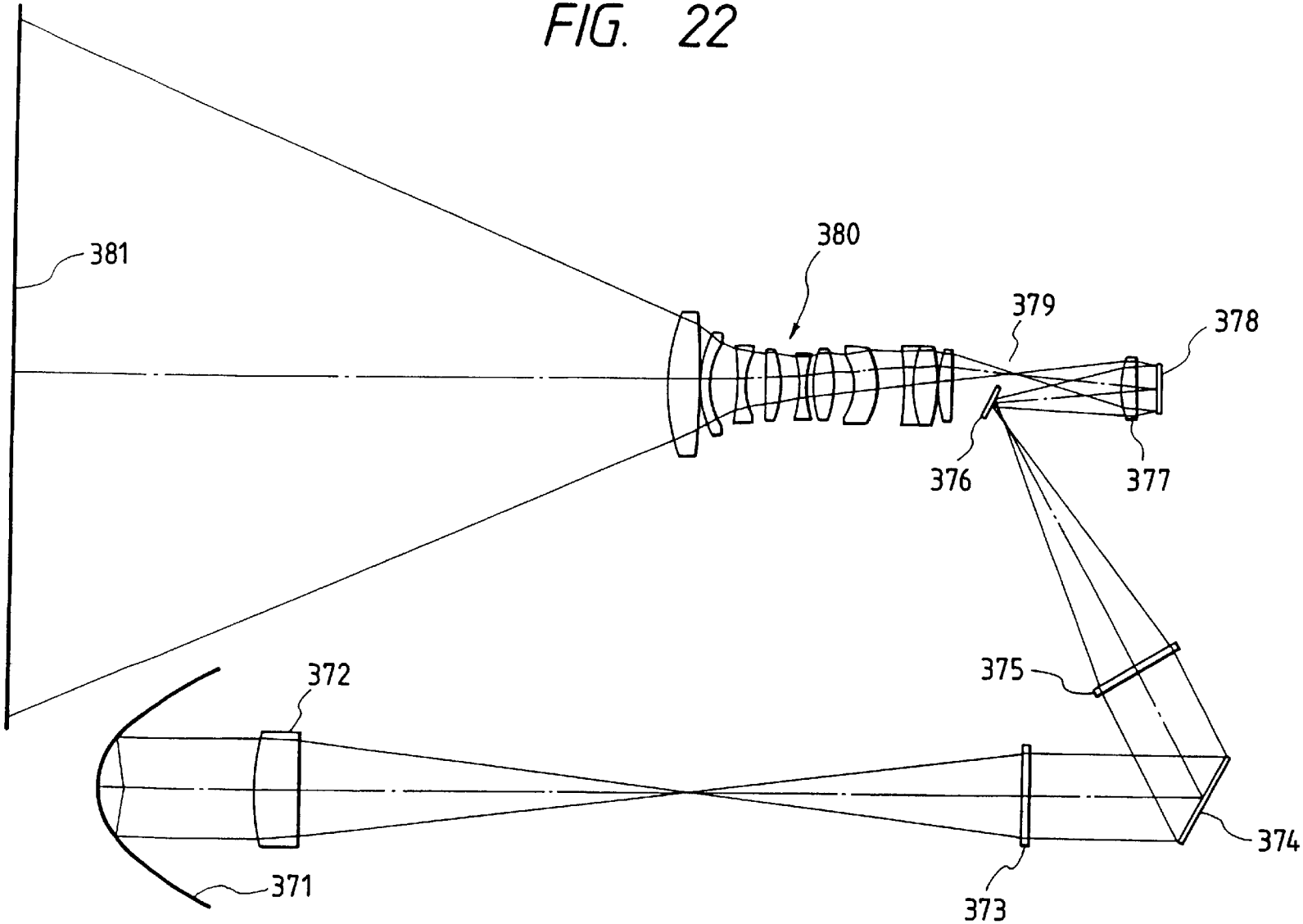
FIG. 22 is a conceptual drawing of a liquid-crystal projector incorporating the liquid-crystal device according to the present invention.

Next described with FIG. 22 is an optical system incorporating the reflection type liquid-crystal panel of the present invention. In FIG. 22, reference numeral 371 indicates a light source such as a halogen lamp, 372 a condenser lens for condensing a light source image, 373, 375 convex Fresnel lenses of a flat surface shape, and 374 a color separation optical element for separating the light into R, G, and B beams. The color separation optical element 374 effectively used may be selected from a dichroic mirror, a diffraction grating, and so on.

Numeral 376 represents mirrors, each for guiding either of the R, G, and B beams to a corresponding panel out of three R, G, and B panels, numeral 377 a field lens for condensing a beam to illuminate a reflection type liquid-crystal panel in the form of parallel light, and 378 the reflection type liquid-crystal elements described above. A stop is located at the position of 379. Numeral 380 denotes a projection lens unit for enlarging the image by a combination of plural lenses, and 381 a screen. Normally, a clear and bright image can be obtained in high contrast when the screen 381 is constructed of two units including a Fresnel lens for converting projected light into parallel light and a lenticular lens for displaying the image at wide vertical and horizontal field angles. The configuration of FIG. 22 is illustrated with only one color panel, but the elements between the color separation optical element 374 and the stop part 379 are separated into those for the three colors and three panels are disposed. It is also possible, of course, to employ a single panel configuration wherein a microlens array is provided on the panel surface of the reflection type liquid-crystal device and wherein different incident beams are projected to different pixel areas, as well as the three panel structure. When the voltage is applied to the liquid-crystal layer in the liquid-crystal elements, light regularly reflected by each pixel is guided through the stop part indicated by 379 to be projected onto the screen.

On the other hand, when the liquid-crystal layer is a scattering body without application of voltage, the light incident to the reflection type liquid-crystal elements is isotropically scattered, so that the scattered light other than that within the angle viewing the aperture of the stop section indicated by 379 is not incident to the projection lens unit. This indicates black. As seen from the above optical system, it requires no polarizing plate and the entire surface of pixel electrode makes the signal light incident into the projection lens at high reflectivity. Therefore, the display is two to three times brighter than before. Since in the present example the surfaces and interfaces of the opposed substrate are processed by the antireflection treatment, the high-contrast display is achieved with very little noise light. Since the panel size is small, the all optical elements (lenses, mirrors, etc.) are compactified, thus achieving the low cost and light weight.

Color nonuniformity, luminance nonuniformity, and variations of the light source can be corrected for by interposing an integrator (of the rod type like the fly's eye lens) between the light source and the optical system, whereby color nonuniformity and luminance nonuniformity is eliminated on the screen.

Figure 23:
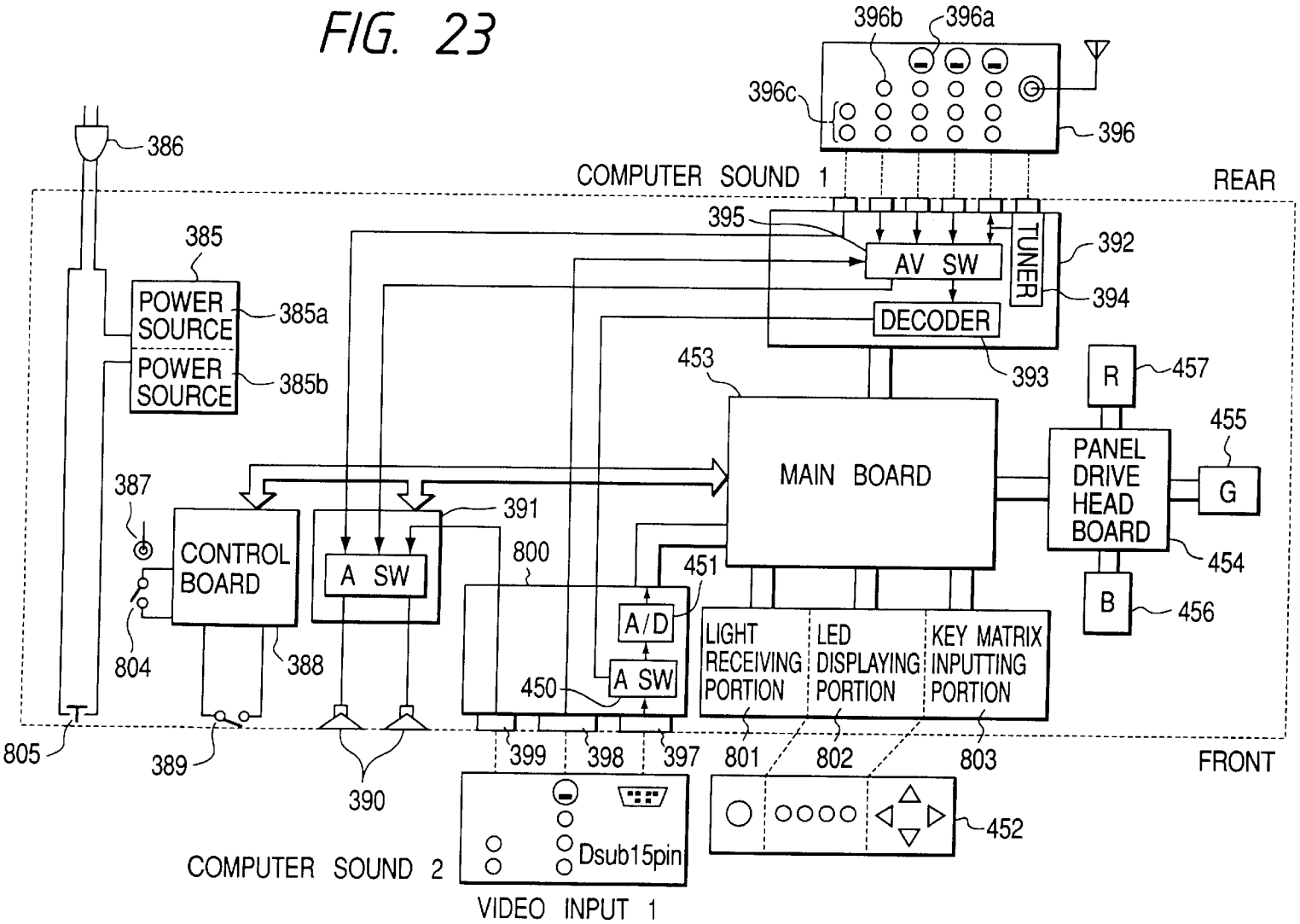
FIG. 23 is a circuit block diagram to show the inside of the liquid-crystal projector according to the present invention.

The peripheral electric circuits other than the above liquid-crystal panel will be described referring to FIG. 23. In the drawing, numeral 385 denotes the power supply, which is separated mainly into a power supply 385*b* for lamp and a system power supply 385*a* for driving the panel and signal processing circuits. Numeral 386 indicates a plug, 805 a main power supply switch, and 387 a lamp temperature detector. With anomaly of the temperature of lamp, control board 388 executes a control for stopping the lamp, for example. 804 denotes a lamp safety switch. The same control is also carried out with a filter safety switch of 389, not only for the lamp. For example, a safety measure is provided to lock a hot lamp house box when it is tried to open. Numeral 390 denotes speakers and 391 a sound board, in which a processor of 3D sound, surround sound, or the like can be built as occasion may demand. Numeral 392 stands for an extender board 1, which is comprised of input terminals from external device 396, such as S terminals 396*a* for video signal, composite image 396*b* for video signal, and sound 396*c*, selection switch 395 for selection of which signal is to be selected, and tuner 394 and from which a signal is sent through decoder 393 to extender board 2, 800. On the other hand, the extender board 2 mainly has terminals such as a video input terminal from another system and a Dsub 15-pin terminal of computer and switch 450 for switching the video signal from the decoder 393 to a signal from the other system and vice versa. A signal through the switch 450 is converted to a digital signal in A/D converter 451.

Numeral 453 is a main board mainly comprised of a CPU and a memory such as a video RAM. NTSC signal after A/D conversion in the A/D converter 451 is temporarily stored in the memory and, for well assigning signals to a number of pixels, signal processing is carried out; e.g., interpolation to produce signals for vacant elements insufficient to match the number of liquid-crystal elements, γ conversion edge enhancement suitable for the liquid-crystal display elements, bright control bias adjustment, and so on. If a computer signal, e.g. a signal of VGA, is supplied instead of the NTSC signal and if the panel is an XGA panel of high resolution, a resolution conversion process thereof is also carried out. This main board 453 also carries out a process for combining a computer signal with NTSC signals of plural image data pieces, in addition to the processing of one image data. In FIG. 23, numeral 801 designates a light receiving portion for remote control, 802 an LED displaying portion, and 803 a key matrix inputting portion for adjustment. The output from the main board 453 is subjected to serial-parallel conversion and is supplied to panel drive head board 454 in the form unlikely to be affected by noise. This head board 454 again performs parallel-serial conversion and thereafter D/A conversion to divide the signal according to the number of video lines of the panel. Then signals are written through a drive amplifier into each of the liquid-crystal panels 455, 456, 457 of the B, G, and R colors. Numeral 452 denotes a remote control panel, through which the computer screen can be manipulated easily with the same feeling as TV. Each of the liquid-crystal panels 455, 456, 457 has the same liquid-crystal device structure provided with a color filter of each color and the horizontal and vertical scanning circuits thereof are those described in the first to fifth embodiments. Since each liquid-crystal device converts an image not always having a high resolution, to a high-definition image by the processing as described above, a very beautiful image can be displayed.

[Seventh Embodiment]

Described herein is a so-called single-panel type full-color display device in which the liquid-crystal device (panel) of the present invention is provided with microlenses.

The applicant proposed a novel display panel in Japanese Patent Application No. Hei 9-72646 as a solution to extreme degradation of the quality of display image because of the conspicuous mosaic structure of R, G, and B in the projection type display device using the conventional display panel with microlenses. The display panel proposed in the Japanese Patent Application No. 9-72646 is a display panel having a pixel unit array in which pixel units are arrayed two-dimensionally at predetermined pitch on a substrate, each pixel unit being constructed in such an arrangement that among three color pixels of first, second, and third color pixels, a combination of the first and second color pixels are arranged in a first direction and a combination of the first and third color pixels are arranged in a second direction different from the first direction so as to share the first color pixel, and a microlens array in which a plurality of microlenses are arrayed two-dimensionally on the pixel unit array on the substrate, one pitch of the microlenses being equal to the pitch of the two color pixels in the first direction and in the second direction.

Described herein is an example wherein the display panel proposed in the Japanese Patent Application No. 9-72646 is applied to the liquid-crystal device and display device of the present invention.

Figures 27A, 27B, 27C:
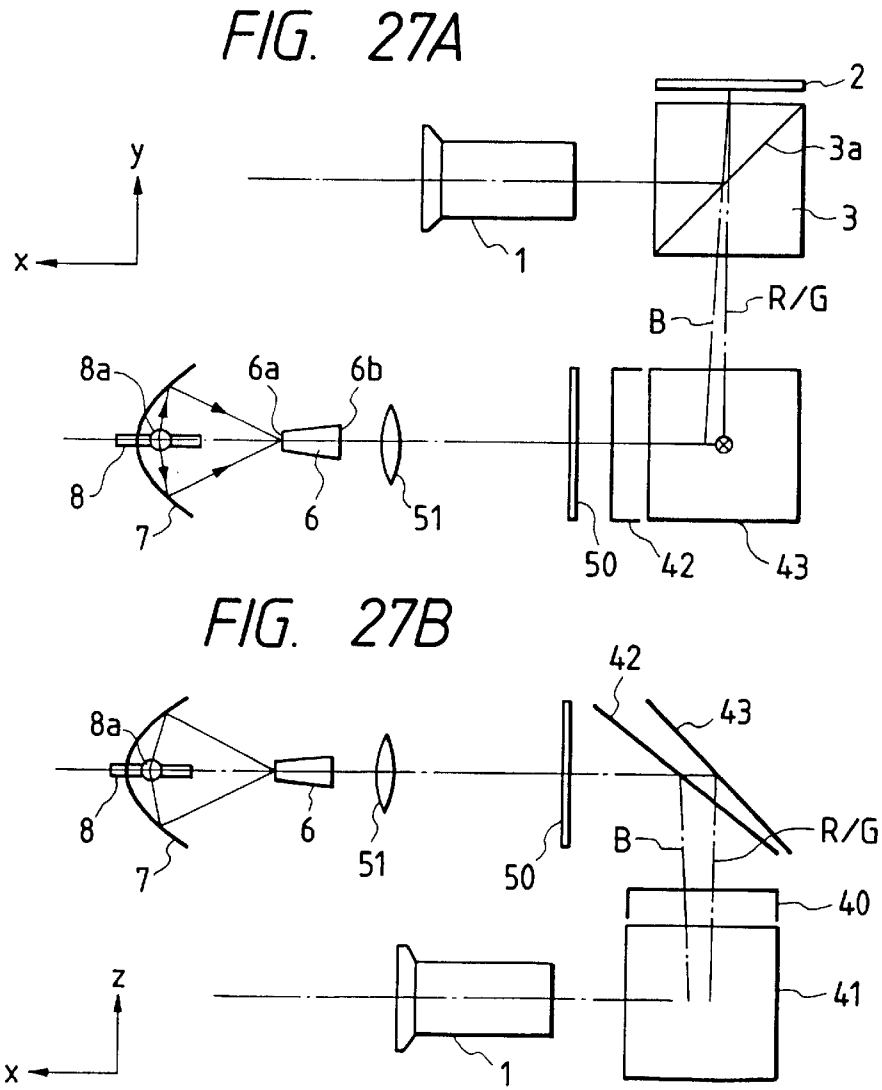
FIGS. 27A, 27B and 27C are schematic diagrams to show an example of the projection type display device of the present invention.

FIGS. 27A to 27C are schematic views to show the major part of the optical system in a projection type liquid-crystal display device using the display panel of the present example. FIG. 27A is a top plan view thereof, FIG. 27B a front view, and FIG. 27C is a side view.

In the drawings reference numeral 1 designates a projection lens, which projects information of an image displayed in the display panel (liquid-crystal panel) 2 with microlenses incorporating the liquid-crystal device, onto a predetermined plane. Numeral 3 denotes a polarizing beam splitter (PBS), for example, which transmits s-polarized light but reflects p-polarized light. Numeral 40 represents an R (red light)-reflecting dichroic mirror, 41 a B/G (blue and green light)-reflecting dichroic mirror, 42 a B (blue light)-reflecting dichroic mirror, 43 a high reflection mirror for reflecting full color light, 50 a Fresnel lens, 51 a convex lens (positive lens), 6 a rod-type integrator, and 7 an ellipsoidal reflector in which a light emitting surface 8*a* of arc lamp (light source) 8 such as a metal halide lamp or a UHP is positioned at the center.

Figure 28A:
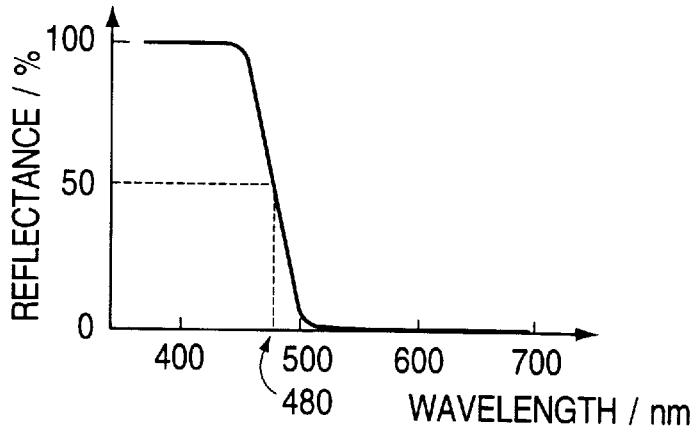
FIGS. 28A, 28B and 28C are spectral reflection characteristic diagrams of dichroic mirrors used in the projection type display device of the present invention.
Figure 28B:
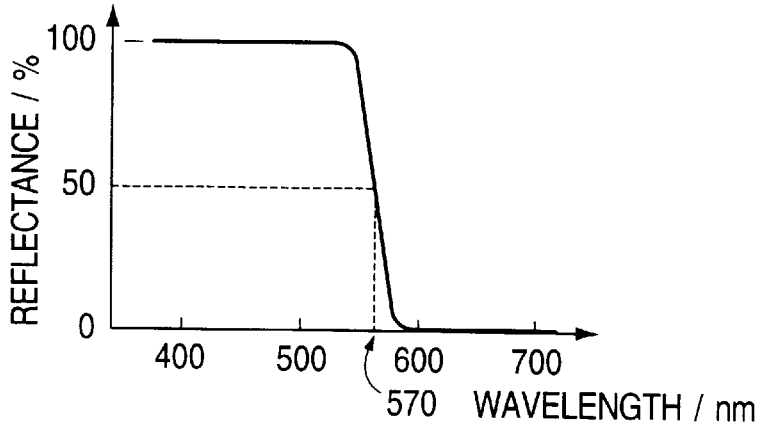
Figure 28C:
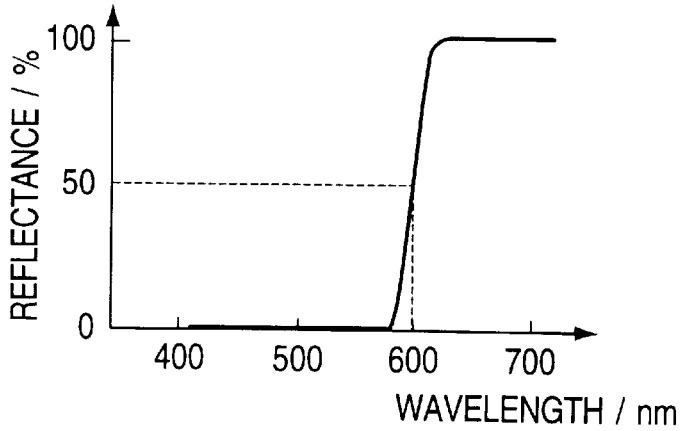
Figure 29:
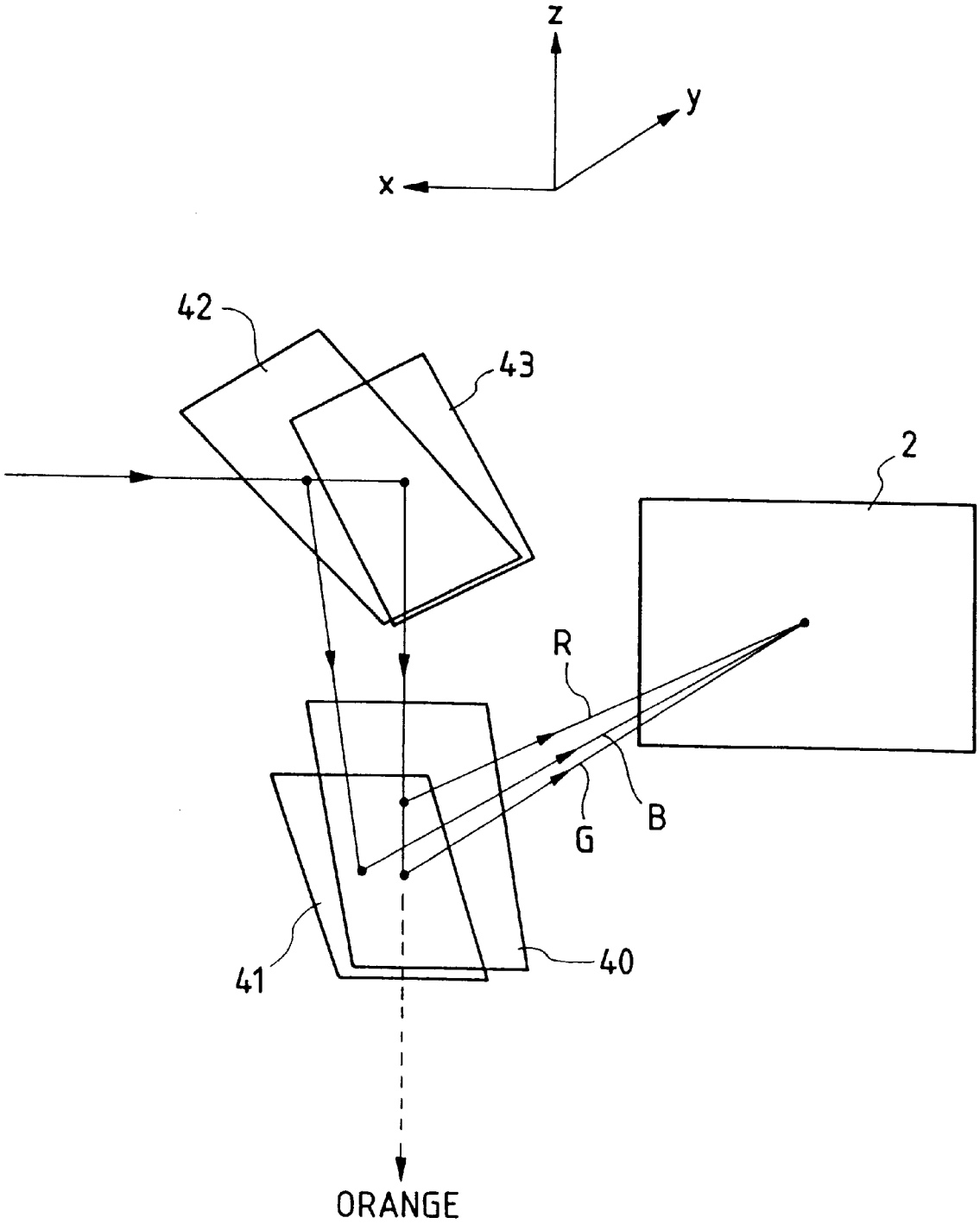
FIG. 29 is a perspective view of a color-separating illumination section in the projection type display device of the present invention.

Here, the R (red light)-reflecting dichroic mirror 40, B/G (blue and green light)-reflecting dichroic mirror 41, and B (blue light)-reflecting dichroic mirror 42 have the spectral reflection characteristics as shown in FIG. 28C, FIG. 28B, and FIG. 28A, respectively. These dichroic mirrors, together with the high reflection mirror 43, are located three-dimensionally as shown in the perspective view of FIG. 29, in which FIG. 29 43 denotes high reflection mirror 43 (G/R-reflecting), and chromatically separate white illumination light from the light source 8 into three color beams of R, G, and B as described below to project the beams toward the liquid-crystal panel 2 and to make the respective primary color beams illuminate the liquid-crystal panel in three-dimensionally different directions.

The operation will be described according to the traveling path of light from the light source 8. First, the white beam emitted from the lamp 8 is collected by the ellipsoidal reflector 7 to be condensed on the entrance (incident surface)

6*a* of the integrator 6 located ahead thereof. The spatial intensity distribution of beam becomes uniform as the beam travels as repetitively reflected in this integrator 6. The beam emergent from the exit 6*b* of the integrator 6 is converted into a parallel beam in the direction along the negative x-axis (on the basis of FIG. 27B) by the convex lens 51 and Fresnel lens 50 to first reach the B-reflecting dichroic mirror 42.

This B-reflecting dichroic mirror 42 reflects only the B light (blue light), so that the blue light is reflected at a predetermined angle relative to the z-axis downward (on the basis of FIG. 27B), i.e., toward the R-reflecting dichroic mirror 40. On the other hand, the other color light (R/G light) than the B light passes through the B-reflecting dichroic mirror 42 and is reflected at the right angle into the direction of the negative z-axis (downward) by the high reflection mirror 43 to also travel toward the R-reflecting dichroic mirror 40.

Describing on the basis of FIG. 27B, the B-reflecting dichroic mirror 42 and high reflection mirror 43 are positioned so as to reflect the beam from the integrator 6 (traveling in the direction of the negative x-axis) into the directions along and near the negative z-axis (downward). The high reflection mirror 43 is inclined just at 45° relative to the xy plane about the rotation axis along the y-axis direction. In contrast with it, the B-reflecting dichroic mirror 42 is set at an angle smaller than this 45° relative to the xy plane about the rotation axis along the y-axis direction.

Therefore, the R/G light reflected by the high reflection mirror 43 is reflected into the direction along the negative z-axis, while the B light reflected by the B-reflecting dichroic mirror 42 travels downward at the predetermined angle relative to the z-axis (as tilted in the xz plane). For equalizing illumination areas on the liquid-crystal panel 2 by the B light and the R/G light, a shift amount and a tilt amount of the high reflection mirror 43 and B-reflecting dichroic mirror 42 are selected so that the principal rays of the respective color beams may cross on the liquid-crystal panel 2.

Next, the R/G/B light directed downward (in the negative z-axis directions) as described above travels toward the R-reflecting dichroic mirror 40 and B/G reflecting dichroic mirror 41, which are located below the B-reflecting dichroic mirror 42 and the high reflection mirror 43. First, the B/G-reflecting dichroic mirror 41 is positioned at an inclination of 45° relative to the xz plane about the rotation axis of the x-axis, while the R-reflecting dichroic mirror 40 is also set at an angle smaller than this 45° relative to the xz plane about the rotation axis of the x-axis direction.

The B/G light out of the R/G/B light incident to these thus first passes the R-reflecting dichroic mirror 40 and then is reflected at the right angle into the direction along the positive y-axis by the B/G-reflecting dichroic mirror 41. Then the B/G light passes through the PBS 3 to be polarized and thereafter illuminates the liquid-crystal panel 2 located in parallel to the xz plane.

Among the beams, the B light has already traveled at the predetermined angle relative to the x-axis (as tilted in the xz plane) (see FIG. 27A and FIG. 27B) as described above, so that it maintains the predetermined angle relative to the y-axis (as tilted in the xy plane) even after reflected by the B/G-reflecting dichromic mirror 41. Therefore, the B light illuminates the liquid-crystal panel 2 at the angle of incidence equal to the inclination angle (in the direction in the xy plane). The G light is reflected at the right angle by the B/G-reflecting dichroic mirror 41 to travel in the direction of the positive y-axis and to pass through the PBS 3 to be polarized. Then the G light illuminates the liquid-crystal panel 2 at the incidence angle of 0°, i.e., normally thereto.

The R-light is reflected into the direction near the positive y-axis by the R-reflecting dichromic mirror 40 located before the B/G-reflecting dichromic mirror 41 as described above and travels at the predetermined angle relative to the y-axis (as tilted in the yz plane) in the direction near the positive y-axis as shown in FIG. 27C (the side view). The R light then passes the PBS 3 to be polarized and thereafter illuminates the liquid-crystal panel 2 at the incidence angle equal to this angle relative to the y-axis (in the direction in the yz plane).

For equalizing the illumination areas on the liquid-crystal panel 2 by the respective color beams of R, G, and B similarly as described above, a shift amount and a tilt amount of the B/G-reflecting dichromic mirror 41 and R-reflecting dichromic mirror 40 are selected so that the principal rays of the respective color beams may cross on the liquid-crystal panel 2.

Further, since the cut wavelength of the B/G-reflecting dichromic mirror 41 is 570 nm and the cut wavelength of the R-reflecting dichromic mirror 40 is 600 nm as shown in FIGS. 28B and 28C, unnecessary orange color light passes through the B/G-reflecting dichromic mirror 41 to go away from the optical path, whereby an optimum color balance is achieved.

The liquid-crystal panel 2 reflects and polarization-modulates each R, G, B light as described below and the light returns to the PBS 3 to be reflected into the direction of the positive x-axis by the PBS surface 3*a* of PBS 3. This beam is incident to the projection lens 1. The projection lens 1 enlarges an image displayed on the liquid-crystal panel 2 and projects the enlarged image onto the screen (not illustrated).

Since the R, G, B beams illuminating the liquid-crystal panel 2 have the different angles of incidence, the R, G, B beams reflected therefrom also have different angles of emergence. The projection lens 1 has the lens diameter and aperture enough to take in the all beams. Since each color beam passes the microlenses twice to be paralleled, the inclinations of the beams incident to the projection lens 1 are maintained equal to those of the incident beams to the liquid-crystal panel 2.

Figures 39, 40:
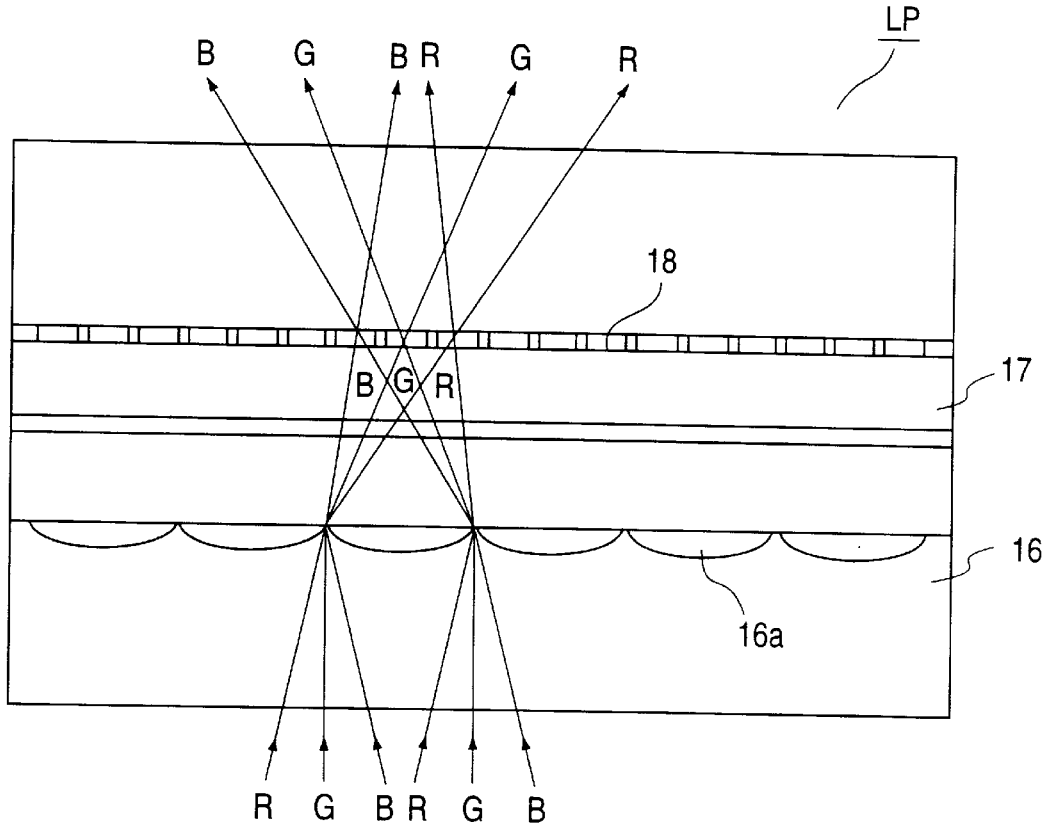
FIG. 39 is a partially enlarged cross-sectional view of a conventional transmission type liquid-crystal panel with microlenses.
FIG. 40 is a partially enlarged view of a projected image on the screen in a conventional projection type display device incorporating the transmission type liquid-crystal panel with microlenses.

In contrast, in the case of the transmission type liquid-crystal panel LP of the conventional example as shown in FIG. 39, beams emerging from the liquid-crystal panel LP diverged more because of addition of the converging effect of microlenses 16 and, therefore, the projection lens for taking in the beams was a large projection lens because of a need for a larger numerical aperture.

In FIG. 39, numeral 16 denotes a microlens array in which a plurality of microlenses 16*a* are arrayed at predetermined pitch, 17 a liquid-crystal layer, and 18 pixels of R (red), G (green), and B (blue).

The illumination beams R, G, B of the respective colors of red, green, and blue are guided at different angles to the liquid-crystal panel LP and the respective color beams are made incident to different color pixels 18 by the converging effect of microlenses 16*a*. This permits the display panel to be constructed without necessitating the color filters and to achieve high light utilization efficiencies. A projection type display device incorporating such a display panel can project and display a bright full color picture even if the panel is a single liquid-crystal panel.

With the projection type display device incorporating the microlens-covered display panel described above, however, the color pixels 18 of R, G, and B of the projection display image are enlarged and projected on the screen. Thus, the mosaic structure of R, G, and B becomes conspicuous as shown in FIG. 40 and the display device has a defect that the mosaic structure extremely degrades the quality of display image.

In comparison with it, the present example is arranged to maintain the spread of beam from the liquid-crystal panel 2 relatively small and to obtain the projected image with sufficient brightness on the screen even by a projection lens with a smaller numerical aperture, thereby enabling to use a smaller projection lens. In addition, the present example can suppress the conspicuous mosaic structure of R, G, and B.

Figure 30:
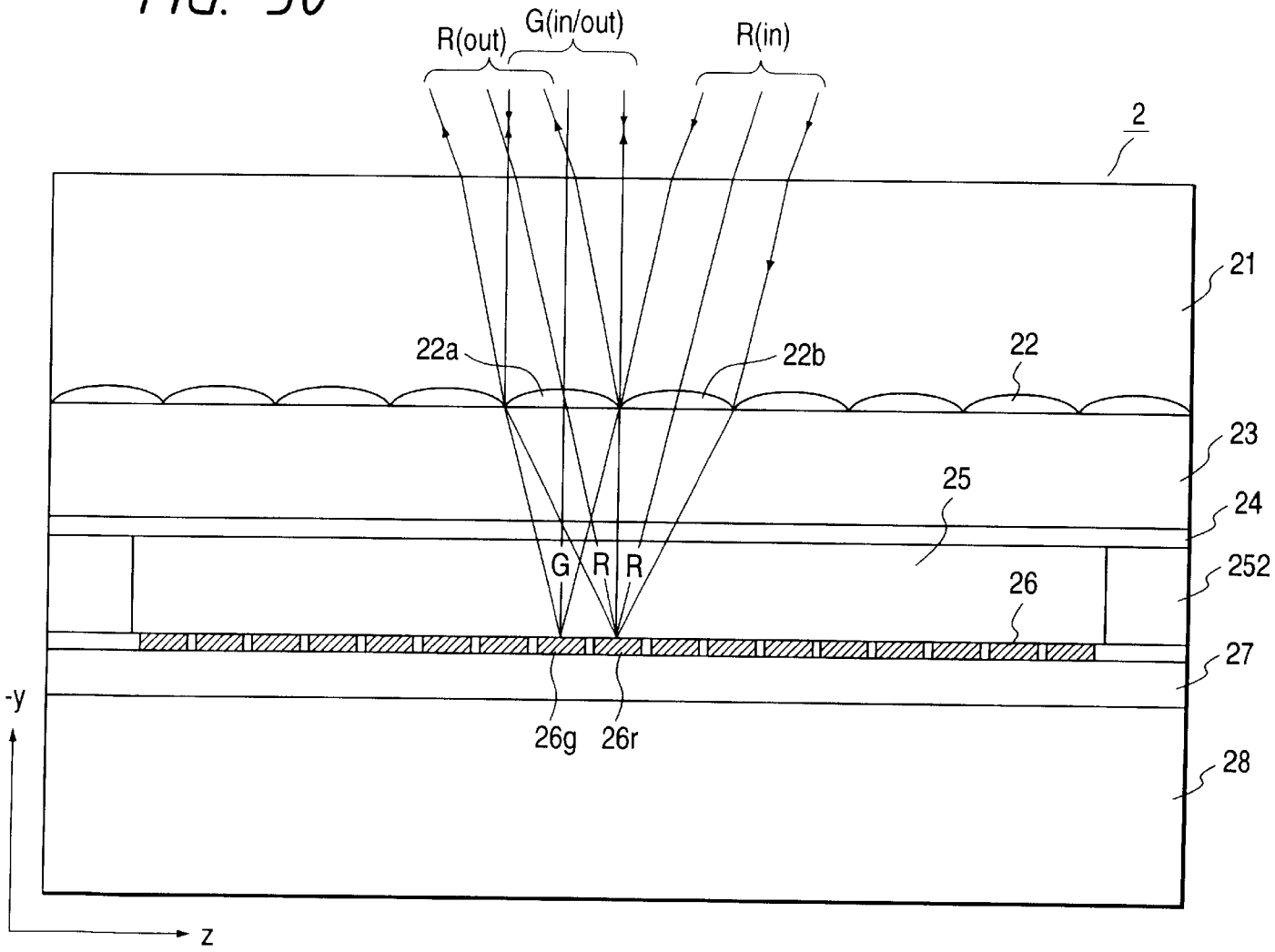
FIG. 30 is a cross-sectional view to show an example of the liquid-crystal panel of the present invention.

Now, the liquid-crystal panel 2 according to the present invention will be described. FIG. 30 is an enlarged, cross-sectional, schematic diagram of the liquid-crystal panel 2 according to the present example (which is a cross section cut by the yz plane in FIG. 27C). In FIG. 30 the driving circuits, which are the features of the present invention, are not illustrated, because they were already described in detail in the other embodiments.

Reference numeral 21 denotes a microlens substrate (glass substrate), 22 microlenses, 23 a glass sheet, 24 a transparent opposed electrode, 25 a liquid-crystal layer, 26 pixel electrodes, 27 an active matrix driving circuit section, and 28 a silicon semiconductor substrate. The microlenses 22 are made on the surface of glass substrate (alkali based glass) 21 by the so-called ion exchange method and have the two-dimensional array structure of lenses located at the pitch equal to the double of the pitch of pixel electrodes 26, thereby composing the microlens array.

The liquid-crystal layer 25 is of a nematic liquid crystal of the so-called ECB mode such as DAP or HAN suitable for the reflection type and predetermined alignment thereof is maintained by the alignment layers not illustrated. The pixel electrodes 26 are made of Al (aluminum) and also serve as a reflecting mirror. The pixel electrodes 26 are processed by the CMP process discussed previously in the final step after patterning, for improving the surface property to raise the reflectivity.

The active matrix driving circuit section 27 is provided on the silicon semiconductor substrate 28. The active matrix driving circuit 27 including the horizontal circuit and vertical circuit as drivers is arranged to write primary color image signals of R, G, and B into predetermined R, G, B pixels. The pixel electrodes 26 have no color filter, but they are distinguished as R, G, B pixels by the primary color image signals written by the active matrix driving circuit 27, thereby forming a predetermined R, G, B pixel array described below.

First described is the G light out of the illumination light to the liquid-crystal panel 2. After polarized by the PBS 3, the principal rays of the G light are incident normally to the liquid-crystal panel 2 as described above. An example of rays incident to one microlens 22*a* out of such rays are indicated by arrows G (in/out) in the drawing.

As illustrated herein, the G rays are converged by the microlens 22*a* to illuminate the G pixel electrode 26*g*. Then the rays are reflected by the pixel electrode 26*g* made of Al and pass through the same microlens 22*a* to go out of the liquid-crystal panel 2. During the go and return passage through the liquid-crystal layer 25 in this way, the G rays (polarized light) are subjected to modulation by operation of the liquid crystal under the electric field established between the pixel electrode and the opposed electrode 24 by the signal voltage applied to the pixel electrode 26*g* and go out of the liquid-crystal panel 2 to return to the PBS 3. Here, the quantity of light reflected by the PBS surface 3*a* toward the projection lens 1 changes depending upon a degree of the modulation, thereby achieving the so-called density-modulated display of each pixel.

As for the R light incident obliquely into the cross section (the yz plane) in the drawing as described above, let us focus attention on the R rays, for example, incident to the microlens 22*b* after also polarized by the PBS 3. As indicated by arrows R (in) in the drawing, the R rays are converged by the microlens 22*b* to illuminate the R pixel electrode 26*r* located as shifted to the left from the position immediately below it. They are then reflected by the pixel electrode 26*r* to travel through the microlens 22*a* adjacent to the microlens 22*b* (in the negative z-direction) this time as illustrated and go out of the liquid-crystal panel 2 (R (out)).

On this occasion, the R rays (polarized light) are also subjected to the modulation by the operation of liquid crystal under the electric field formed between the pixel electrode and the opposed electrode 24 by the signal voltage applied to the R pixel electrode 26*r* and go out of the liquid-crystal panel 2 to return to the PBS 3. The process after that is the same as in the case of the previous G light, and the R light is projected as part of image light by the projection lens 1.

Incidentally, the illustration of FIG. 30 seems as if the G light and the R light partly overlaps above the G pixel electrode 26*g* and above the R pixel electrode 26*r* to interfere with each other, but it should be noted that this is because the liquid-crystal layer 25 is schematically depicted so as to enlarge and emphasize the thickness thereof and that such interference does not occur in fact, regardless of the pixel size, because the thickness of the liquid-crystal layer 25 is actually very thin, approximately 5$\mu$, in comparison with the thickness of glass sheet 23 being 50 to 100$\mu$.

Figure 31A:
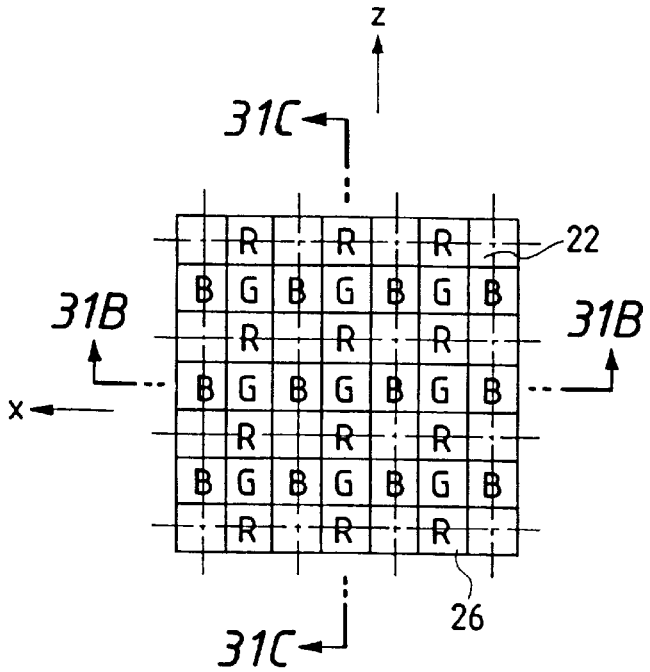
FIGS. 31A, 31B and 31C are explanatory drawings to illustrate the principles of color separation and color synthesis in the liquid-crystal panel of the present invention.
Figure 31C:
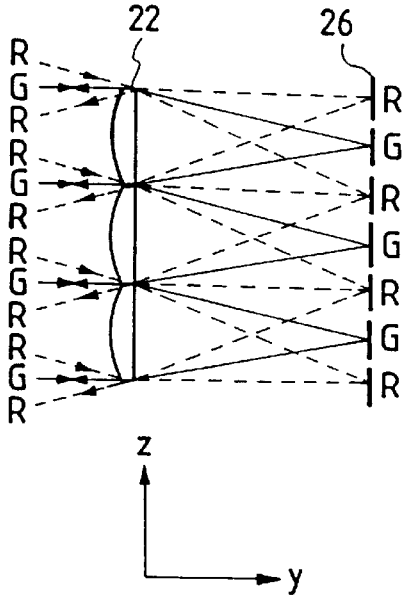
Figure 31B:
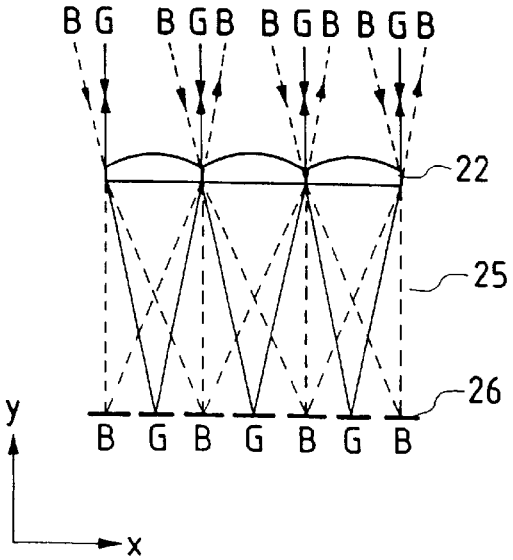

FIGS. 31A to 31C are explanatory drawings for explaining the principles of color separation and color synthesis in the present example. FIG. 31A is a schematic top plan view of the liquid-crystal panel 2 and FIG. 31B and FIG. 31C are a schematic cross-sectional view along 31B—31B (in the x-direction) and a schematic cross-sectional view along 31C—31C (in the z-direction) with respect to the schematic top plan view of the liquid-crystal panel 2.

FIG. 31C corresponds to above FIG. 30 to show the yz cross section and illustrates states of incidence and emergence of the G light and R light incident to each microlens 22 for one pixel. As seen from this illustration, each G pixel electrode as a first color pixel is located immediately below the center of each microlens 22 and each R pixel electrode as a second color pixel immediately below the border between microlenses 22. Accordingly, an angle of incidence of the R light is preferably set so that tanθ thereof may become equal to a ratio of the pixel pitch (B & R pixels) and the distance between the microlens 22 and pixel electrode 26.

On the other hand, FIG. 31B corresponds to the xy cross section of the liquid-crystal panel 2. In the figure, numeral 26 denotes pixel. In this xy cross section the B pixel electrodes as third color pixels and the G pixel electrodes are alternately arranged, similar to FIG. 31C. Each G pixel electrode is also located immediately below the center of each microlens 22 and each B pixel electrode as a third color pixel is located immediately below the border between microlenses 22.

Incidentally, the B light illuminating the liquid-crystal panel 2 is incident obliquely in the cross section (the xy plane) in the drawing, after polarized by the PBS 3 as described above. In the same manner as in the case of the R light, the B rays incident into each microlens 22 are reflected by the B pixel electrode as illustrated and go out of a microlens adjacent to the incident microlens in the x-direction. The modulation by the liquid-crystal layer 25 on the B pixel electrode and the projection of the B light emergent from the liquid-crystal panel 2 are the same as in the case of the G light and R light described above.

Each B pixel electrode is located immediately below the border between microlenses 22 and the angle of incidence of the B light to the liquid-crystal panel 2 is preferably set so that tanθ thereof may become equal to the ratio of the pixel pitch (G & B pixels) and the distance between the microlens 22 and the pixel electrode 26, similar to the R light.

Incidentally, the liquid-crystal panel 2 of the present example is constructed in such an arrangement of the R, G, B pixels that the pixels are aligned as RGRGRG . . . in the z-direction (in the first direction) and as BGBGBG . . . in the x-direction (in the second direction) as described above. FIG. 31A shows the two-dimensional arrangement.

As described, the size of each pixel (color pixel) is approximately a half of the microlens 22 both in length and in width, and the pixel pitch is a half of that of the microlenses 22 both in the x-direction and in the z-direction. Each G pixel is also located immediately below the center of microlens 22 on the two-dimensional arrangement, each R pixel is located between the G pixels in the z-direction and at the border of microlens 22, and each B pixel is located between the G pixels in the x-direction and at the border of microlens. The shape of one microlens unit is square (in the width and length equal to the double of pixel).

Figure 32:
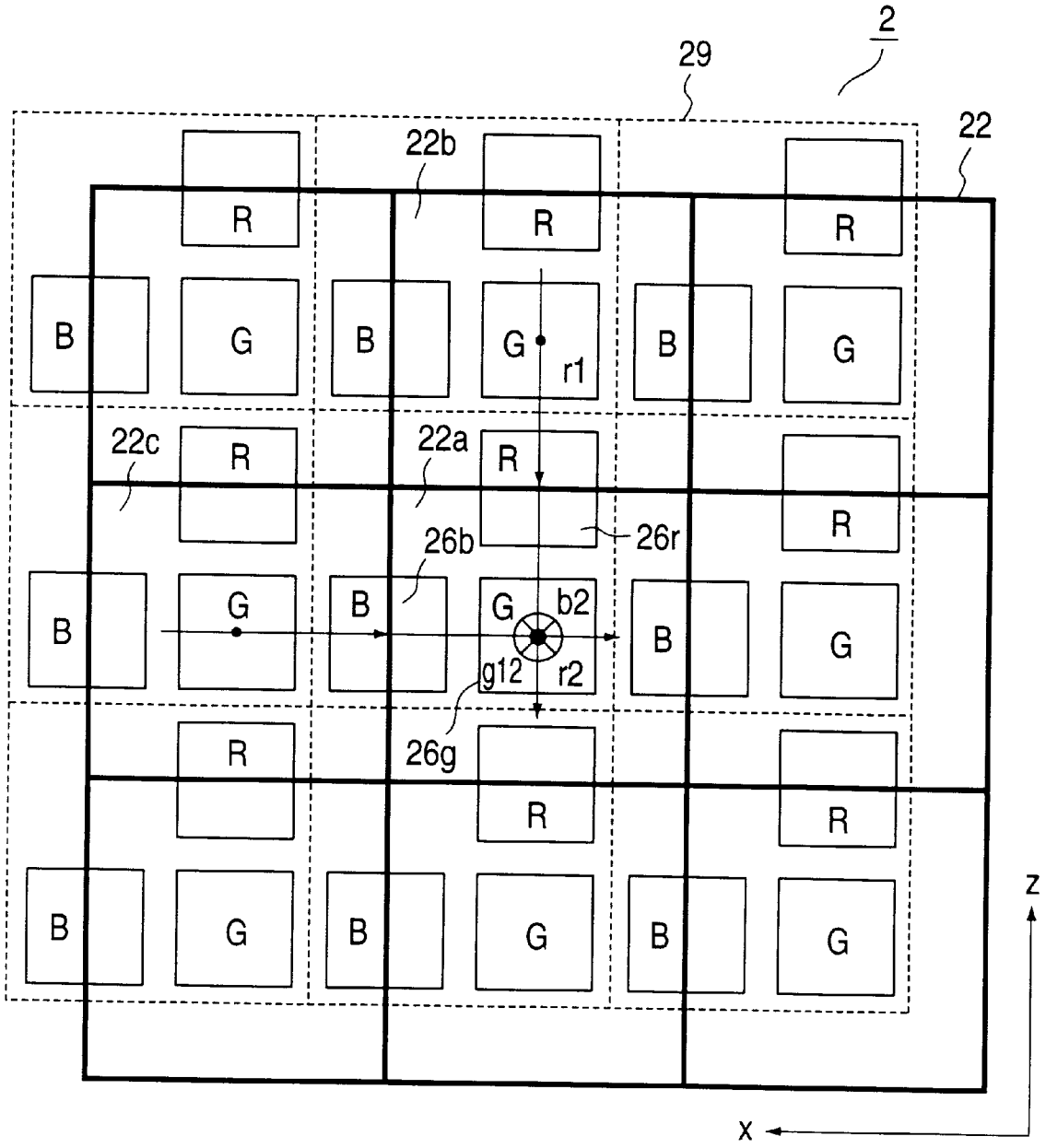
FIG. 32 is a partially enlarged top plan view of an example of the liquid-crystal panel of the present invention.

FIG. 32 is a top plan view to show an enlarged part of the liquid-crystal panel 2 of the present example. Here, each dashed-line grid segment 29 in the drawing indicates a pixel unit as an assembly of R, G, B pixels composing one picture element.

The pixel units are two-dimensionally arrayed at the predetermined pitch on the substrate, thereby composing the pixel unit array. When the R, G, B pixels are driven by the active matrix driving circuit section 27 shown in FIG. 30, the pixel units of R, G, and B indicated by the dashed-line grid segments 29 are driven by R, G, B image signals corresponding to associated pixel positions.

Now, let us focus attention on one picture element composed of R pixel electrode 26*r*, G pixel electrode 26*g*, and B pixel electrode 26*b*. First, the R pixel electrode 26*r* is illuminated by the R light obliquely incident through the microlens 22*b* as indicated by arrow r1, as described above, and the R reflected light is outgoing through the microlens 22*a* as indicated by arrow r2. The B pixel electrode 26*b* is illuminated by the B light also obliquely incident through the microlens 22*c* as indicated by arrow b1, as described above, and the B reflected light is also outgoing through the microlens 22*a* as indicated by arrow b2.

The G pixel electrode 26*g* is illuminated by the G light incident normally thereto (in the direction into the plane of the drawing) through the microlens 22*a* as indicated by forward and backward arrow g12, as described above, and the G reflected light is outgoing normally (in the direction out of the plane of the drawing) through the same microlens 22*a*.

As described above, in the liquid-crystal panel 2, concerning the R, G, B pixel unit 29 composing one picture element, the incident illumination positions of the respective primary color illumination beams are different, but the emergent beams thereof are outgoing through the same microlens (e.g., through the microlens 22*a* in this case). This is also the case for the all other picture elements (R, G, B pixel units).

Figure 33:
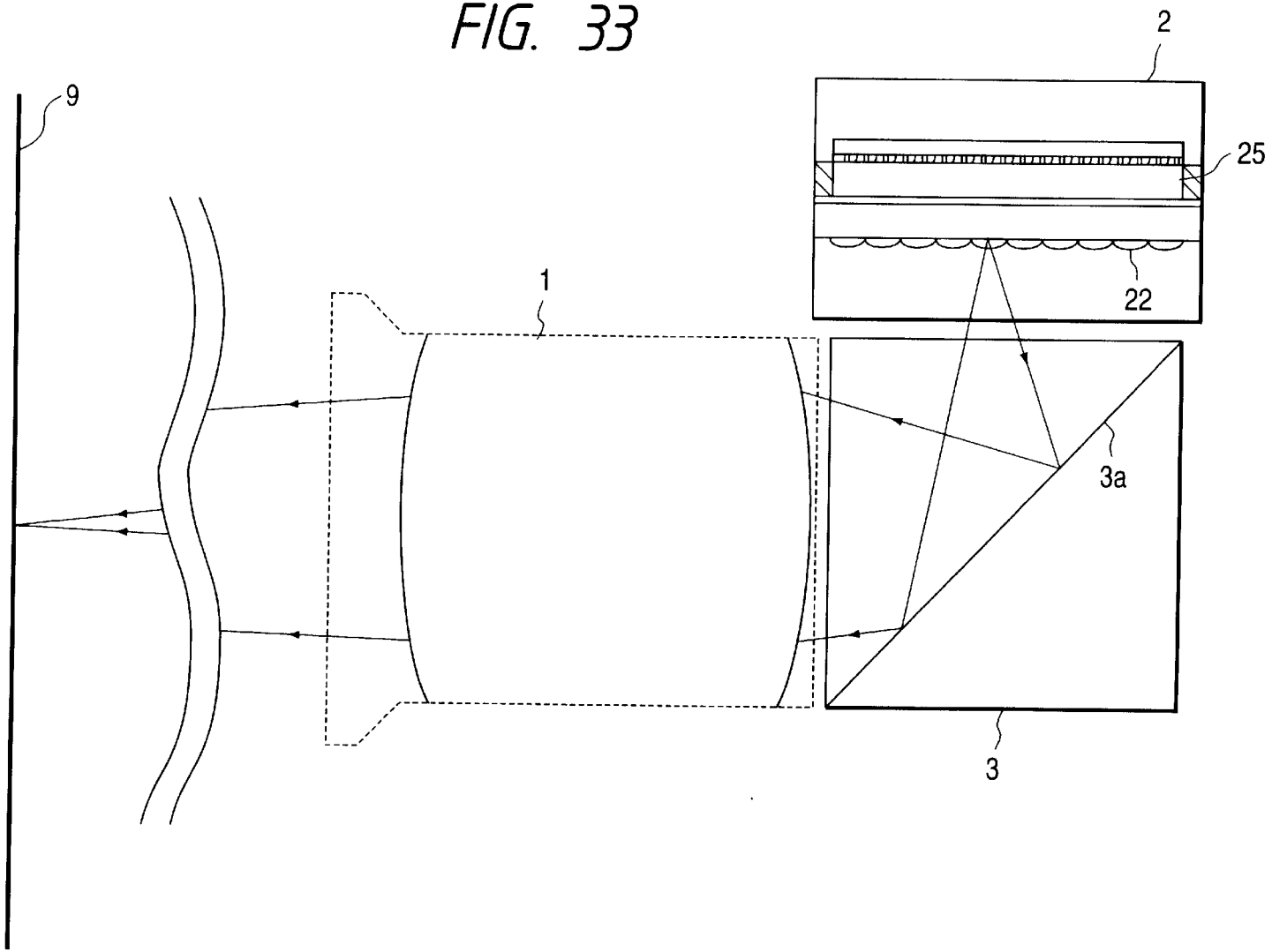
FIG. 33 is a schematic diagram to show a projection optical system in the projection type display device of the present invention.
Figure 35:
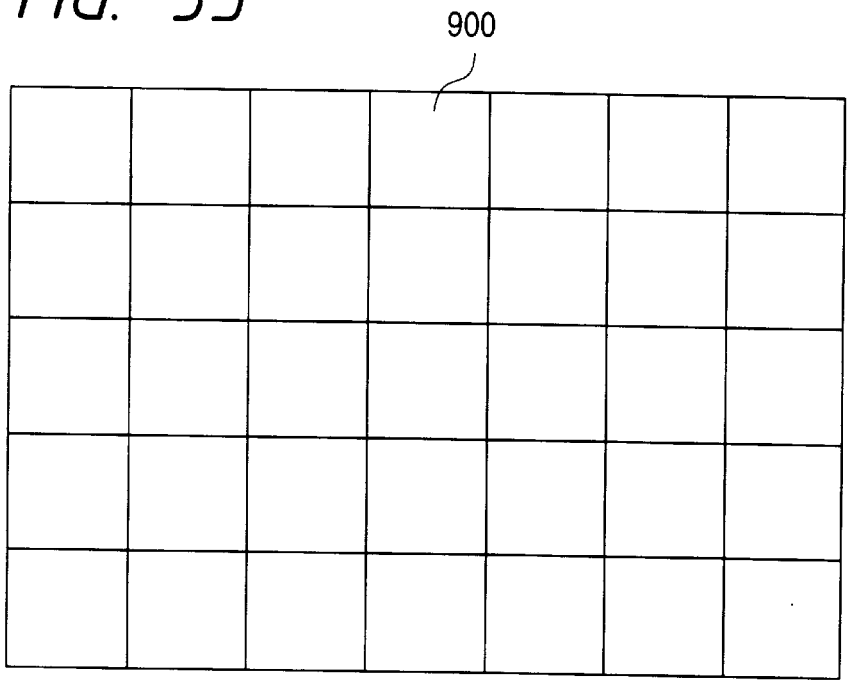
FIG. 35 is a partially enlarged view of a projected image on a screen in an example of the projection type display device of the present invention.

FIG. 33 is a schematic diagram where the whole emergent light from the liquid-crystal panel 2 in the present example is projected through the PBS 3 and projection lens 1 onto the screen 9. As illustrated in the same drawing, the liquid-crystal panel 2 as shown in FIG. 32 is employed and optical adjustment is made so that the position of the microlenses 22 in the liquid-crystal panel 2 or a position near it is focused on the screen 9. Then the projected image is a mixture of the emergent light from the R, G, B pixel units composing the respective picture elements in the grid segments of the microlenses 22 as shown in FIG. 35; i.e., the image constructed of the constituent units of picture elements with beams of pixels mixed in each unit (900).

The present example enables to display good color images with high quality but without the so-called R, G, B mosaic structure on the screen surface by using the display panel 2 in the configuration shown in FIG. 32 and adjusting the plane of location of the microlenses 22 or the position near it in almost conjugate relation with the screen.

Figure 34:
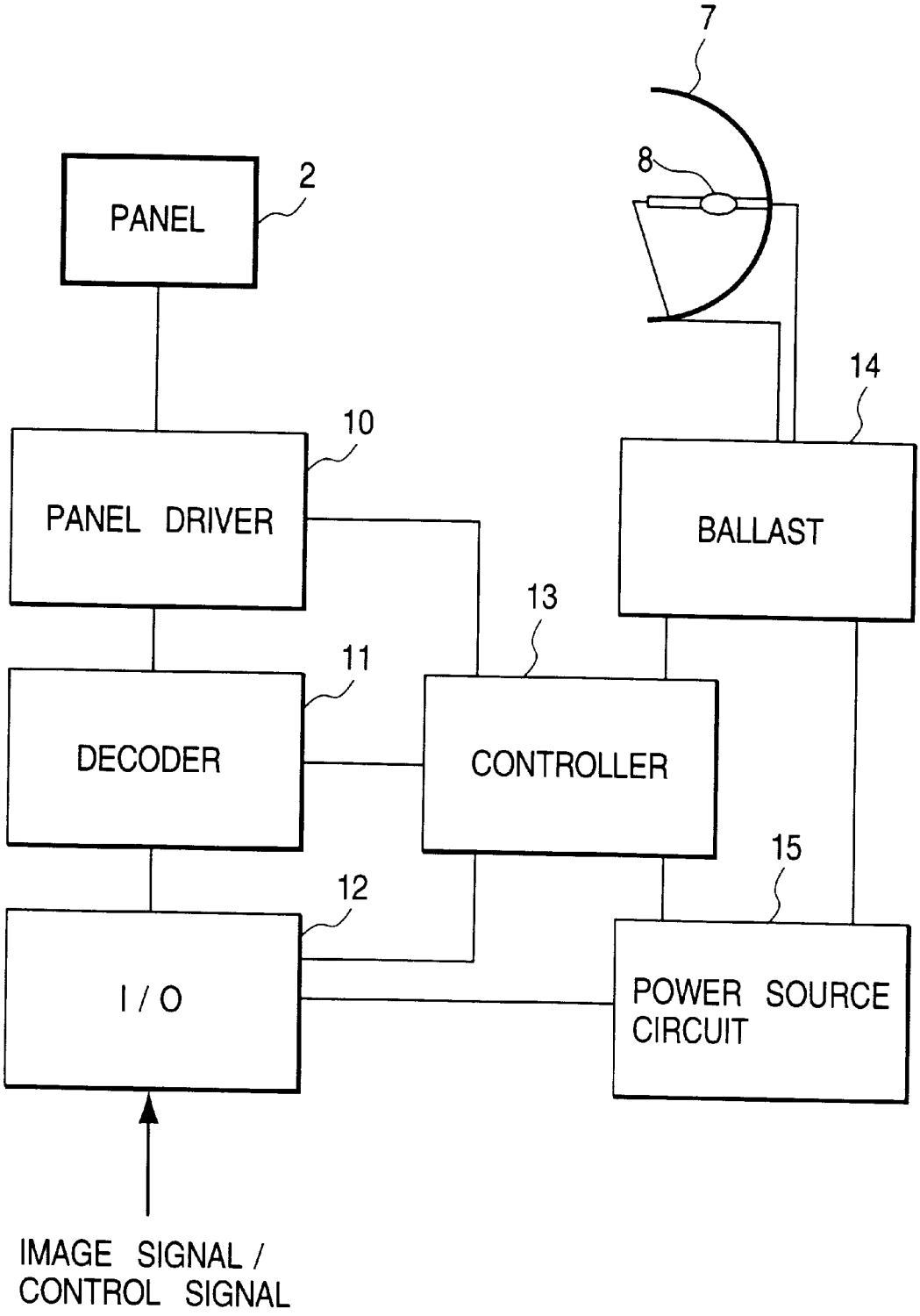
FIG. 34 is a block diagram to show a driving circuit system in the projection type display device of the present invention.

FIG. 34 shows a block diagram of the whole of the driving circuit system in the projection type liquid-crystal display device of the present embodiment.

In the drawing, reference numeral 2 designates a panel. Numeral 10 designates a panel driver, which makes the R, G, B image signals and other signals including the driving signal of opposed electrode 24, various timing signals, and so on. Numeral 12 denotes an interface, which decodes various image and control transmission signals into standard image signals etc. Numeral 11 represents a decoder, which decodes the standard image signals from the interface 12 into R, G, B primary color image signals and synchronizing signals. Numeral 14 indicates a ballast, which drives to turn the arc lamp 8 on. Numeral 15 stands for a power-supply circuit, which supplies the power to each circuit block. Numeral 13 is a controller incorporating a control section not illustrated, which systematically controls the circuit blocks described above.

In this arrangement the projection type liquid-crystal display device of the present example can display the color image of high quality without the R, G, B mosaic structure described before.

Figure 36:
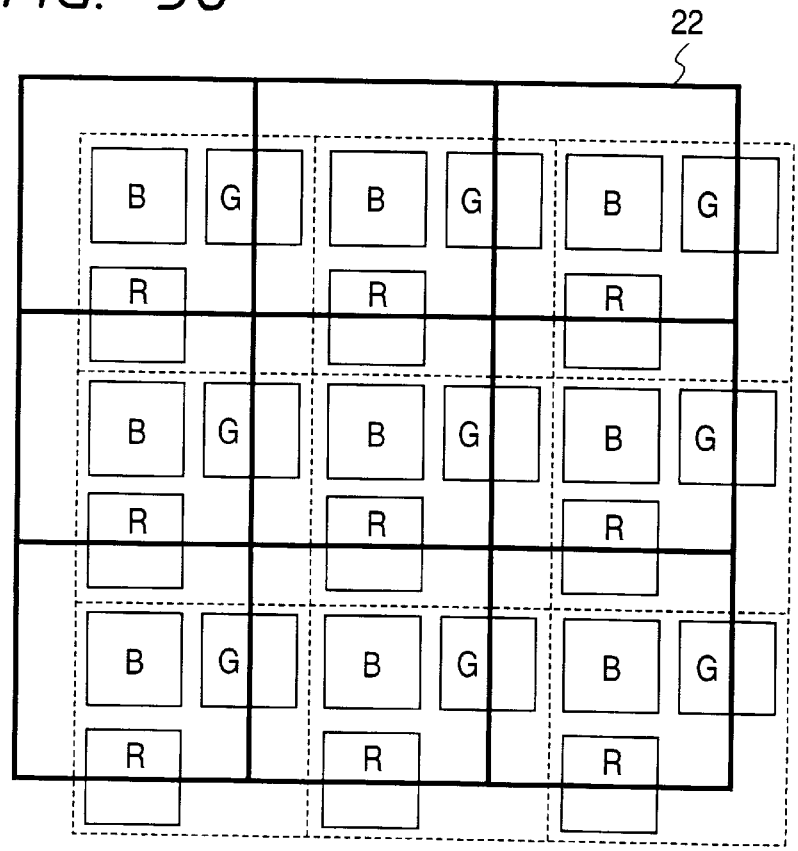
FIG. 36 is a partially enlarged top plan view of an example of the liquid-crystal panel of the present invention.

FIG. 36 is a top plan view of a partially enlarged part of another form of the liquid-crystal panel in the present example. In this form the B pixels are arranged as first color pixels at positions immediately below centers of microlenses 22, the G pixels as second color pixels are alternately arranged horizontally with respect to the B pixels, and the R pixels as third color pixels are alternately arranged vertically.

This arrangement can also achieve the same effect as in the previous example, by making the B beam normally incident and the R/G beams obliquely incident (at the same angle and in different directions) so that beams of reflected light from the R, G, B pixel units composing each picture element may go out of one common microlens. A further possible arrangement is such that the R pixels as first color pixels are arranged at positions immediately below the centers of microlenses 22 and the other color pixels are alternately arranged horizontally or vertically with respect to the R pixels.

[Eighth Embodiment]

The present embodiment shows another form of the seventh embodiment.

Figure 37:
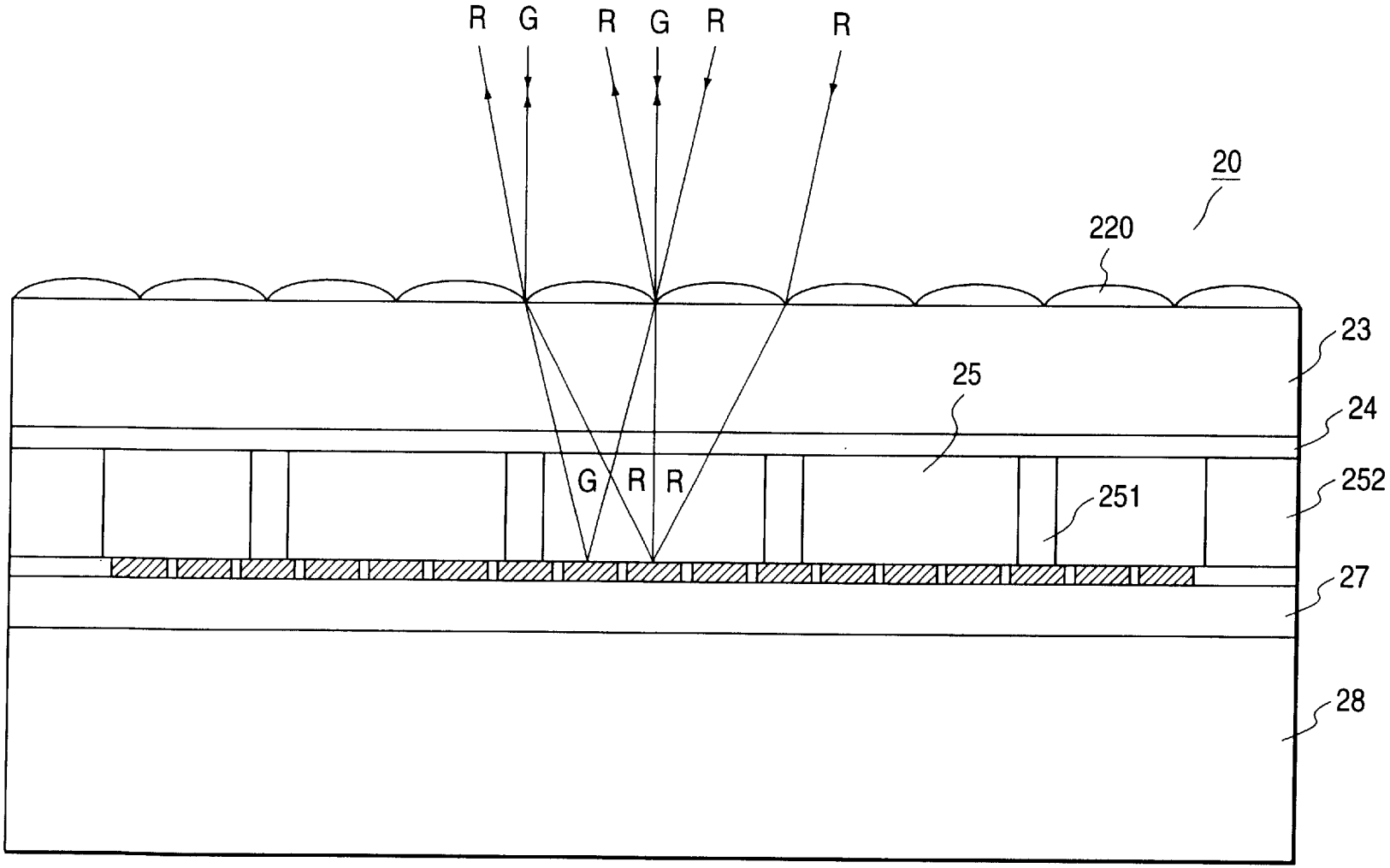
FIG. 37 is a schematic diagram to show an example of the liquid-crystal panel of the present invention.

FIG. 37 is a schematic diagram of the major part of the liquid-crystal panel 20 in the present example. This figure illustrates a cross-sectional view of partially enlarged liquid-crystal panel 20. Differences from Embodiment 7 reside in that glass sheet 23 is used as the opposed electrode substrate and that the microlenses 220 are made on the glass sheet 23 by the so-called reflow method using a thermoplastic resin. Further, spacer posts 251 are made in non-pixel portions by photolithography with a photosensitive resin.

Figure 38A:
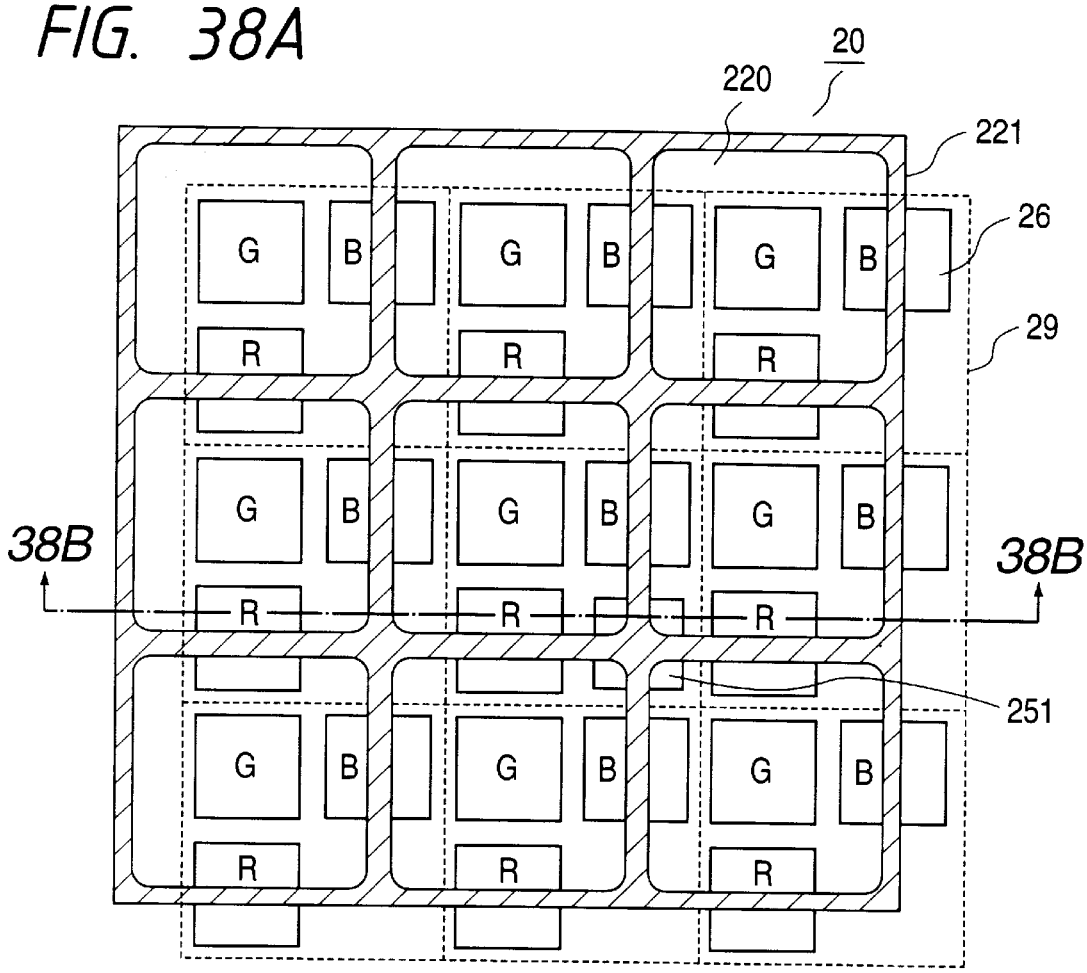
FIGS. 38A and 38B are a partially enlarged top plan view and a partially enlarged cross-sectional view, respectively, of an example of the liquid-crystal panel of the present invention.
Figure 38B:
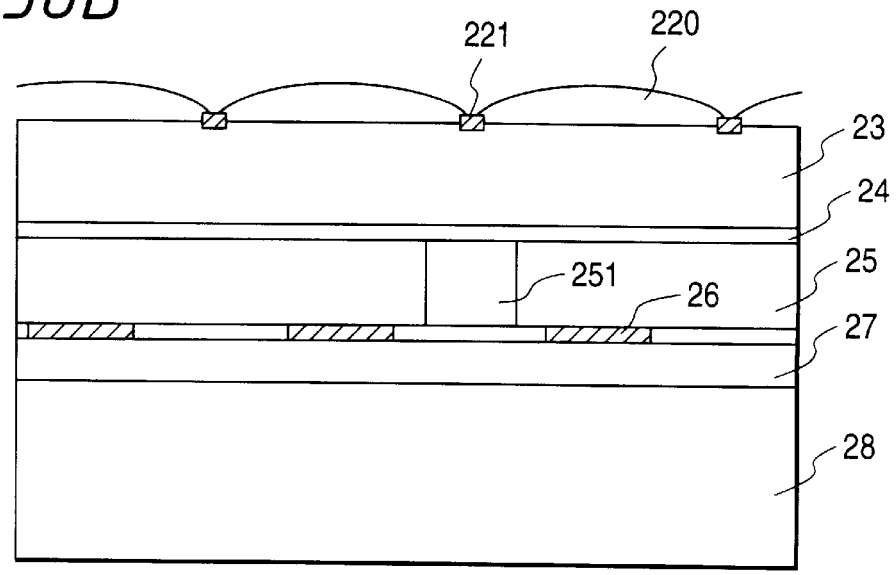

FIG. 38A shows a partial top plan view of the liquid-crystal panel 20. As seen from this figure, the spacer posts 251 are made at predetermined pixel pitch and at corners of microlenses 220 in the non-pixel regions. 38B—38B cross section through a spacer post 251 is shown in FIG. 38B. The density of the spacer posts 251 thus formed should be so determined that they are made preferably at the pitch of 10 to 100 pixels in a matrix pattern and that the number of spacer posts may satisfy contradicting parameters, flatness of glass sheet 23 and easiness of injection of liquid crystal.

In the present example there is provided a light shielding layer 221 of a metal film pattern, which prevents leak light from entering the panel through border portions between the microlenses. This prevents degradation of saturation of projected image (due to mixture of the primary color image beams) and degradation of contrast caused by the leak light. When a projection type display device is constructed by use of this liquid-crystal panel 220 as in Embodiment 7, a sharper image can be obtained with high quality accordingly.

As understood from the above description of the first to the eighth embodiments, since the present invention selectively employs the dynamic and static shift registers as the driving circuits for horizontal driving and for vertical driving in the reflection type liquid-crystal device, the present invention can enjoy such various effects that the driving circuits are optimized, the chip size of liquid-crystal display device is decreased, the consumption power is low, the reliability is high, and the freedom of design is high.

What is claimed is:

1. A matrix substrate comprising:

a plurality of pixel electrodes arranged along plural rows and columns in a matrix;

a plurality of first switching elements connected respectively to said pixel electrodes;

horizontal signal lines comprising a plurality of first wirings each connecting commonly said switching elements on each of the rows;

vertical signal lines comprising a plurality of second wirings each connecting commonly said switching elements on each of the column;

a plurality of first video signal lines for outputting a video signal;

a plurality of second video signal lines for outputting a video signal;

a plurality of second switching elements provided with a plurality of connecting wirings for connecting each of said plurality of first video signal lines to each of one group of said vertical signal lines, and being arranged per each of said plurality of connecting wirings;

a plurality of third switching elements provided with a plurality of connecting wirings for connecting each of said plurality of second video signals lines to each of the other group of said vertical signal lines, and being arranged per each of said plurality of connecting wirings;

a plurality of third wirings wherein said plurality of second switching elements are classified into groups including smaller number of plural said second switching elements, and said third wirings connect commonly gates of said second switching elements per each of the groups;

a plurality of fourth wirings, wherein said plurality of third switching elements are classified into groups including smaller number of plural said third switching elements, and said fourth wirings connect commonly to of said third switching elements per each of the groups;

a first horizontal driving circuit having a first shift register supplying a pulse to plurality of said third wirings, said first shift register being only of a dynamic type;

a second horizontal driving circuit having a second shift register supplying, a pulse to plurality of said fourth wirings, said second shift register being only of a dynamic type; and a vertical driving circuit having a shift register supplying a scanning signal to said horizontal signal lines, said shift register of said vertical driving circuit being only of a static type.

2. A matrix substrate according to claim 1, wherein said second switching elements are classified into four groups including smaller number of elements.

3. A matrix substrate according to claim 1, wherein said second switching elements are classified into two groups including smaller number of elements.

4. A matrix substrate comprising:

a plurality of pixel electrodes arranged along plural rows and columns in a matrix:

a plurality of first switching elements connected respectively to said pixel electrodes;

horizontal signal lines comprising a plurality of first wirings each connecting commonly said switching elements on each of the rows, wherein adjacent ones of said first wirings are connected commonly;

vertical signal lines comprising a plurality of second wirings each connecting commonly said switching elements on each of column;

a plurality of video signal lines for outputting a video signal;

a plurality of second switching elements provided with a plurality of connecting wirings for connecting each of said plurality of video signal wirings to each of said vertical signal lines, and being arranged per each of said plurality of connecting wirings;

a plurality of third wirings wherein said plurality of second switching elements are classified into groups including smaller number of plural said second switching elements, and said third wirings commonly gates of said second switching elements per each of groups;

a horizontal driving circuit having a shift register supplying a pulse to plurality of said third wirings, said shift register of said horizontal driving circuit being only of a dynamic type; and a vertical driving circuit having a shift register supplying a scanning signal to said horizontal signal lines, said shift register of said vertical driving circuit being only of a static type.

5. A matrix substrate comprising:

a plurality of pixel electrodes arranged along plural rows and columns in a matrix;

a plurality of first switching elements connected respectively to said pixel electrodes;

horizontal signal lines comprising a plurality of first wirings each connecting commonly said switching elements on each of the rows;

vertical signal lines comprising a plurality of second wirings connecting commonly said switching elements on each of the columns;

a plurality of first video signal lines for outputting a video signal;

a plurality of second video signal lines for outputting a video signal;

a plurality of second switching elements provided with a plurality of connecting wirings for connecting each of said plurality of first video signal lines to each of one group of said vertical signal lines, and being arranged per each of said plurality of connecting wirings;

a plurality of third switching elements provided with a plurality of connecting wirings for connecting each of said second video signal lines to each of the other group of said vertical signal lines, and being arranged per each of said plurality of connecting wirings;

a plurality of third wirings, wherein said plurality of second switching elements are classified into groups including smaller number of plural said second switching elements, and said third wirings connect commonly gates of said second switching elements per each of the groups;

a plurality of fourth wirings, wherein said third switching elements are classified into groups including smaller number of said third switching elements and said fourth wirings connect commonly gates of said third switching elements per each of the groups;

a first horizontal driving circuit having a first shift register supplying a pulse to said third wirings, said first shift register being only of a dynamic type;

a second horizontal driving circuit having a second shift register supplying a pulse to said fourth wirings, said second shift register being only of a dynamic type; and a vertical driving circuit having a shift register supplying a scanning signal to said horizontal signal lines, said shift register of said vertical driving circuit being only of a static type.

6. A liquid crystal apparatus comprising;

a) a matrix substrate comprising, a plurality of pixel electrodes arranged along plural rows and columns in a matrix, a plurality of first switching elements connected respectively to said pixel electrodes, horizontal signal lines comprising a plurality of first wirings each connecting commonly said switching elements on each of the rows, wherein adjacent ones of said plural first wirings are connected commonly, vertical signal lines comprising a plurality of second wirings each connecting commonly said switching elements on each of the columns, a plurality of video signal lines for outputting a video signal, a plurality of second switching elements provided with a plurality of connecting wirings for connecting each of said plurality of video signal lines to each of said vertical signal lines, and being arranged per each of said plurality of connecting wirings, a plurality of third wirings, wherein said plurality of second switching elements are classified into groups each including smaller number of plural said second switching elements, and said third wirings connect commonly gates of said second switching elements per each of the groups, a horizontal driving circuit having a shift register supplying a pulse to said third wirings, said shift register of said horizontal driving circuit being only of a dynamic type, and a vertical driving circuit having a shift register supplying a scanning signal to said horizontal signal lines, said shift register of said vertical driving circuit being only of a static type;

b) an opposing substrate having an opposing electrode opposing said pixel electrode; and c) a liquid crystal arranged between said matrix substrate and said opposing substrate.

7. An apparatus according to claim 6, wherein said second switching elements are classified into four groups including smaller number of elements.

8. An apparatus according to claim 6, wherein said second switching elements are classified into two groups including smaller number of ones.

9. A matrix substrate comprising:

a plurality of pixel electrodes arranged along plural rows and columns in a matrix;

a plurality of first switching elements connected respectively to said pixel electrodes;

horizontal signal lines comprising a plurality of first wirings each connecting commonly to said switching elements on each of the rows;

vertical signal lines comprising a plurality of second wirings each connecting commonly to said switching elements on each of the columns;

a plurality of video signal lines outputting a video signal;

a plurality of second switching elements provided with a plurality of connecting wirings for connecting each of said plurality of video signal lines to each of said vertical signal lines, and being arranged per each of said plurality of connecting wirings;

a plurality of third wirings, wherein said plurality of second switching elements are classified into groups each including a smaller number of plural said second switching elements, and said third wirings connect commonly to gates of said second switching elements per each of the groups;

a horizontal driving circuit having a shift register supplying a pulse to the plurality of said third wirings, said shift register of said horizontal driving circuit being only of a dynamic type; and a vertical driving circuit having a shift register supplying a scanning signal to said horizontal signal lines, said shift register of said vertical driving circuit being only of a static type.

10. A matrix substrate according to claim 9, wherein said horizontal driving circuit is CMOS.

11. A matrix substrate according to claim 9, wherein said horizontal shift register has an inverter and a booster circuit is connected to the inverter.

12. A matrix substrate according to claim 9, wherein a power source voltage of said dynamic shift register is set at a level lower than other power source voltages in said matrix substrate.

13. A matrix substrate according to claim 9, wherein at least one of said horizontal driving circuit and said vertical driving circuit comprises a driving circuit capable of transferring signals to two directions.

14. A matrix substrate according to claim 9, said matrix substrate being constructed by use of a semiconductor substrate.

15. A matrix substrate according to claim 9, said matrix substrate being constructed by use of a glass substrate.

16. A matrix substrate according to claim 9, wherein said pixel electrodes are formed by use of chemical mechanical polishing.

17. A matrix substrate according to claim 9, wherein said plurality of said second switching elements are classified into four groups each including smaller number of said second switching elements.

18. A matrix substrate according to claim 9, wherein said plurality of said second switching elements are classified into two groups each including smaller number of said second switching elements.

19. A liquid crystal device comprising:

a) a matrix substrate comprising a plurality of pixel electrodes arranged along plural rows and columns in a matrix, a plurality of first switching elements connected to said pixel electrodes, horizontal signal lines comprising a plurality of first wirings each connecting commonly to said switching elements on each of the rows, vertical signal lines comprising a plurality of second wirings each connecting commonly to said switching elements on each of the columns, a plurality of video signal lines outputting a video signal, a plurality of second switching elements provided with a plurality of connecting wirings for connecting each of said plurality of video signal wirings to each of said vertical signal lines, and being arranged per each of said plurality of connecting wirings, a plurality of third wirings, wherein said plurality of second switching elements are classified into groups including a smaller number of plural said second switching elements, and said third wirings connect commonly to gates of said second switching elements per each of the groups, a horizontal driving circuit having a shift register supplying a scanning signal to said horizontal signal lines, said shift register of said horizontal driving circuit being only of a dynamic type;

b) an opposed substrate having an opposed electrode opposing said pixel electrode; and c) a liquid crystal disposed between said matrix substrate and said opposed substrate.

20. A liquid-crystal device according to claim 19, wherein said horizontal driving circuit is CMOS.

21. A liquid-crystal device according to claim 19, wherein said horizontal shift register has an inverter and a booster circuit is connected to the inverter.

22. A liquid-crystal device according to claim 19, wherein a power source voltage of said dynamic shift register is set at a level lower than other power source voltages in said matrix substrate.

23. A liquid-crystal device according to claim 19, wherein at least one of said horizontal driving circuit and said vertical driving circuit comprises a driving circuit capable of transferring signals to two directions.

24. A liquid-crystal device according to claim 19, wherein said matrix substrate is constructed by use of a semiconductor substrate.

25. A liquid-crystal device according to claim 19, wherein said matrix substrate is constructed by use of a glass substrate.

26. A liquid-crystal device according to claim 19, wherein said pixel electrodes are formed by use of chemical mechanical polishing.

27. A display device comprising the liquid-crystal device as set forth in claim 19.

28. A display device according to claim 27, wherein a reflection type liquid-crystal panel is used as the liquid-crystal device, said liquid-crystal panel is illuminated by light emitted from a light source, and reflected light is projected through an optical system onto a screen, thereby displaying an image thereon.

29. A display device according to claim 28, wherein said reflection type liquid-crystal panel is a liquid-crystal panel comprising: a pixel unit array in which pixel units are two-dimensionally arrayed at predetermined pitch on a substrate, each pixel unit being so arranged that among three color pixels of first, second, and third color pixels a combination of the first and second color pixels are aligned in a first direction and a combination of the first and third color pixels are aligned in a second direction different from the first direction so as to share the first color pixel; and a microlens array in which a plurality of microlenses are two-dimensionally arrayed on the pixel unit array on the substrate, one pitch of said microlenses being equal to pitch of two color pixels in the first direction and in the second direction.

30. A liquid crystal device according to claim 19, wherein said plurality of said second switching elements are classified into four groups each including smaller number of said second switching elements.

31. A liquid crystal device according to claim 19, wherein said plurality of said second switching elements are classified into two groups each including smaller number of said second switching elements.

* * * * *

UNITED STATES PATENT AND TRADEMARK OFFICE

CERTIFICATE OF CORRECTION

PATENT NO. : 6,127,998
DATED : October 3, 2000
INVENTOR(S) : Takeshi Ichikawa et al.

It is certified that error appears in the above-identified patent and that said Letters Patent is hereby corrected as shown below:

Column 2,
Line 25, "the" should be deleted.

Column 6,
Line 2, "the all" should read -- all the --;
Line 27, "with" should read -- while --;
Line 51, $i=(10x10^{-15}1)/(50x10^{9})=200$ nA." should read
-- $i=(10x10^{-15}x1)/(50x10^{-9})=200$ nA. --.

Column 7,
Line 22, "$i=(10x10^{-15}1)/(6.5x10^{-6})=1.5$ nA." should read
-- $i=(10x10^{-15}x1)/(6.5x10^{-6})=1.5$ nA. --;
Line 30, "have" should read -- has --;
Line 40, "in" should read -- is --.

Column 8,
Line 19, "$i=(10x10^{-15}1)/(160x10^{-9})=62.5$ nA." should read
-- $i=(10x10^{-15}x1)/(160x10^{-9})=62.5$ nA. --;
Line 33, "$i=(10x10^{-15}1)/(102x10^{-6})=98$ pA." should read
-- $i=(10x10^{-15}x1)/(102x10^{-6})=98$ pA. --.

Column 10,
Line 36, "a reconnected" should read -- are connected --.

Column 17,
Line 27, "signal" should read -- signal. --.

Column 22,
Line 57, "43" (first occurrence) should be deleted.

Column 23,
Line 60, "dichromic" should read -- dichroic --.

Column 24,
Lines 2, 3, 14, 15, 19, 21 and 23, "dichromic" should read -- dichroic --.

UNITED STATES PATENT AND TRADEMARK OFFICE

CERTIFICATE OF CORRECTION

PATENT NO. : 6,127,998
DATED : October 3, 2000
INVENTOR(S) : Takeshi Ichikawa et al.

It is certified that error appears in the above-identified patent and that said Letters Patent is hereby corrected as shown below:

Column 29,
Line 40, "column;" should read -- columns; --;
Line 52, "signals" should read -- signal --;
Line 67, "of" should be deleted.

Column 30,
Line 30, "column;" should read -- the columns; --;
Line 41, "wirings" should read -- wirings connect --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*